US012535295B2

(12) United States Patent
Smathers et al.

(10) Patent No.: US 12,535,295 B2
(45) Date of Patent: Jan. 27, 2026

(54) FIREARMS WITH AN AMBIDEXTROUS SLIDE STOP AND/OR RELIEF

(71) Applicant: OA Defense LLC, Dayton, NV (US)

(72) Inventors: Joseph Smathers, Dayton, NV (US); Todd Powers, Dayton, NV (US)

(73) Assignee: OA DEFENSE LLC, Dayton, NV (US)

( * ) Notice: Subject to any disclaimer, the term of this patent is extended or adjusted under 35 U.S.C. 154(b) by 0 days.

(21) Appl. No.: 19/061,764

(22) Filed: Feb. 24, 2025

(65) Prior Publication Data

US 2025/0224202 A1 Jul. 10, 2025

Related U.S. Application Data

(63) Continuation of application No. 19/032,209, filed on Jan. 20, 2025, which is a continuation-in-part of application No. PCT/US2023/029136, filed on Jul. 31, 2023, which is a continuation of application No. 18/228,363, filed on Jul. 31, 2023, now Pat. No. 12,379,185, and a continuation of application No. 18/228,542, filed on Jul. 31, 2023, now Pat. No. 12,007,199.

(60) Provisional application No. 63/400,953, filed on Aug. 25, 2022, provisional application No. 63/393,891, filed on Jul. 30, 2022, provisional application No. 63/393,453, filed on Jul. 29, 2022, provisional application No. 63/393,536, filed on Jul. 29, 2022, provisional application No. 63/393,552, filed on Jul. 29, 2022.

(51) Int. Cl.

| | |
|---|---|
| ***F41A 3/68*** | (2006.01) |
| ***F41A 19/10*** | (2006.01) |
| ***F41A 19/38*** | (2006.01) |
| ***F41A 19/53*** | (2006.01) |
| ***F41C 3/00*** | (2006.01) |
| ***F41C 23/10*** | (2006.01) |
| ***F41G 1/02*** | (2006.01) |

(52) U.S. Cl.

CPC ..... *F41G 1/02* (2013.01); *F41A 19/10* (2013.01); *F41A 19/38* (2013.01); *F41A 19/53* (2013.01); *F41C 3/00* (2013.01); *F41C 23/10* (2013.01)

(58) Field of Classification Search

CPC ..... F41A 3/68; F41A 3/72

See application file for complete search history.

(56) References Cited

U.S. PATENT DOCUMENTS

| | | | |
|---|---|---|---|
| 984,519 | A | 2/1911 | Browning |
| 1,410,266 | A | 3/1922 | Pedersen |
| 1,618,510 | A | 2/1927 | Browning |

(Continued)

FOREIGN PATENT DOCUMENTS

| | | | |
|---|---|---|---|
| WO | 2018102458 | A2 | 6/2018 |

OTHER PUBLICATIONS

International Search Report and Written Opinion dated Oct. 19, 2023 received in PCT/US2023/29136 filed on Jul. 31, 2023.

(Continued)

*Primary Examiner* — J. Woodrow Eldred

(74) *Attorney, Agent, or Firm* — HUNTON ANDREWS KURTH LLP

(57) ABSTRACT

The application pertains to 1911 style firearms. In some embodiments, the firearm frame comprises a relief to capture debris. In some embodiments, the firearm has an ambidextrous slide stop.

12 Claims, 36 Drawing Sheets

(56) References Cited

U.S. PATENT DOCUMENTS

| | | | | |
|---|---|---|---|---|
| 2,404,118 | A | 7/1946 | Yawman | |
| 3,365,829 | A | 1/1968 | Shockey | |
| 3,682,040 | A | 8/1972 | Roy | |
| 4,023,296 | A | 5/1977 | Frisoli | |
| 4,109,403 | A | 8/1978 | Badali | |
| 4,232,583 | A | 11/1980 | Harrison | |
| 4,338,740 | A | 7/1982 | Miller | |
| 4,539,770 | A | 9/1985 | Bornancini | |
| 4,593,487 | A | 6/1986 | Ruger et al. | |
| 4,681,020 | A * | 7/1987 | Polanecky | F41A 35/06 89/196 |
| 4,709,497 | A | 12/1987 | Resca | |
| 5,212,327 | A * | 5/1993 | Schuemann | F41A 35/06 42/70.01 |
| 5,822,903 | A | 10/1998 | Davis, Sr. | |
| 6,116,137 | A | 9/2000 | Strahan | |
| 6,205,694 | B1 | 3/2001 | Davis, Sr. | |
| 7,313,996 | B2 | 1/2008 | Werner | |
| 9,068,790 | B2 | 6/2015 | La Vigne | |
| 9,696,101 | B2 | 7/2017 | Kada | |
| 10,794,648 | B2 | 10/2020 | Henninger et al. | |
| 11,248,869 | B2 | 2/2022 | Lopata | |
| 11,719,499 | B1 | 8/2023 | Hynds | |
| 11,846,483 | B1 * | 12/2023 | Smathers | F41A 3/66 |
| 12,007,199 | B2 | 6/2024 | Smathers | |
| 2004/0035286 | A1 | 2/2004 | Spinner | |
| 2006/0064914 | A1 | 3/2006 | Greer | |
| 2012/0117841 | A1 | 5/2012 | Joubert et al. | |
| 2013/0269233 | A1 | 10/2013 | Chin | |
| 2016/0047613 | A1 | 2/2016 | Hudson, III | |
| 2017/0030673 | A1 | 2/2017 | Lee | |
| 2017/0108304 | A1 | 4/2017 | Heizer | |
| 2018/0058792 | A1 | 3/2018 | Schirmer et al. | |
| 2019/0041150 | A1 | 2/2019 | Lopata et al. | |
| 2019/0137206 | A1 | 5/2019 | Lopata | |
| 2020/0025501 | A1 | 1/2020 | Price | |
| 2021/0131764 | A1 | 5/2021 | Padovan | |

OTHER PUBLICATIONS

Video entitled "Walther PPQ Armorer's Bench—Nomenclature", published Sep. 14, 2021. Selected screenshots are included herewith. Video is available at https://vimeo.com/605089073.

Beretta PX4 Storm Compact User Manual, 3rd Issue, Published Feb. 2021.

Internet forum post on pistol-forum.com from user "PX4 Storm Tracker" posted May 7, 2020. Screenshot is included herewith. Post is available at https://pistol-forum.com/showthread.php?42291-Searching-for-Beretta-PX4-right-side-slide-release.

Beretta Store web pages, date unknown. Screenshots are included herewith. Pages are available at https://estore.beretta.com/en-nl/product/px4-compact-slide-catch-C5D234 and https://estore.beretta.com/en-nl/product/slide-catch-lever-lh-for-px4-storm-compact-C5D235.

International Search Report and Written Opinion dated Oct. 19, 2023 issued in PCT/US2023/29136.

Notification Concerning Transmittal of International Preliminary Report on Patentability from related PCT Application No. PCT/US2023/029136, mailed Feb. 4, 2025, 13 pages.

* cited by examiner

FIREARMS WITH AN AMBIDEXTROUS SLIDE STOP AND/OR RELIEF

CROSS-REFERENCE TO RELATED APPLICATIONS

This application is a continuation of U.S. application Ser. No. 19/032,209 filed Jan. 20, 2025 which application was a continuation-in-part of PCT/US2023/029136 filed on Jul. 31, 2023 which application claimed priority to U.S. application Ser. No. 18/228,405 which claims priority to U.S. Provisional Application No. 63/393,453 filed Jul. 29, 2022, U.S. application Ser. No. 18/228,394 filed Jul. 31, 2023 which claims priority to U.S. Provisional Application No. 63/393,536 filed Jul. 29, 2022, U.S. application Ser. No. 18/228,379 which claims priority to U.S. Provisional Application No. 63/393,552 filed Jul. 29, 2022, U.S. application Ser. No. 18/210,457 filed Jun. 15, 2023 which claims priority to U.S. Provisional Application No. 63/400,953 filed Aug. 25, 2022, and U.S. application Ser. No. 18/219,514 which claims priority to U.S. Provisional Application No. 63/393,891 filed Jul. 30, 2022, and U.S. application Ser. No. 18/228,363 filed Jul. 31, 2023, the contents of which are incorporated by reference herein. This application relates to U.S. Pat. No. 984,519 filed on Feb. 17, 1910, the contents of which are incorporated herein in its entirety.

FIELD OF THE DISCLOSURE

The present disclosure relates to a firearm in the style of the 1911 handgun but with several beneficial modifications.

BACKGROUND AND SUMMARY

Hand pistols taught by U.S. Pat. No. 984,519, or some variation thereof, (each a "1911") have been in production for over one-hundred years. During that time, the 1911 has developed a loyal following for a variety of reasons. Unfortunately, certain features of the 1911 are not optimized. Accordingly, it would be beneficial to have a firearm that is capable of satisfying 1911 loyalists while improving upon certain non-optimized features.

Conventional hand pistols have unitary grips and/or frames that makes any customization of features difficult. That is, to mount a gas pedal, i.e., a support hand thumb rest, traditional pistols require replacing the slidestop which can cause difficulty locking the slide. Other configurations may require making unsightly aftermarket holes in the receiver which may reduce re-sale value and/or cause functional problems with the pistol. Yet other configurations may damage the grip, frame, or other components of the firearm. Still other configurations prevent mounting of traditional optics and/or are not securely attached and therefore disrupt accuracy.

What is needed are new firearm systems that allow for ready customization of the pistols. It would further be desirable if such systems were user-friendly, reliable, robust, and/or allowed for customization of such features as gas pedals, take-down levers, and/or other thumb support. Advantageously, the systems described herein accomplish at least one or more up to all of the aforementioned needs.

In one embodiment, the application pertains to a modular firearm frame. The frame has a length which is straight at a top and wherein the straight length then extends downward to form a grip. The frame comprises a recessed socket face located at a position in the straight length of the frame. A removable finger interface is configured to fit within and attach to the recessed socket face. Advantageously, the removable finger interface may one or more accessories so that accessories may be readily added, removed, or changed without any permanent alteration of the frame.

In some aspects, the techniques described herein relate to a firearm including: a frame including a block member recess and a pin connector member recess; a barrel; a slide; a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow; a magazine catch including a catch body, a catch spring, and a release mechanism configured to disengage the magazine catch; and a magazine catch retainer plate positioned between a trigger shoe and the magazine catch, wherein the magazine catch retainer plate is configured to prevent the catch spring of said magazine catch from buckling into a trigger cavity behind the trigger shoe; a hammer pivotally coupled to an upper portion of the frame; a mainspring assembly coupled to a lower portion of the frame; a hammer strut extending between the hammer and the mainspring assembly; the mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; a retention mechanism configured to secure the mainspring assembly in position relative to the frame, thereby securing the position of the mainspring relative to the frame; wherein the retention mechanism extends through a portion of the frame into engagement with the retention clip, securing the mainspring assembly relative to the frame by way of the retention clip; a slide stop including: a first portion configured to be removably attached to a side of the frame; a second portion configured to be removably attached to an opposite side of the frame of the handgun; the first portion including a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide; the second portion including a lever; and a mating mechanism between the first portion and the second portion, wherein the mating mechanism includes a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame; a relief in the inner surface of the frame wherein the relief is coaxially situated on the inner surface of the frame; a barrel lug configured to removably attach the barrel to the frame, wherein the barrel lug further includes a first flute and a second flute. a sight block including: a block member configured to removably attach to the block member recess; a barrel hole; a pin hole below the barrel hole; a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a firearm including: a frame; a barrel; a slide; a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow; a magazine catch including a catch body, a catch spring, and a release mechanism configured to disengage the magazine catch; and a magazine catch retainer plate positioned between a trigger shoe and the magazine catch, wherein the magazine catch retainer plate is configured to prevent the catch spring of said magazine catch from buckling into a trigger cavity behind the trigger shoe; a hammer pivotally coupled to an upper portion of the frame; a mainspring assembly coupled to a lower portion of the frame; a hammer strut extending between the hammer and the mainspring assembly; the mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; a retention mechanism configured to secure the mainspring assembly in position relative to the frame, thereby securing the position of the mainspring relative to the frame; and wherein the retention mechanism extends through a portion of the frame into engagement with the retention clip, securing the mainspring assembly relative to the frame by way of the retention clip.

In some aspects, the techniques described herein relate to a firearm including: a slide stop including: a first portion configured to be removably attached to a side of the frame; a second portion configured to be removably attached to an opposite side of the frame of the handgun; the first portion including a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide; the second portion including a lever; and a mating mechanism between the first portion and the second portion, wherein the mating mechanism includes a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame; a relief in the inner surface of the frame wherein the relief is coaxially situated on the inner surface of the frame; a barrel lug configured to removably attach the barrel to the frame, wherein the barrel lug further includes a first flute and a second flute. a sight block including: a block member configured to removably attach to the block member recess; a barrel hole; a pin hole below the barrel hole; a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

U.S. Pat. No. 984,519 (FIG. 1), the pistol shown in a rest configuration.

Figure 1A:
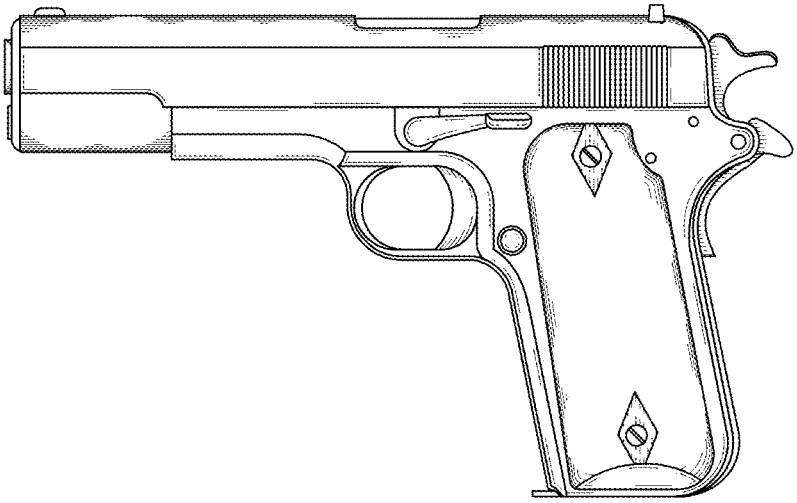
FIG. 1A is side view of a hand pistol of the prior art, the image taken from U.S. Pat. No. 984,519 (FIG. 1), the pistol shown in a rest configuration.

FIG. 1A is side view of a hand pistol of the prior art, the image taken from U.S.

Figure 1B:
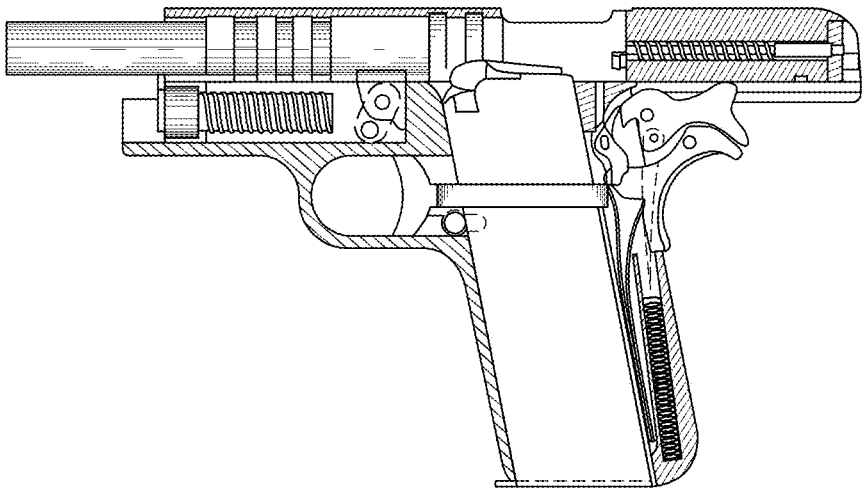

FIG. 1B shows the pistol of FIG. 1A in a loading configuration, a portion of the pistol removed to show internal components thereof.

Figure 2:
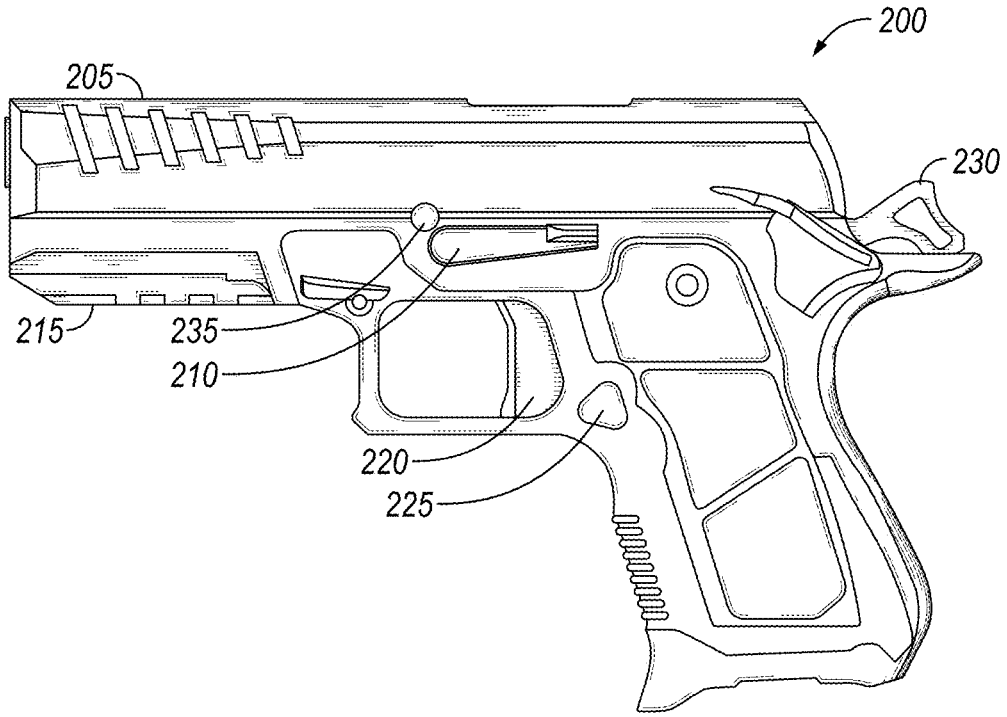
Figure 3A:
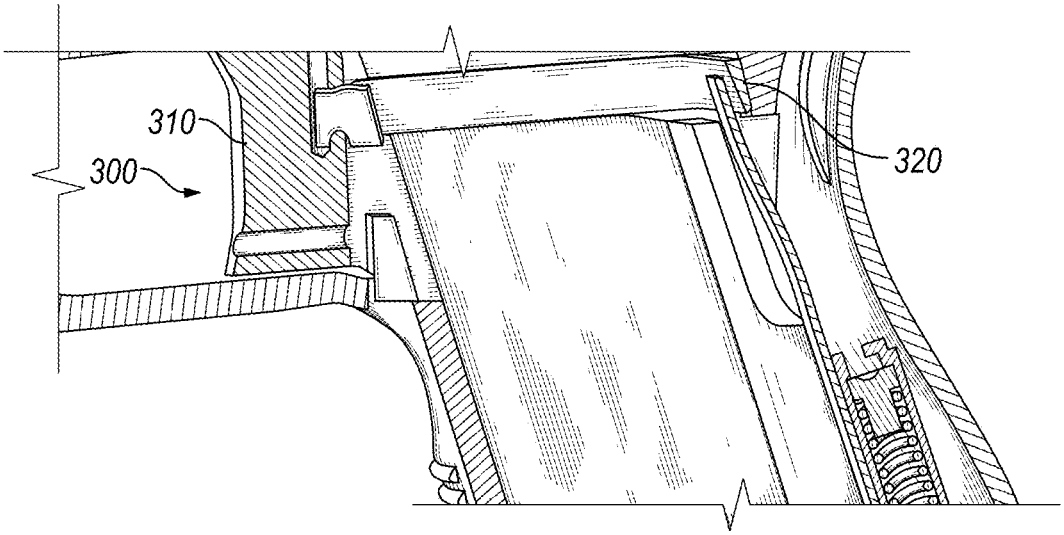
Figure 3B:
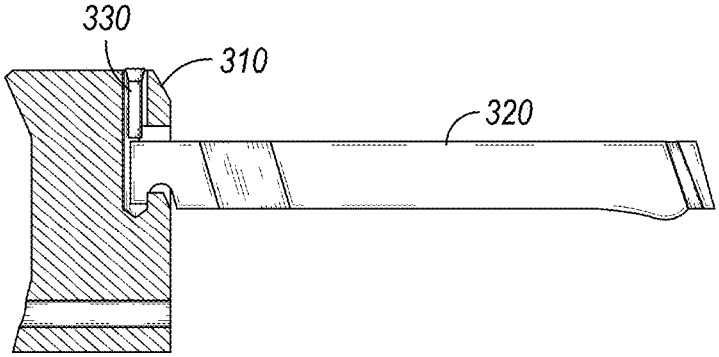
Figure 3C:
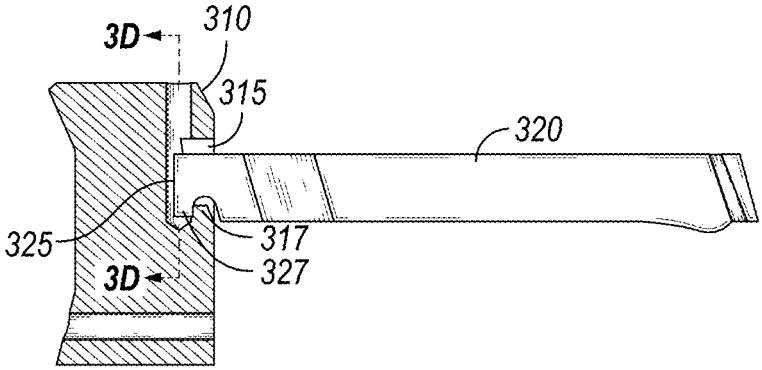
Figure 3D:
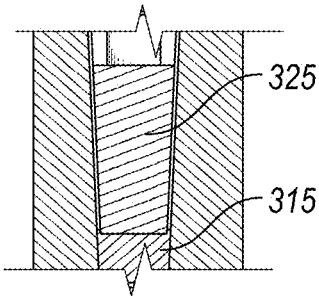
Figure 3E:
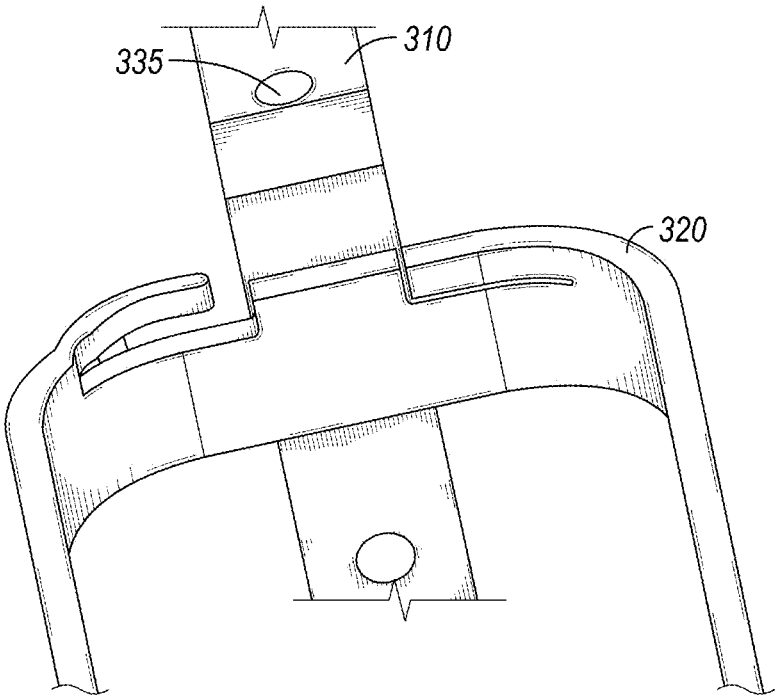
Figure 3F:
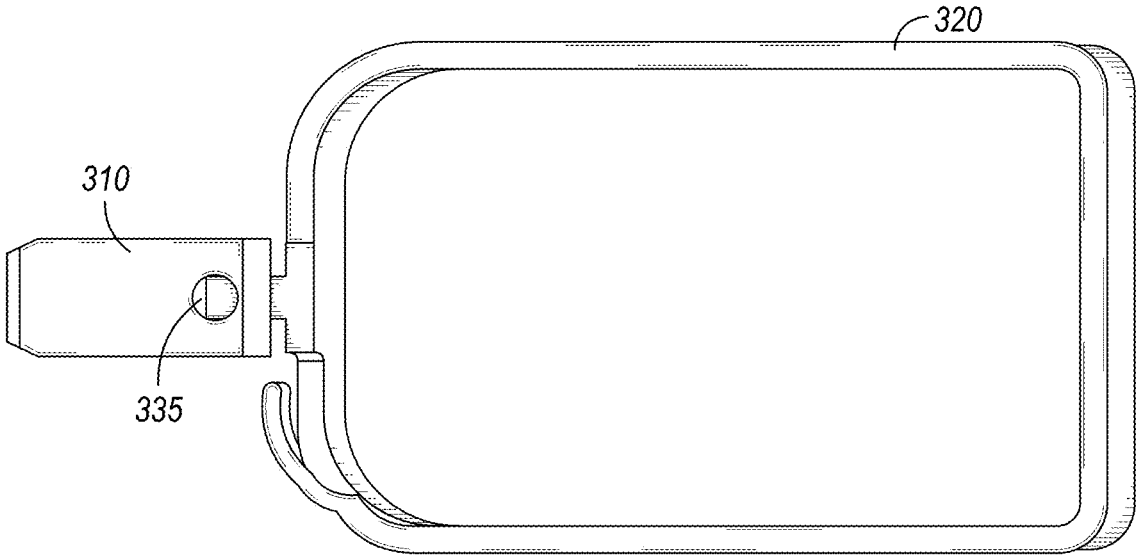

FIG. 2 is a diagram of a firearm according to an exemplary embodiment.

FIGS. 3A-3F illustrates an improved firearm embodiment incorporates a trigger shoe assembly, comprising a trigger shoe and a trigger bow, providing enhanced functionality and adjustability.

Figure 4A:
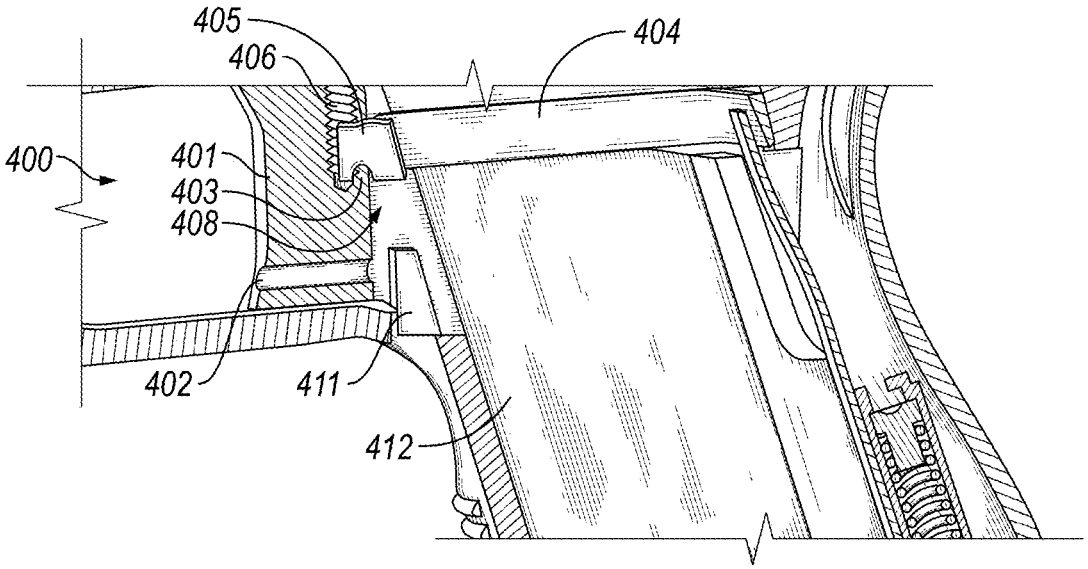

FIG. 4A shows a firearm according to an exemplary embodiment.

Figure 4B:
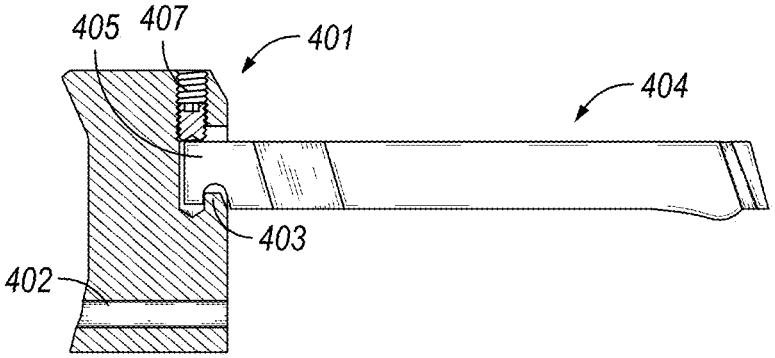

FIG. 4B is a partial perspective sectional side view of a firearm of FIG. 4A, the hand pistol including a magazine catch retainer plate positioned between a trigger shoe and a magazine catch.

Figure 4C:
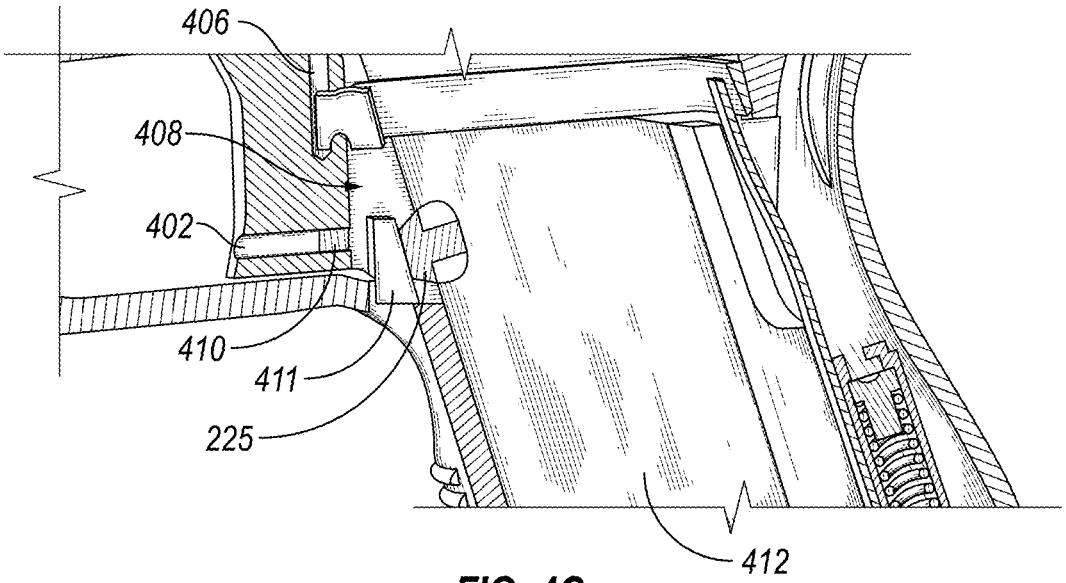

FIG. 4C is a partial perspective sectional view of the trigger shoe and the trigger bow 404.

Figure 4D:
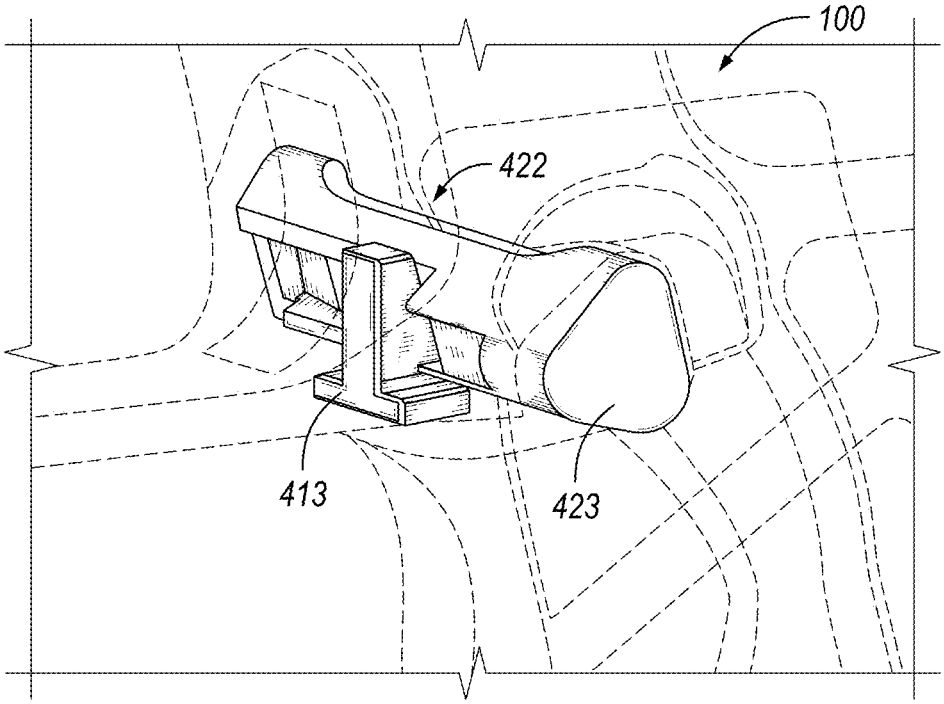
Figure 4E:
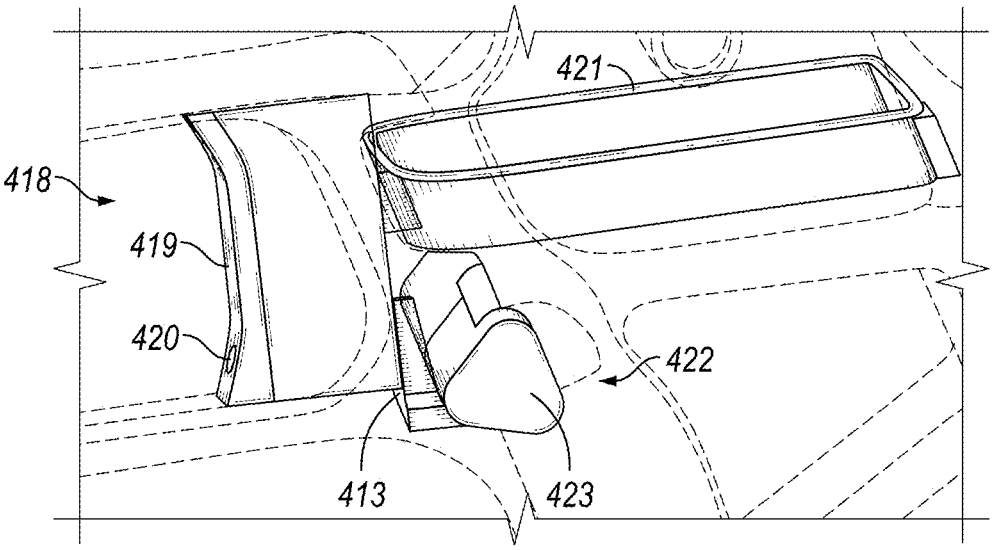

FIGS. 4D and 4E illustrate how the magazine catch plate interacts with the magazine catch and the trigger shoe assembly.

Figure 4F:
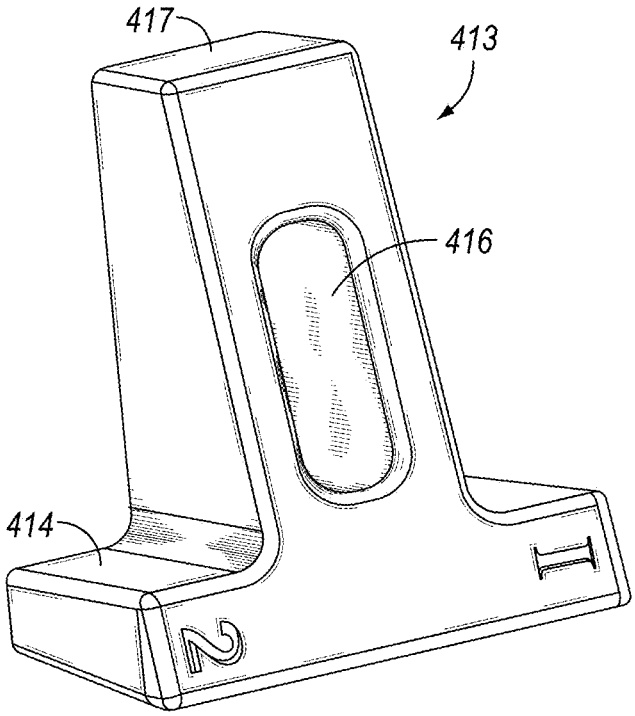
Figure 4G:
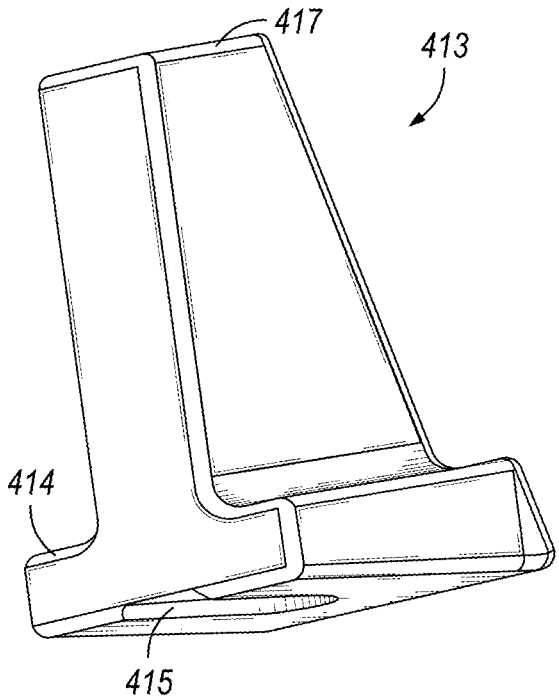

FIGS. 4F and 4G illustrate a magazine catch plate with an upper portion, a lower portion, and a recess.

Figure 5A:
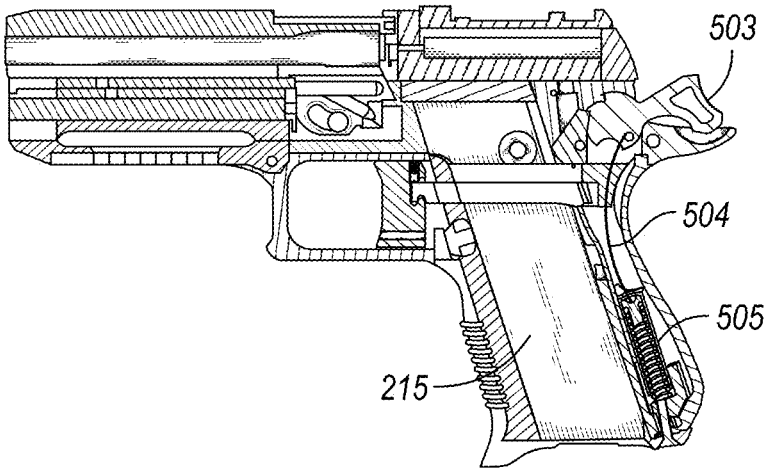
Figure 5B:
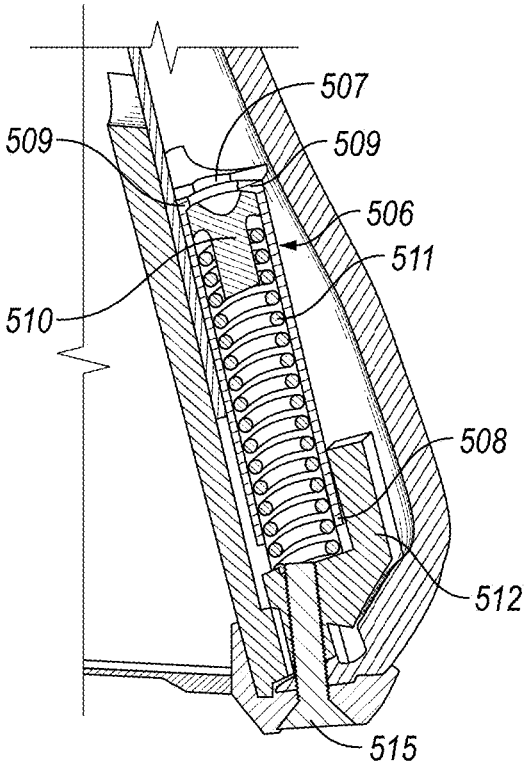
Figure 5C:
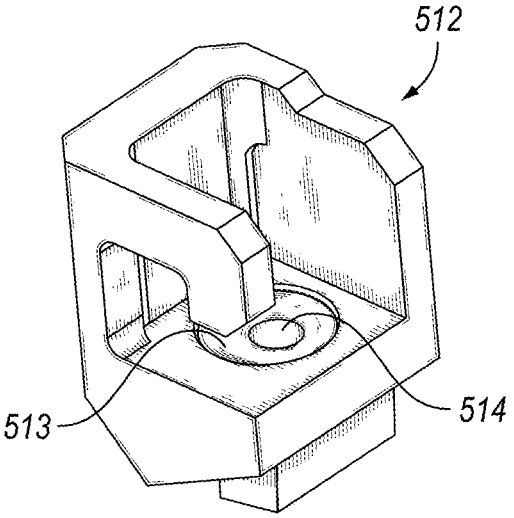

FIGS. 5A-5C illustrate a firearm of the present invention includes a frame, which serves as the structural foundation of the firearm.

Figure 5D:
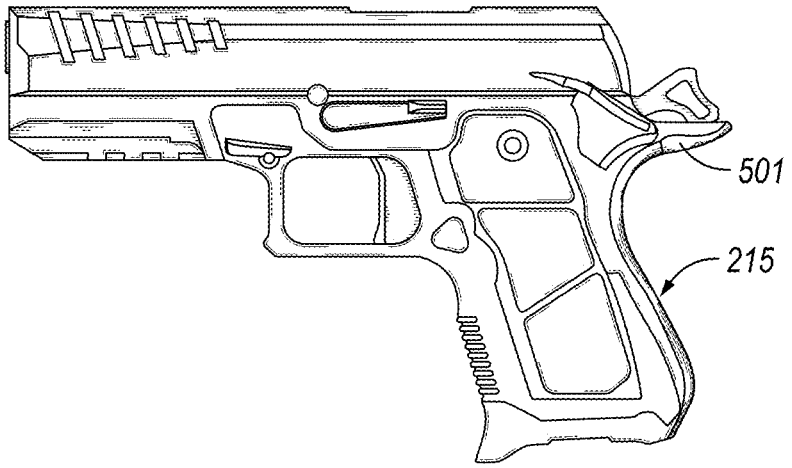
Figure 5E:
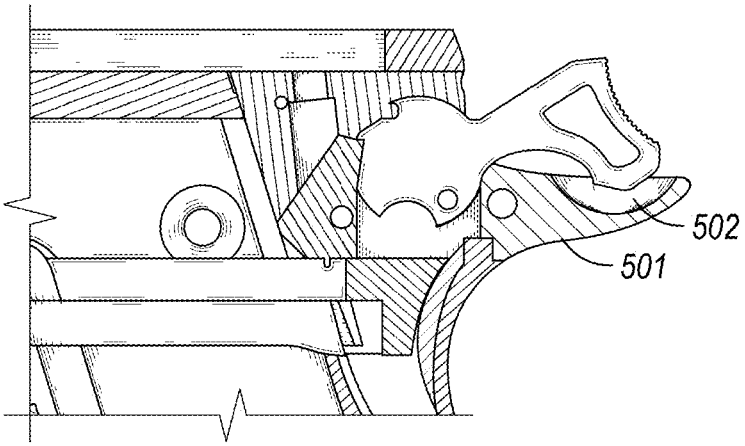
Figure 5F:
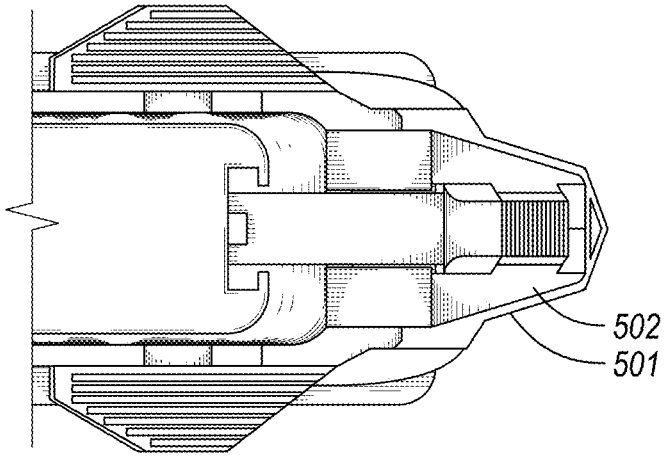

FIGS. 5D-5F, illustrate a frame having an integral beavertail.

Figure 6A:
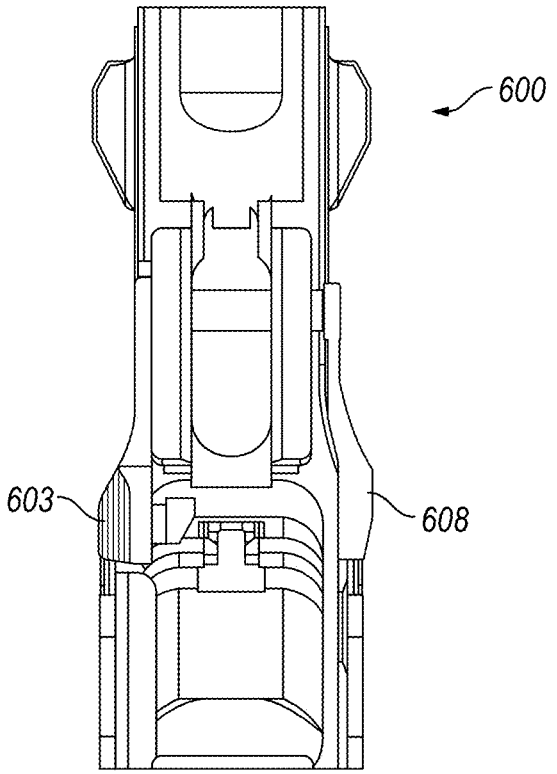
Figure 6B:
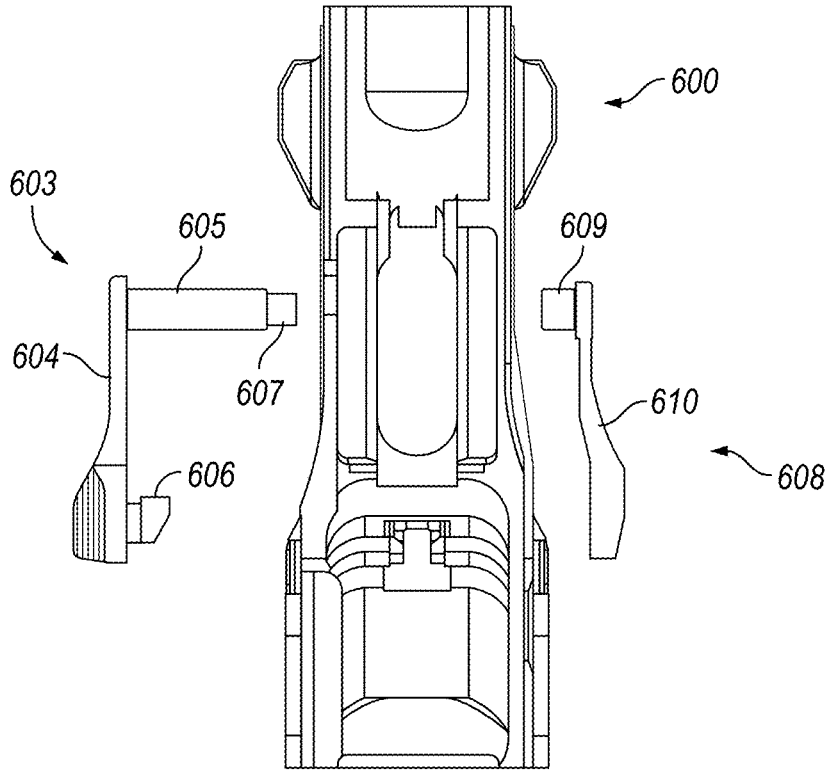

FIGS. 6A and 6B are top-down views of the firearm with the slide stop having a first portion and a second portion attached removably to the frame.

Figure 6C:
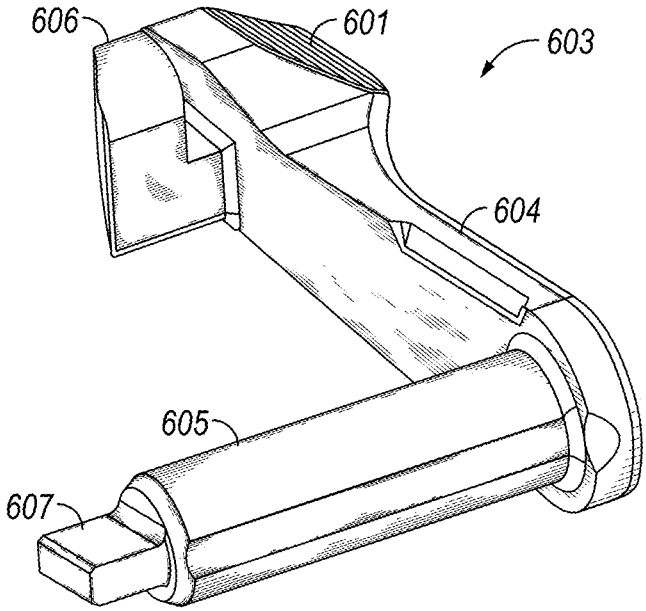
Figure 6D:
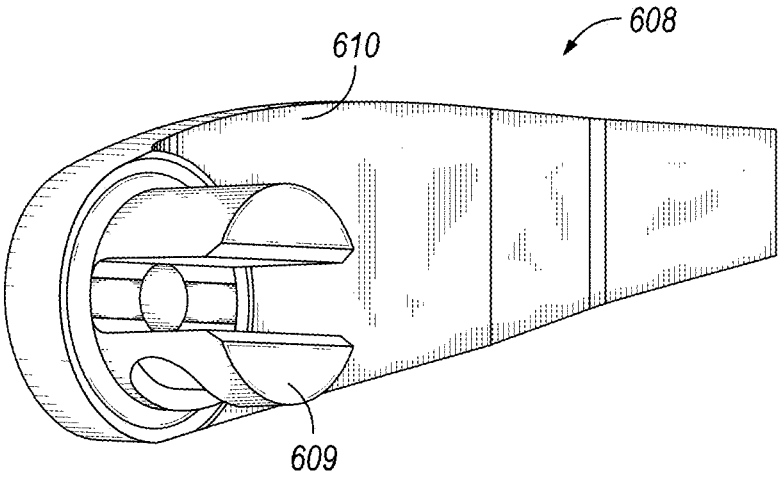

FIGS. 6C and 6D illustrate the first portion and the second portion in greater detail.

Figure 6E:
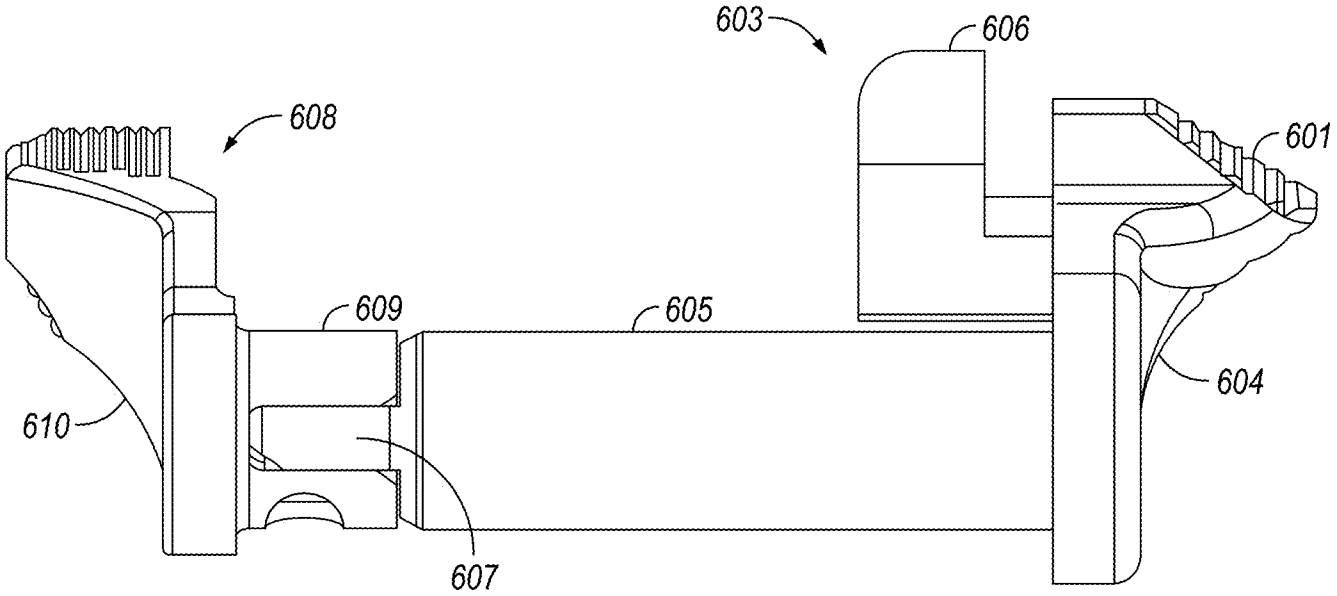

FIG. 6E illustrates the first portion and the second portion mated together but outside the context of the frame.

Figure 7A:
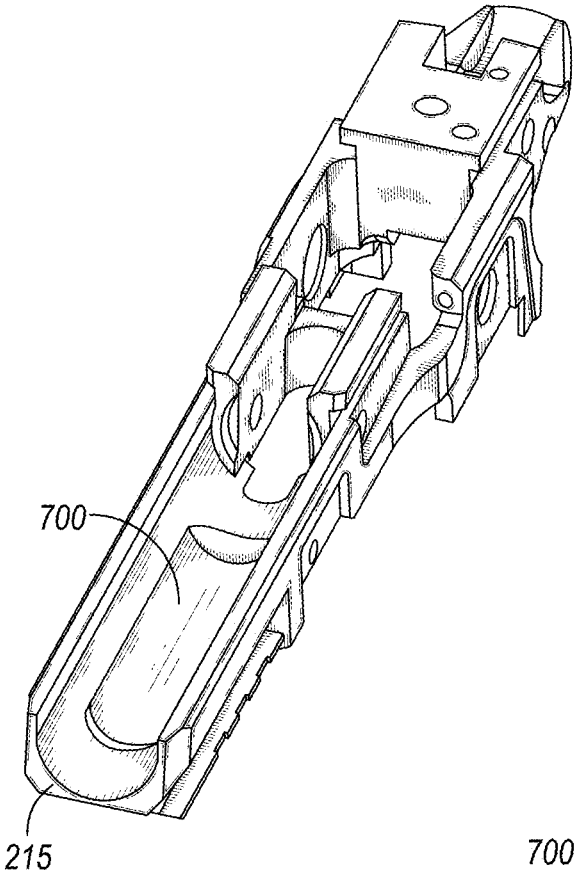
Figure 7B:
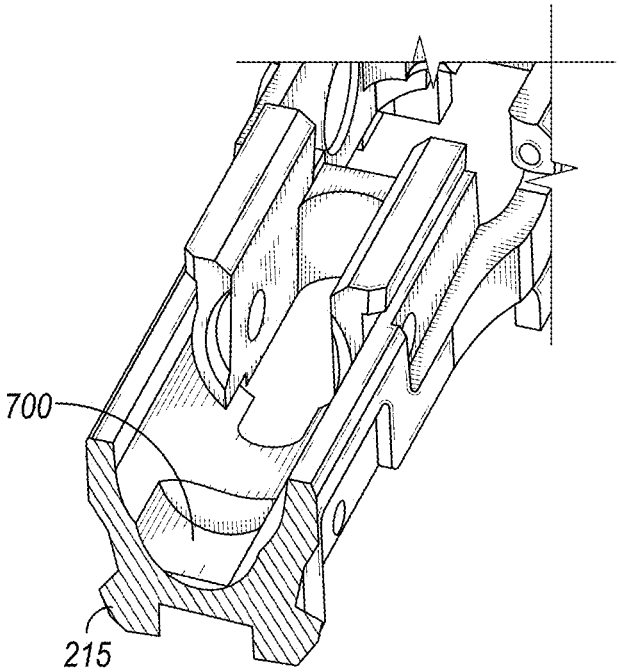
Figure 7C:
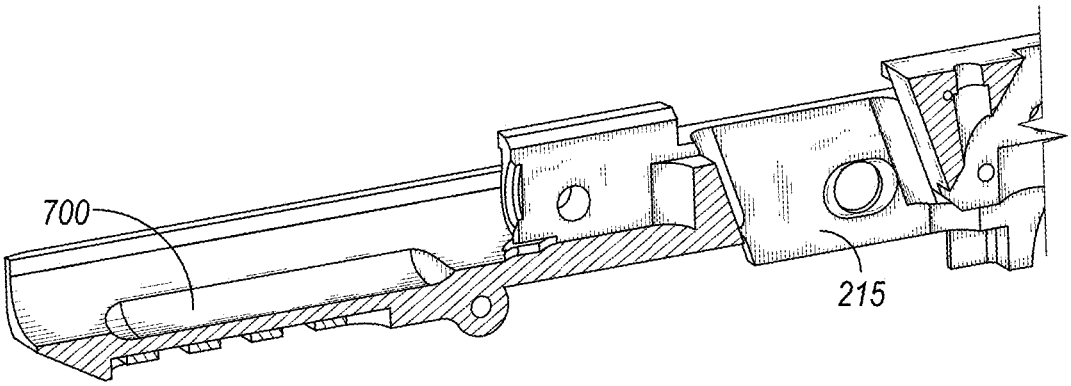

FIGS. 7A-7C is an elevation view of a portion of the frame with a relief.

Figure 7D:
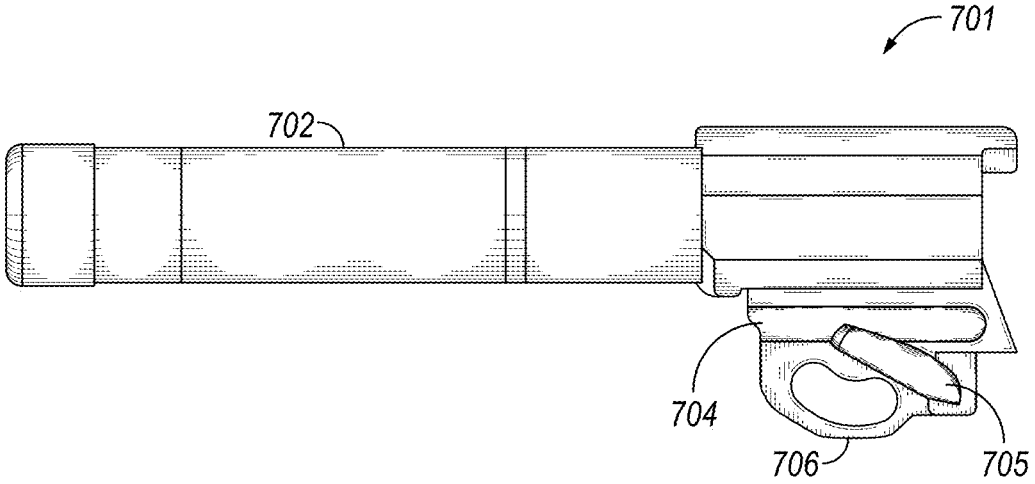
Figure 7E:
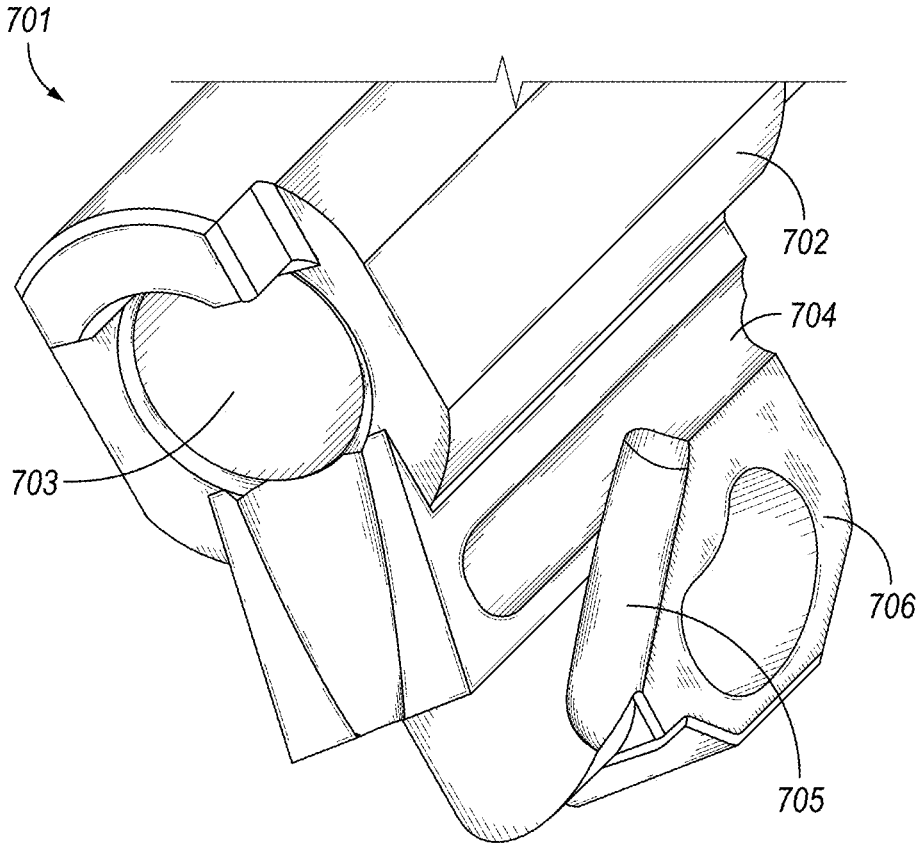

FIGS. 7D-7E, illustrates a barrel can have a cylindrical body, a barrel exterior, a barrel interior, and a barrel lug configured to be coupled to the frame so as to facilitate rocking the barrel between loading and firing positions.

Figure 7F:
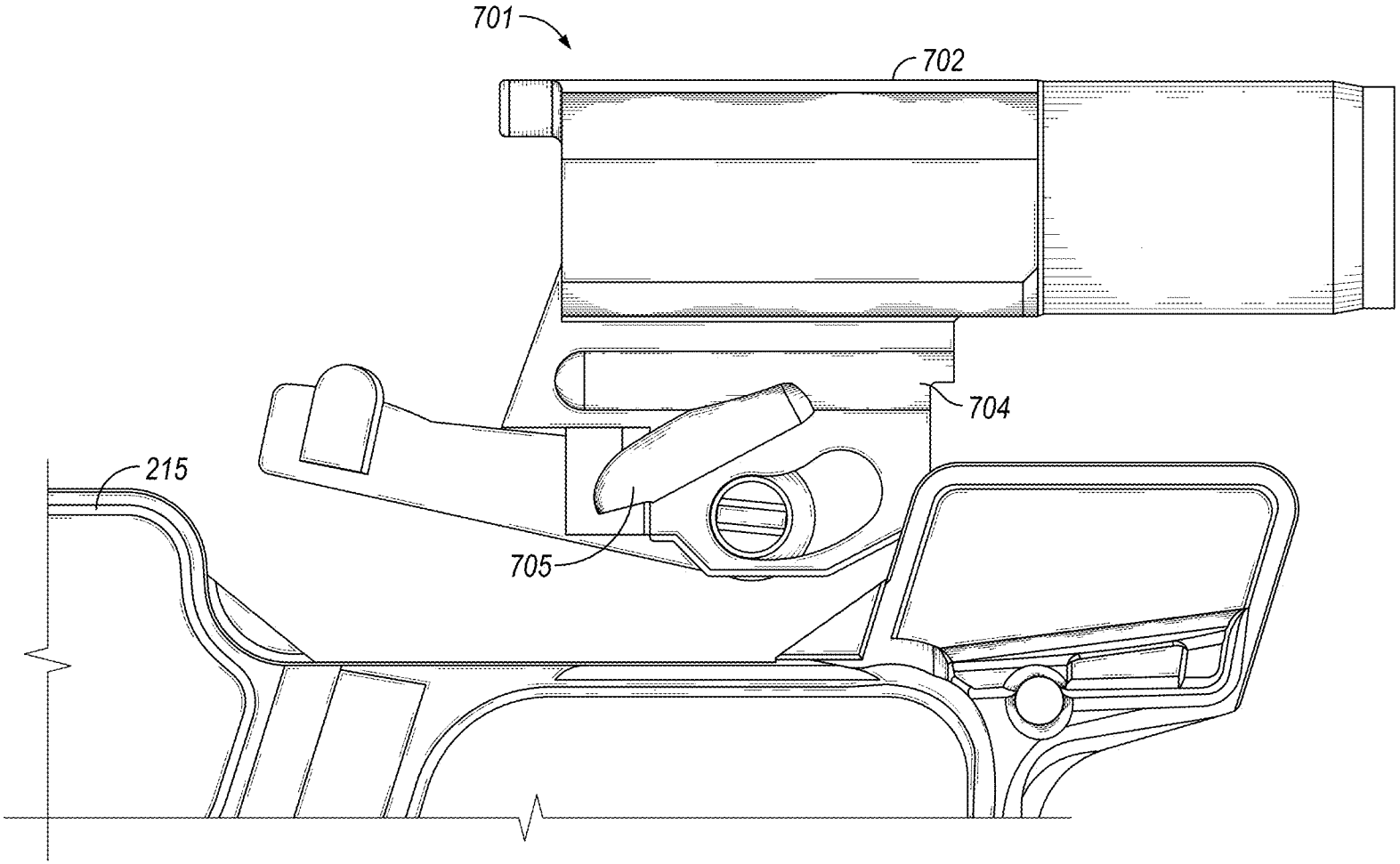

FIG. 7F shows a side elevation view of the barrel and the frame.

Figure 8A:
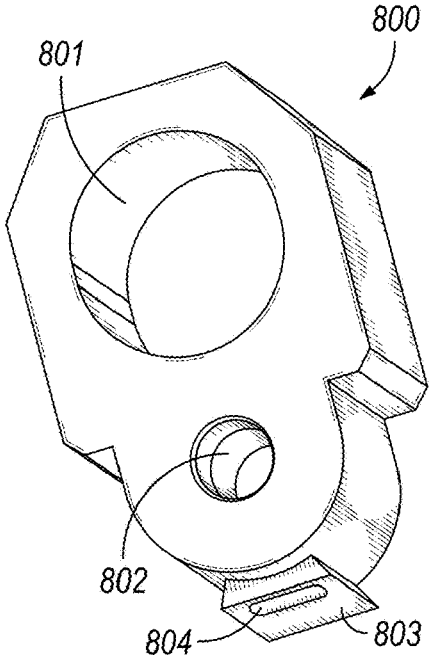

FIG. 8A is a perspective view of the sight block.

Figure 8B:
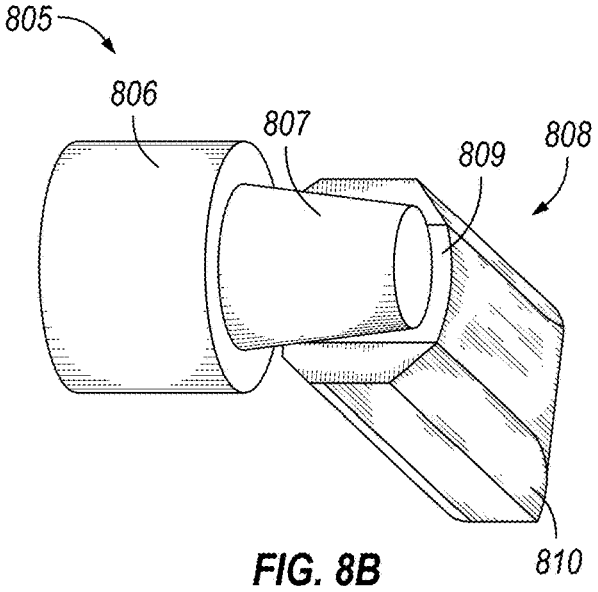
Figure 8C:
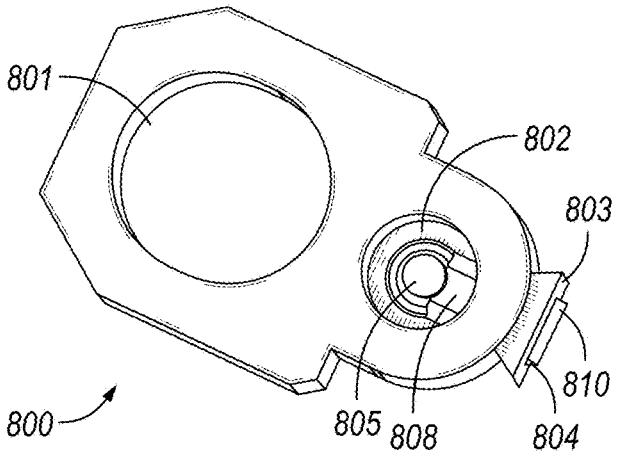

FIGS. 8A, 8B, and 8C illustrate a modular sight block according to an exemplary embodiment.

Figure 8D:
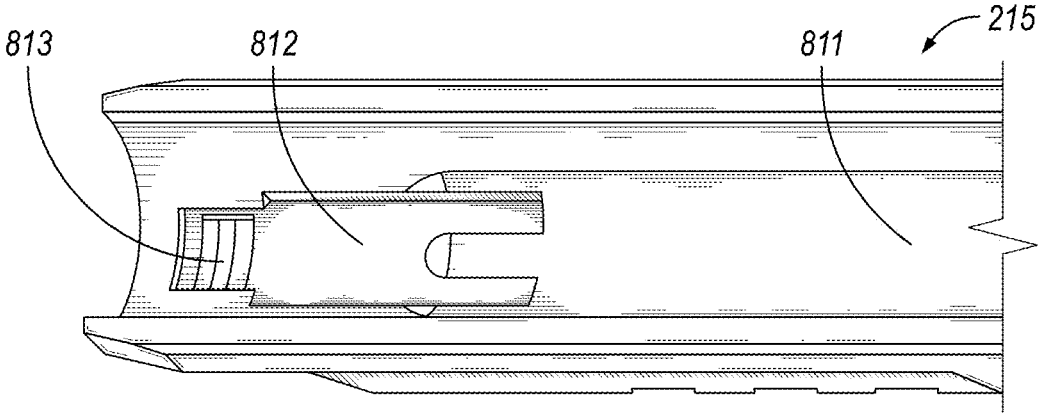
Figure 8E:
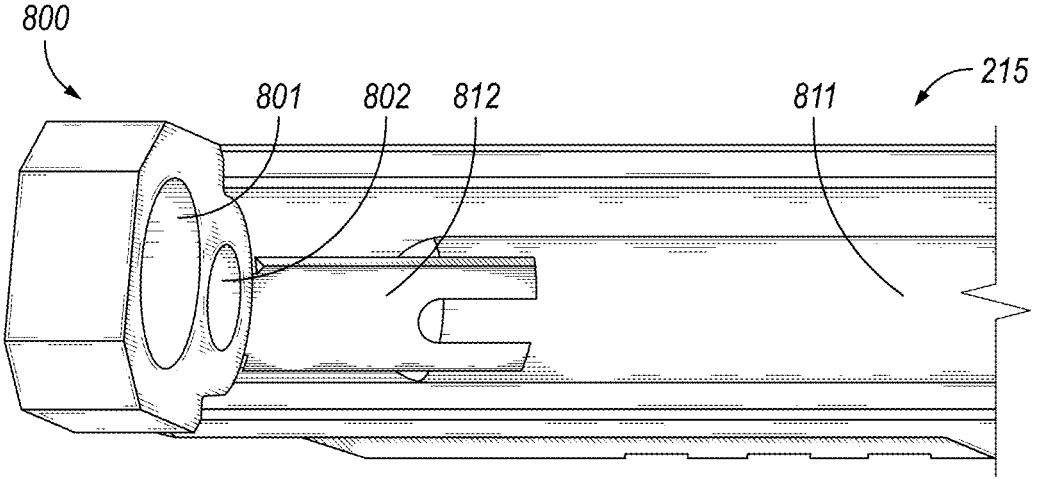
Figure 8F:
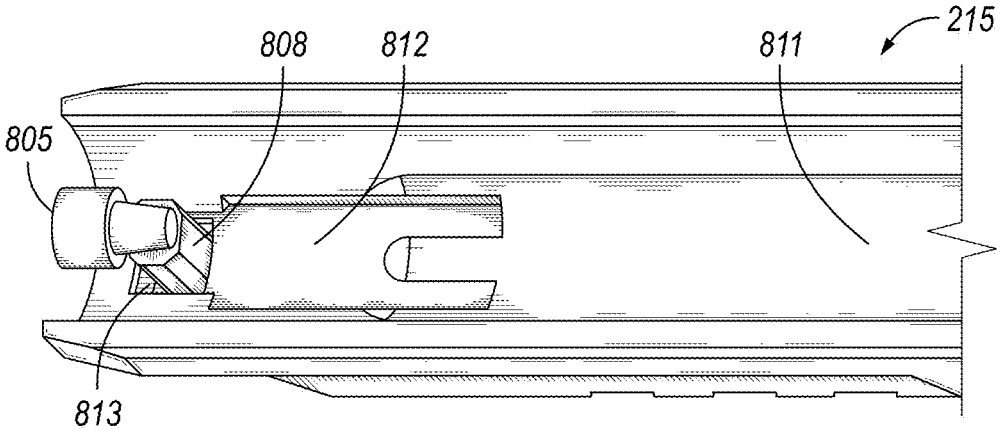

FIGS. 8D, 8E, and 8F illustrate a firearm frame with and without a modular sight block according to an exemplary embodiment.

Figure 9A:
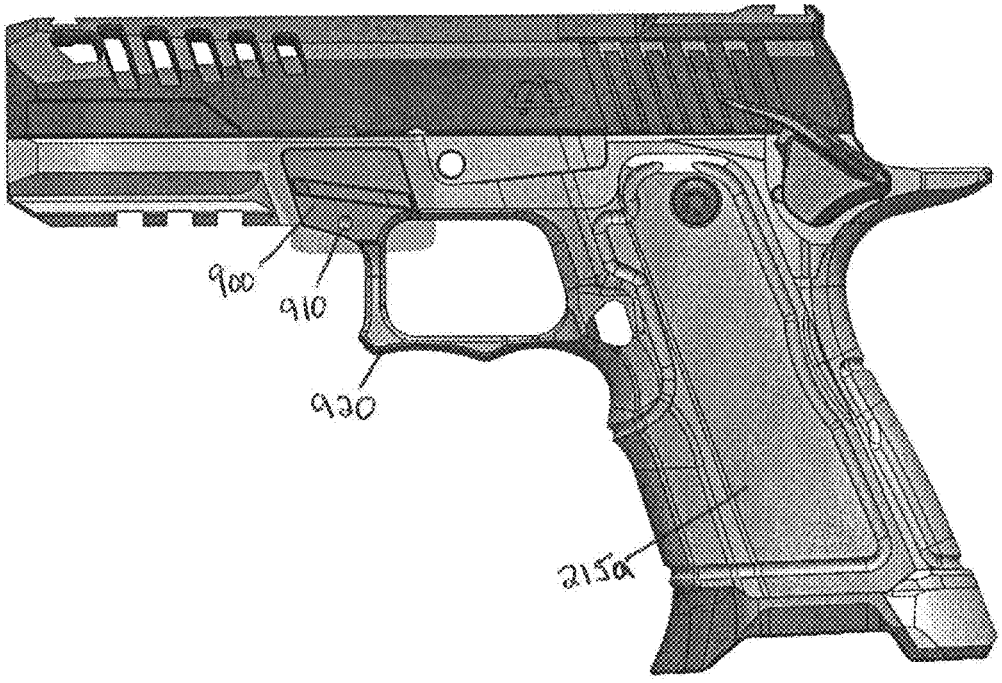
Figure 9B:
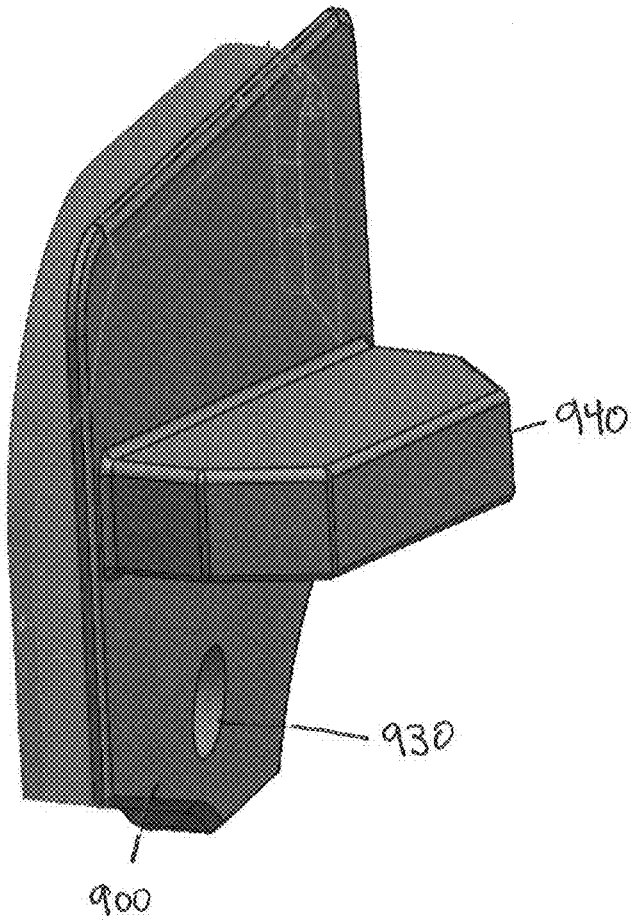
Figure 9C:
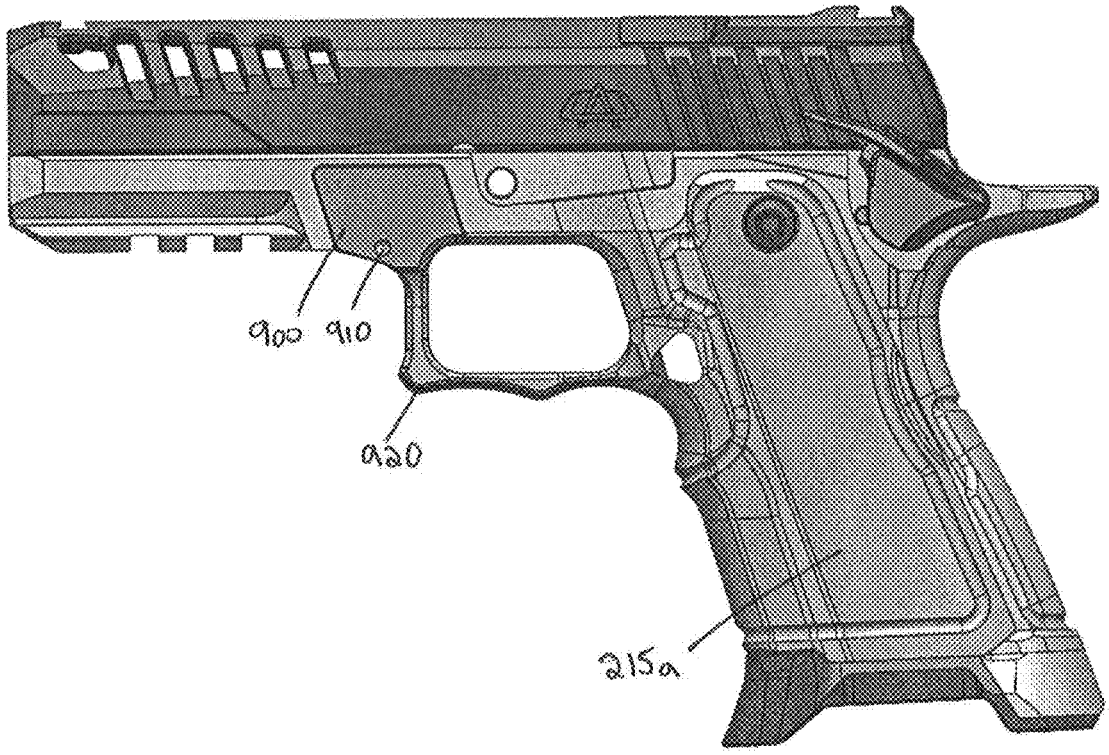
Figure 9D:
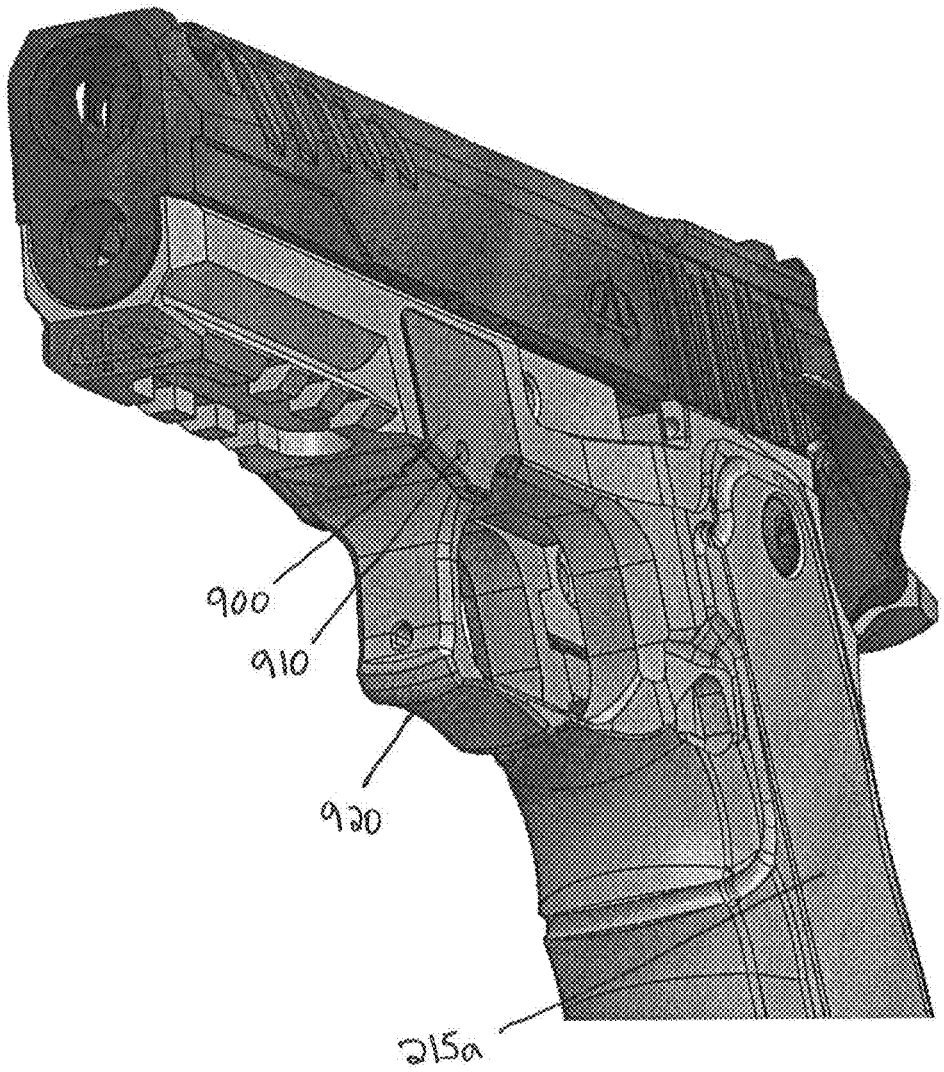
Figure 9E:
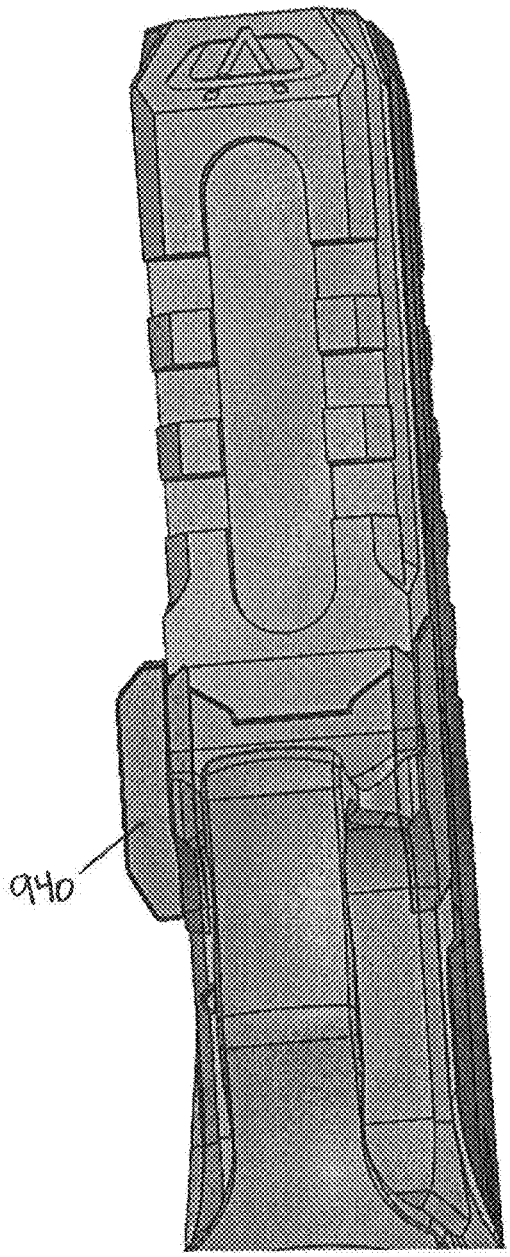
Figure 9F:
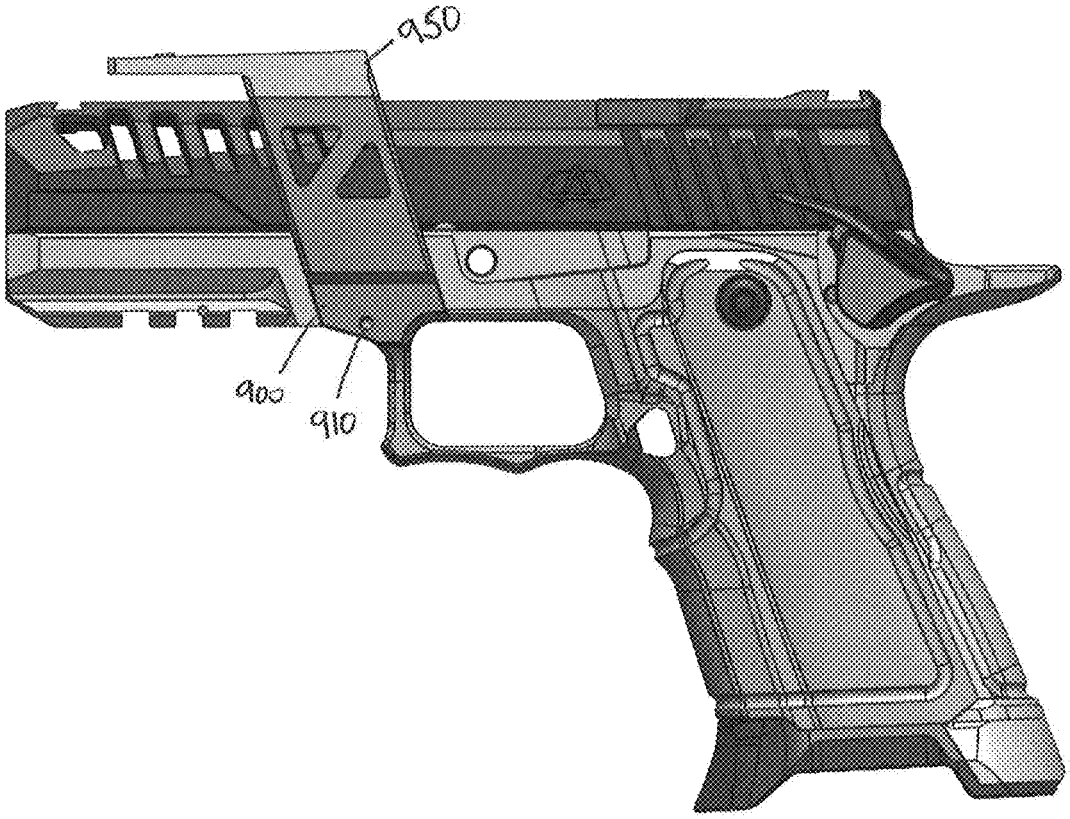
Figure 9G:
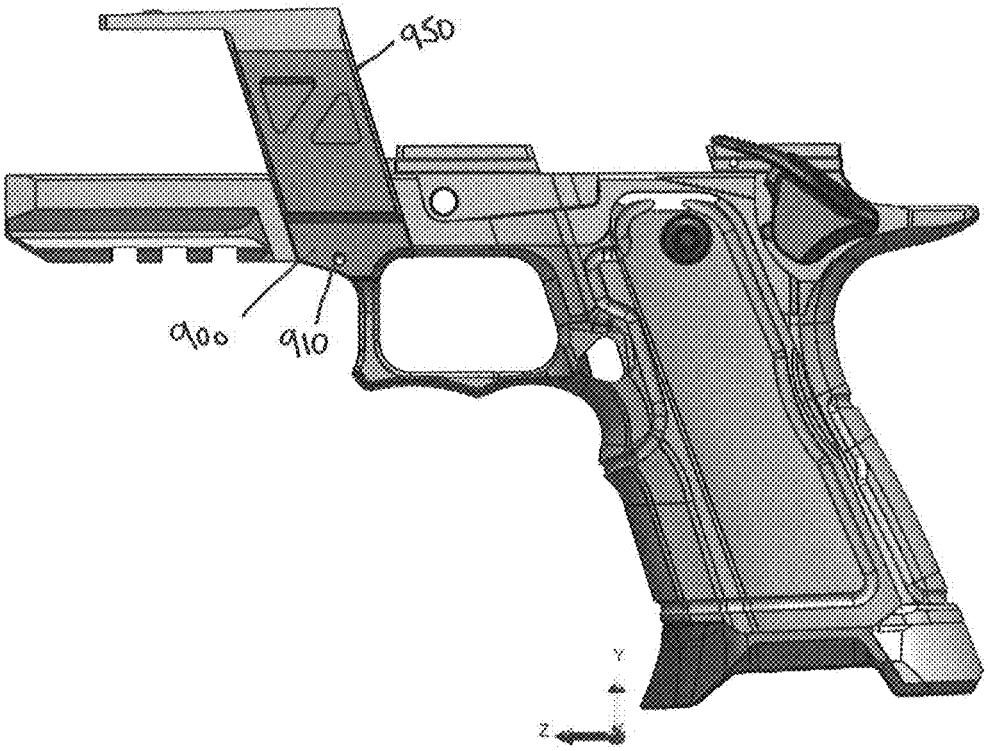
Figure 9H:
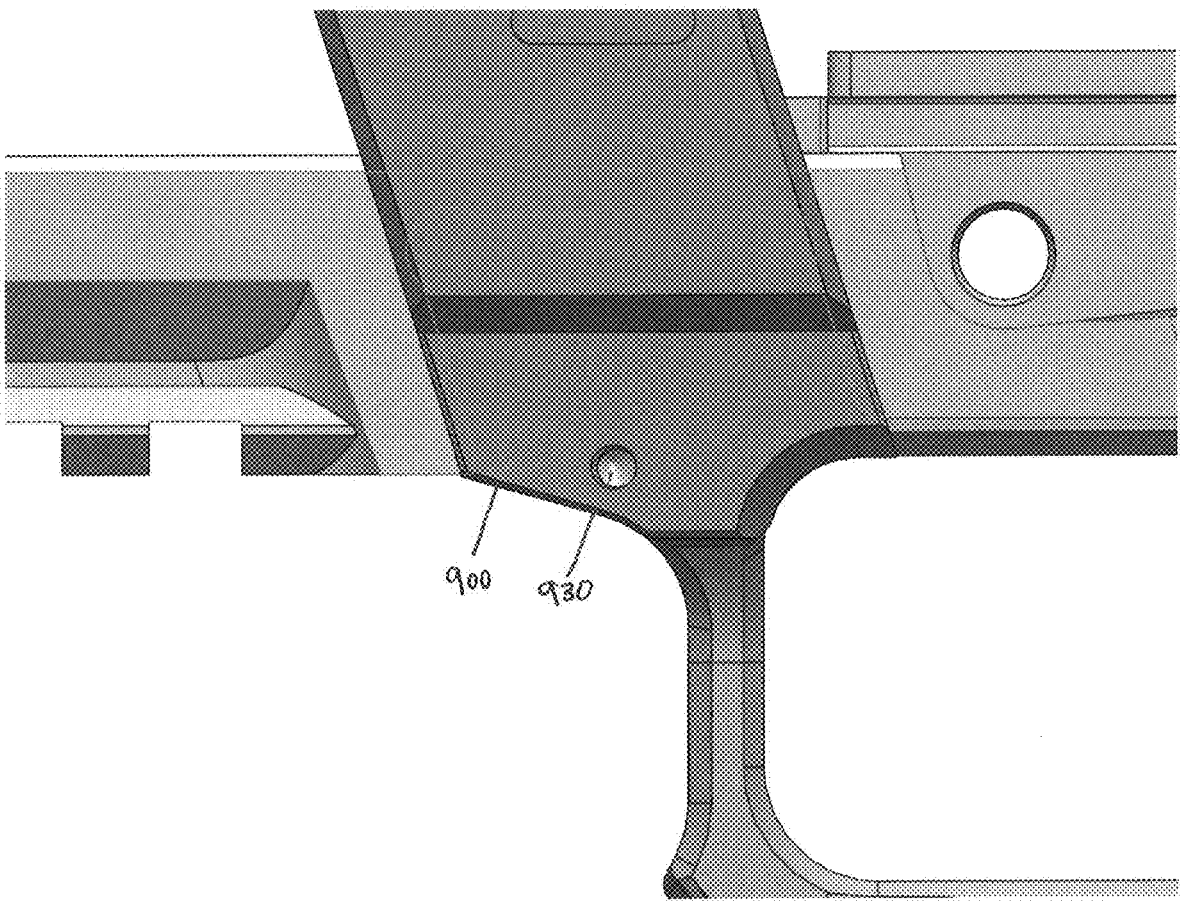
Figure 9I:
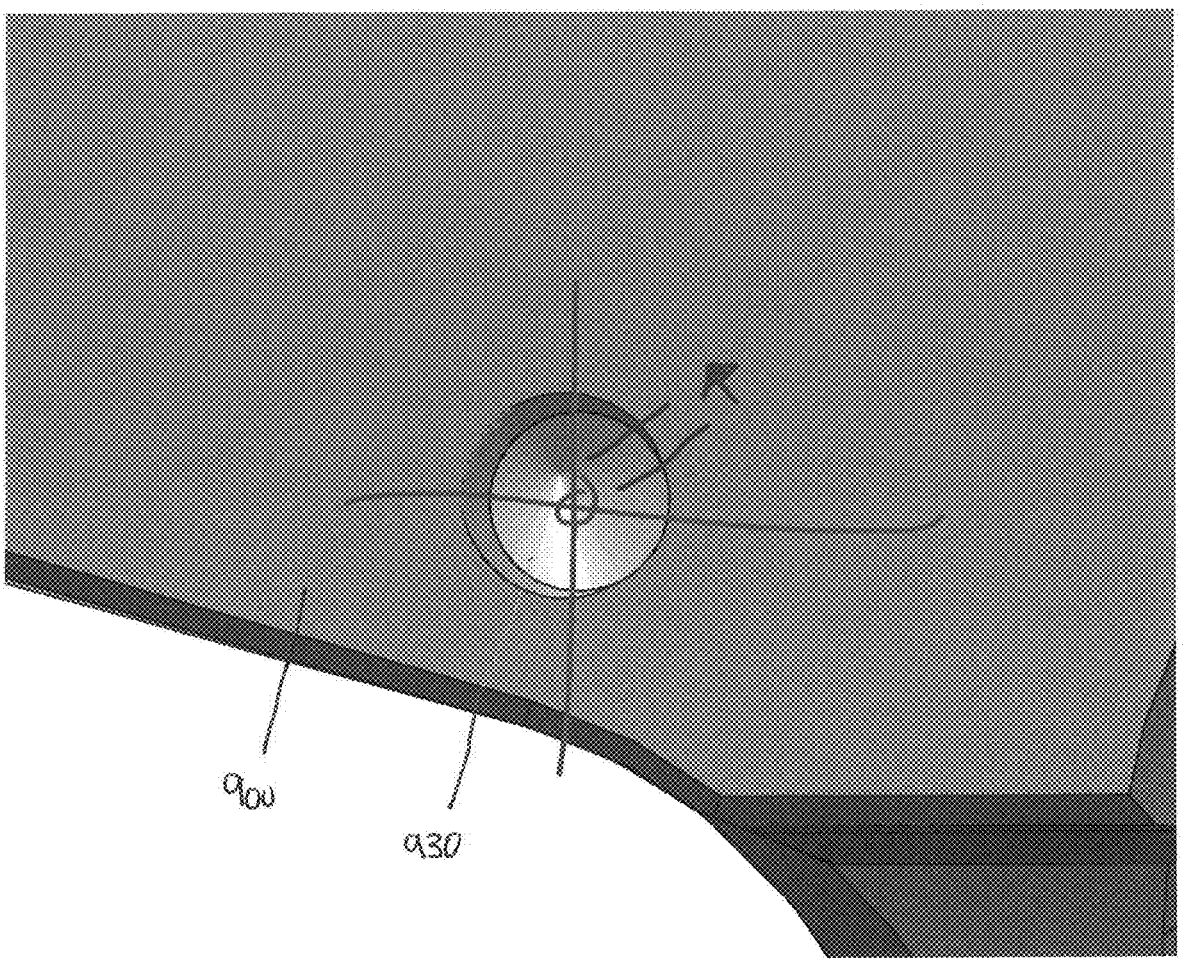
Figure 9J:
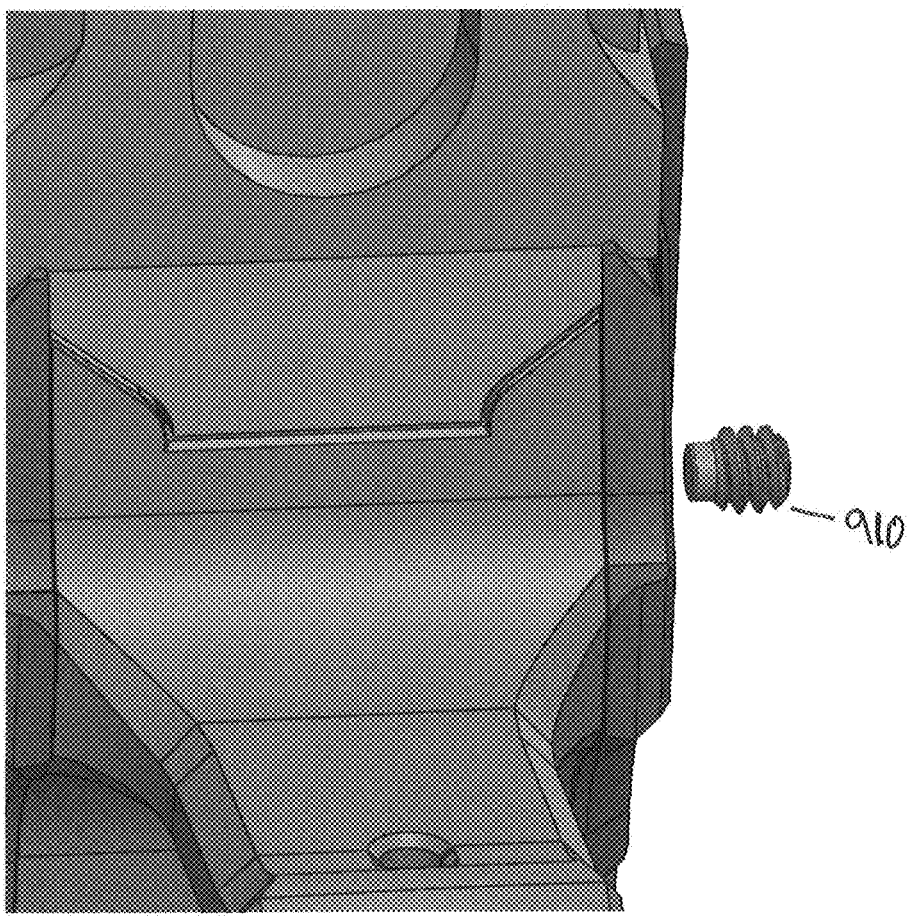
Figure 9K:
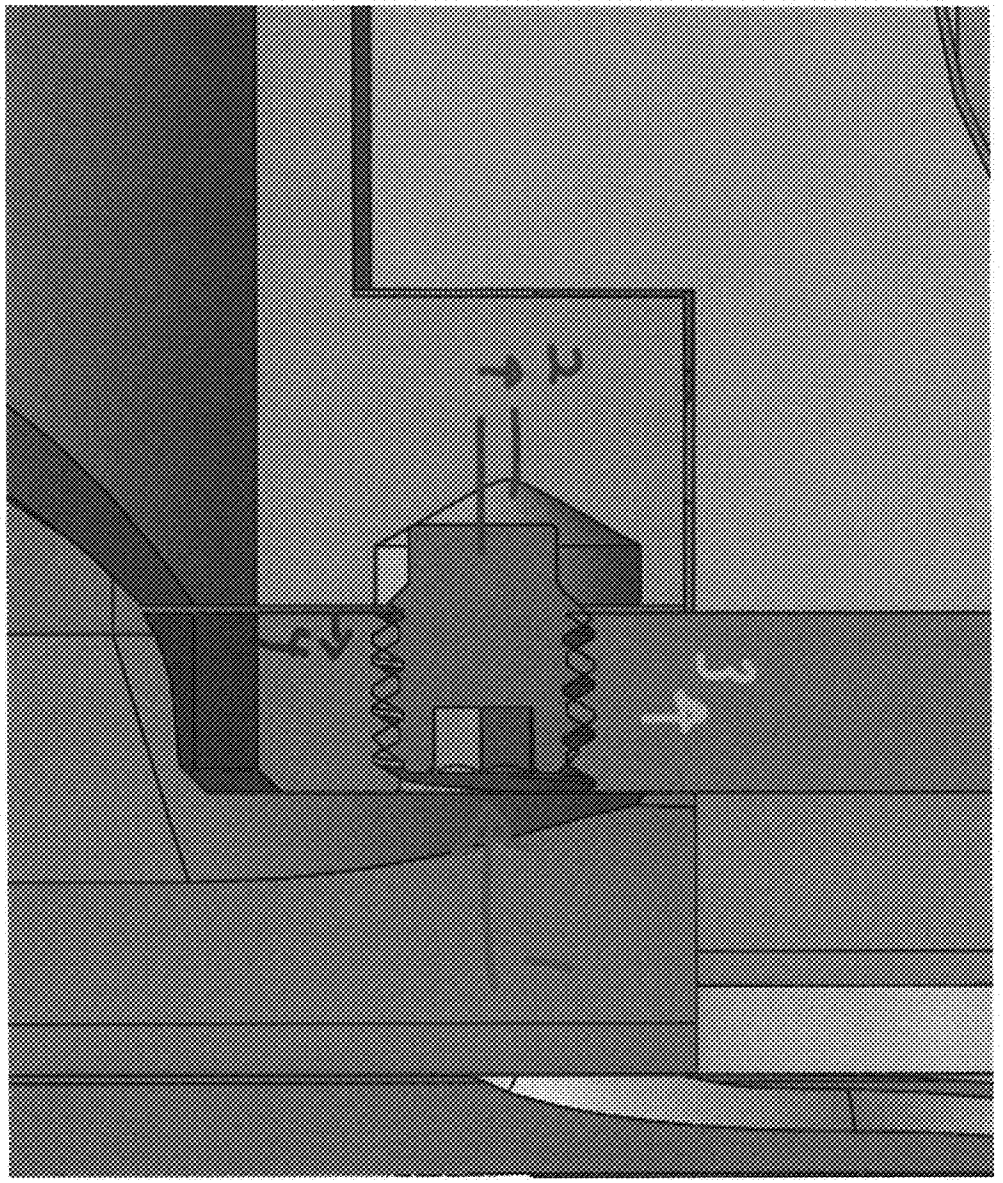
Figure 9L:
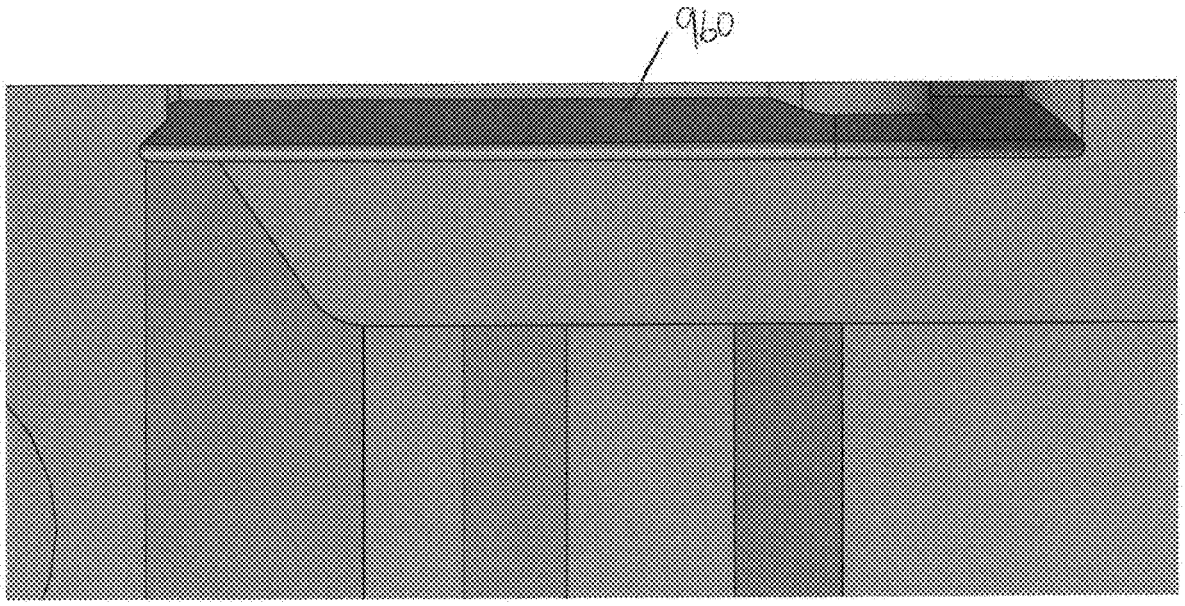
Figure 9M:
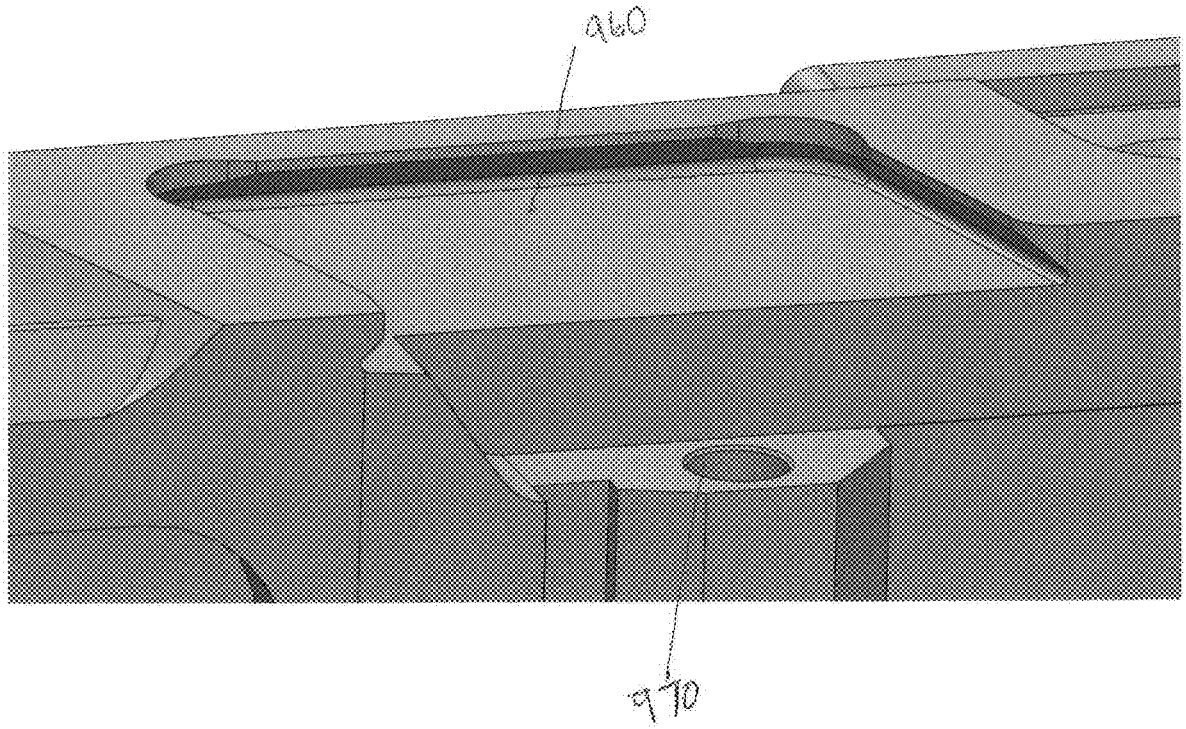
Figure 9N:
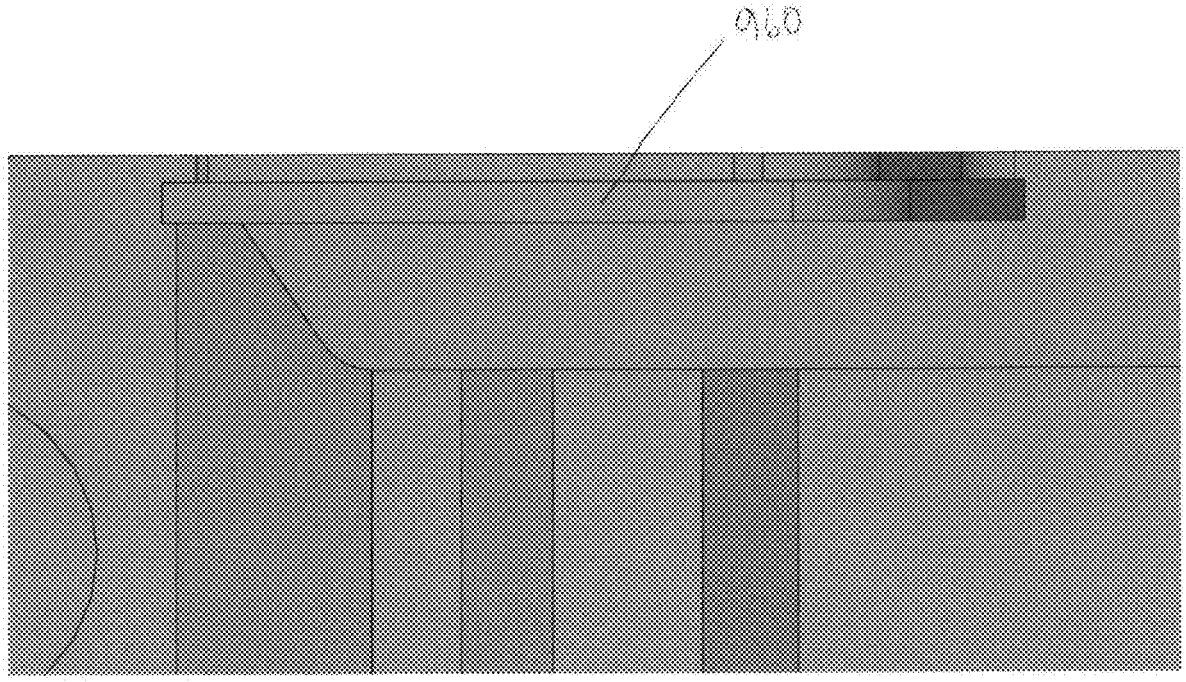
Figure 9O:
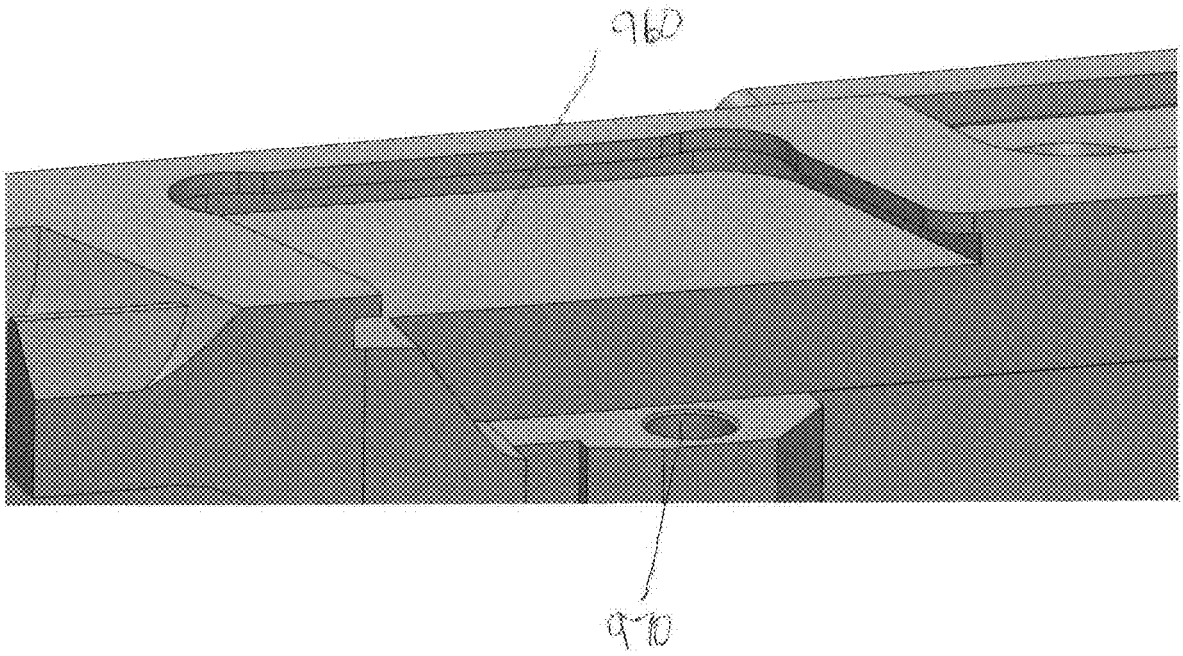
Figure 9P:
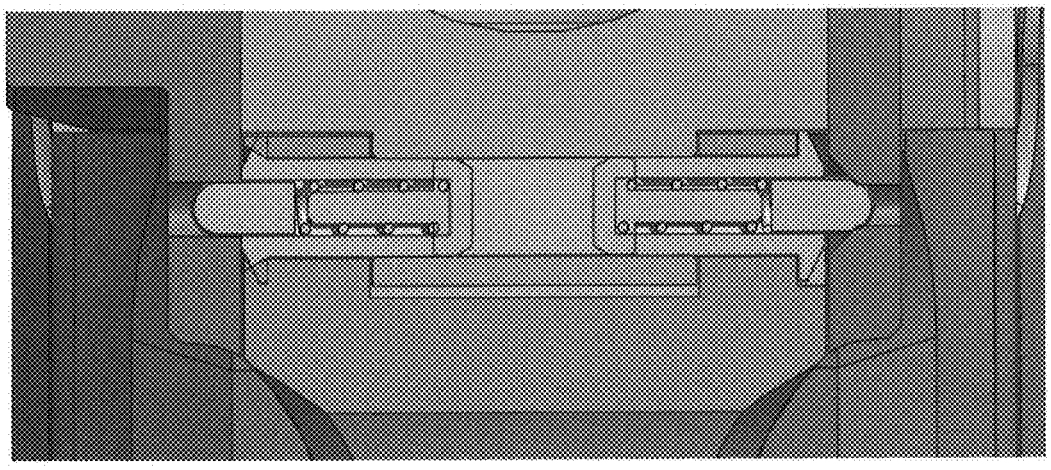
Figure 9Q:
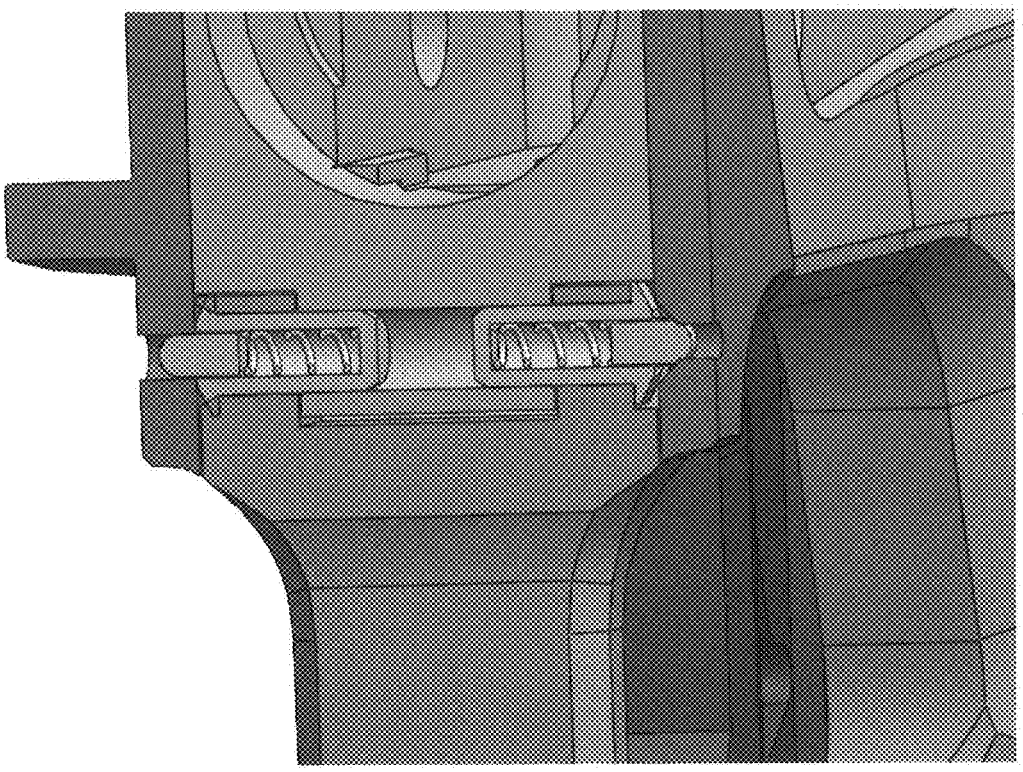
Figure 9R:
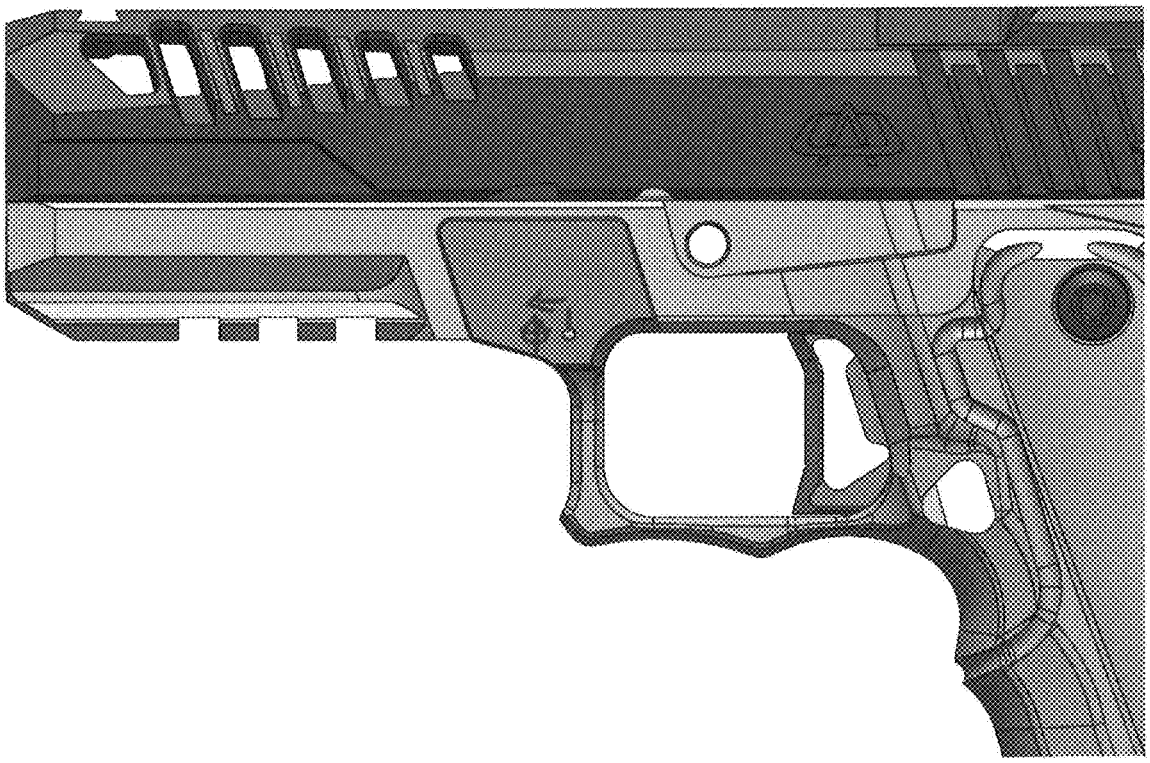
Figure 9S:
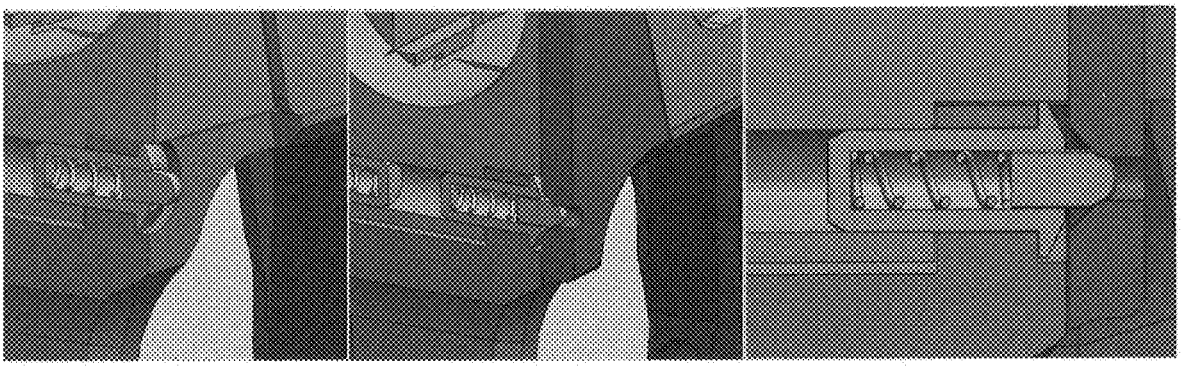
Figure 9T:
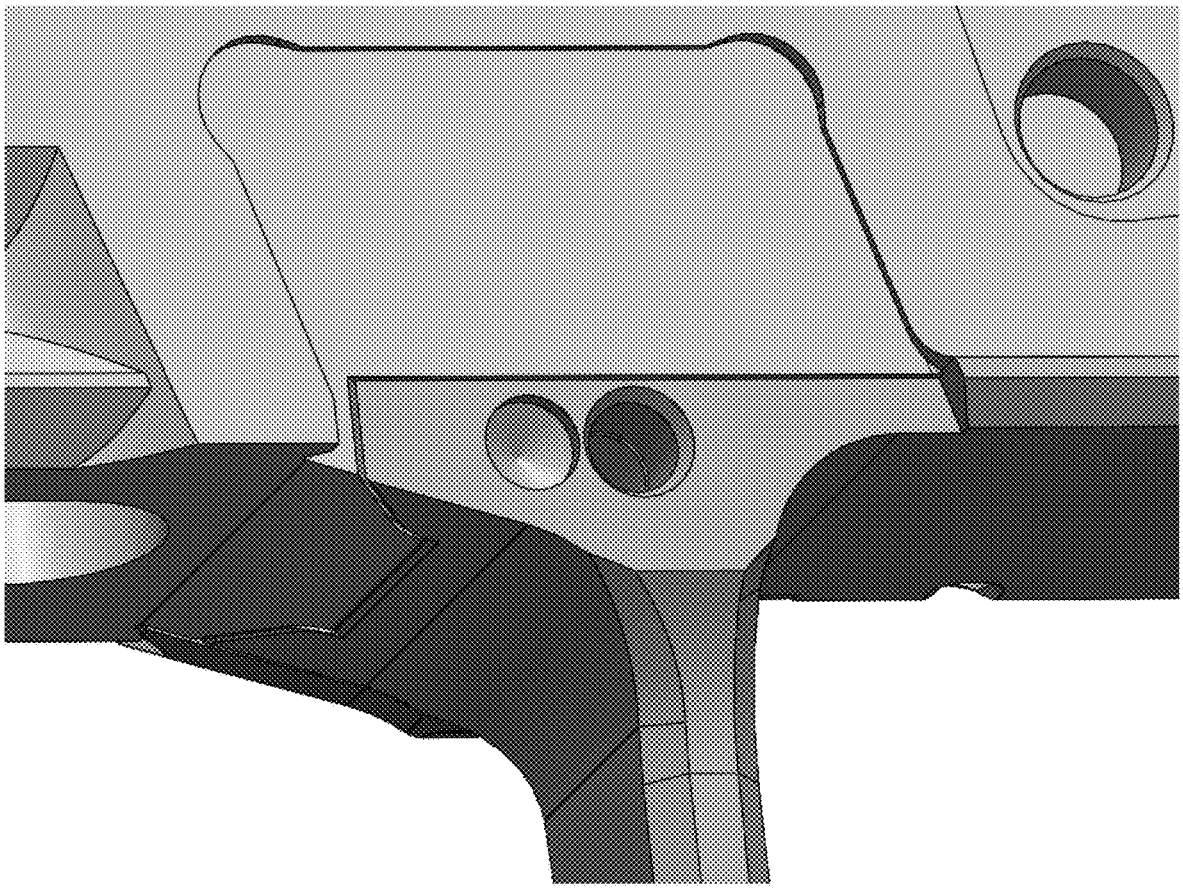

FIGS. 9A-9T illustrate various embodiments of a modular finger interface according to exemplary embodiments.

DETAILED DESCRIPTION

Exemplary embodiments of the invention will now be described in order to illustrate various features of the invention. The embodiments described herein are not intended to be limiting as to the scope of the invention, but rather are intended to provide examples of the components, use, and operation of the invention.

Furthermore, the described features, advantages, and characteristics of the embodiments may be combined in any suitable manner. One skilled in the relevant art will recognize that the embodiments may be practiced without one or more of the specific features, advantages, and characteristics of an embodiment. In other instances, additional features, advantages, and characteristics may be recognized in certain embodiments that may not be present in all embodiments. One skilled in the relevant art will recognize that the features, advantages, and characteristics of any embodiment can be interchangeably combined with the features, advantages, and characteristics of any other embodiment.

It is understood that any or all of the following elements described in the figures is combinable in a single firearm. All may be combined into a single embodiment, or only some may be combined into a single embodiment.

FIG. 1A is side view of a hand pistol of the prior art, the image taken from U.S. Pat. No. 984,519 (FIG. 1), the pistol shown in a rest configuration.

FIG. 1B shows the pistol of FIG. 1A in a loading configuration, a portion of the pistol removed to show internal components thereof.

FIG. 2 is a diagram of a firearm 200 according to an exemplary embodiment. The firearm 200 can include a frame 215, slide 205, slide stop 210, trigger assembly 220; magazine catch assembly 225; hammer 230; and slide stop notch 235 as well as other element not shown or labeled such as barrel; hammer; firing pin; safety; magazine; magazine spring; sear; sear spring; firing pin block; grip; sights; ejection port; slide stop; extractor; and trigger guard.

Dovetail Trigger Shoe Assembly

A traditional 1911 is configured to receive a magazine within a magazine well. As the magazine is inserted into the magazine well, it is guided through a trigger bow. Traditional 1911 trigger bows are swaged with a trigger shoe, thereby forming a trigger shoe assembly. The trigger shoe assembly is then installed on the firearm by inserting the trigger shoe assembly through a back opening of the magazine well and translating the trigger shoe assembly through the magazine well until the trigger shoe extends through a front opening of the magazine well, thereby forming a trigger cavity between the trigger shoe and the magazine well. Although the traditional 1911 assembly process and engagement feature is satisfactory in certain situations, it would be beneficial to have an alternative assembly process and engagement feature.

Adjustment of certain features of a 1911 are also not optimum. For instance, adjusting traditional trigger shoe assemblies often requires removing the assembly from the firearm, which first requires complete disassembly of the firearm. Accordingly, it would be beneficial to have a system for and a method of adjusting a trigger shoe assembly without requiring removal of the trigger shoe assembly from the firearm and/or otherwise not requiring complete disassembly of the firearm.

Like the 1911, the 2311 utilizes a trigger bow that extends around a magazine inserted into a magazine well. Unlike the 1911, the 2311 trigger bow dovetails with the 2311 trigger shoe, thereby providing superior engagement over traditional swaging of the components. The trigger shoe assembly of the 2311 further includes a set screw extending vertically through a top rear portion of the trigger shoe so as to bias a front tab of the trigger bow into full engagement with the trigger shoe. The trigger shoe and trigger bow further include corresponding lips that are configured to interlock when the front tab of the trigger bow is in full engagement with the trigger shoe. In this way, the robust joint of the 2311 trigger shoe assembly provides more assembly and adjustment possibilities than are available for a traditional 1911 trigger shoe assembly.

Referring to FIGS. 3A-3F, an improved firearm embodiment incorporates a trigger shoe assembly 300, comprising a trigger shoe 310 and a trigger bow 320, providing enhanced functionality and adjustability. The trigger shoe 310 includes a back portion that features a rear channel 315 specifically designed to accommodate a front tab 325 of the trigger bow 320. The front tab 325 and rear channel 315 exhibit corresponding angled surfaces, optimizing the alignment and facilitating a secure seating of the front tab 325 within the rear channel 315. This configuration ensures reliable and consistent engagement between the trigger shoe 310 and the trigger bow 320 during firearm operation.

To further enhance the connection between the trigger shoe 310 and the trigger bow 320, the rear channel 315 terminates at a lip 317 that is configured to engage with a notch 327 present on the front tab 325. The interaction between the lip 317 and the notch 327 provides a robust and stable connection, thereby fully engaging the trigger shoe 310 with the trigger bow 320. This ensures that the trigger shoe assembly 300 remains securely in place during firing and handling of the firearm.

In addition to the above features, the trigger shoe assembly 300 incorporates a set screw 330, which plays a crucial role in biasing the trigger bow 320 into full engagement with the trigger shoe 310. The set screw 330 is positioned within a screw cavity 335, allowing for precise adjustment of the trigger shoe assembly. In certain embodiments, the set screw 330 extends vertically through a top rear portion of the trigger shoe 310, making contact with a top portion of the front tab 325 of the trigger bow 320. This contact point allows for the application of controlled pressure, ensuring a consistent and optimal engagement between the trigger shoe 310 and the trigger bow 320.

To facilitate convenient and efficient adjustment of the trigger shoe assembly 300, particularly in terms of the set screw 330, the firearm is designed such that the set screw 330 is accessible from the top of the firearm when the slide 205 is removed. This arrangement enables shooters to make precise adjustments to the trigger shoe assembly without the need for complete disassembly of the firearm. By simply removing the slide 205, the set screw 330 becomes readily accessible, allowing for easy modification of the trigger shoe assembly to suit individual preferences or specific shooting requirements.

It should be noted that various modifications and variations can be implemented in the described trigger shoe assembly. For instance, the shape, size, and materials of the trigger shoe 310 and trigger bow 320 can be adapted to accommodate different firearm models or shooter preferences. Additionally, the specific configuration and dimensions of the rear channel 315, front tab 325, lip 317, notch 327, set screw 330, and screw cavity 335 can be adjusted as needed to achieve optimal performance and ease of adjustment.

The trigger shoe assembly and its components can be fabricated from a variety of materials to meet specific requirements such as strength, durability, weight, and cost considerations. Commonly used materials include steel, aluminum alloys, and various metals known for their structural integrity and resistance to wear. These metal-based materials provide robustness and longevity to withstand the forces exerted during firearm operation. Additionally, polymers or polymer blends are often employed in trigger shoe assemblies, offering benefits such as lightweight construction, cost-effectiveness, and the ability to be molded into intricate shapes for ergonomic design. Carbon fiber, known for its high strength-to-weight ratio, may also be utilized to create lightweight and rigid trigger shoe assemblies, catering to shooters seeking optimal performance and reduced weight. The choice of material for the trigger shoe assembly and its parts ultimately depends on the desired balance of factors such as strength, weight, cost, and design considerations for the specific firearm application.

In some aspects, the techniques described herein relate to a firearm including: a slide assembly; a barrel; a frame; and a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

In some embodiments, the present invention encompasses a firearm that incorporates techniques facilitating convenient adjustment of the trigger shoe assembly without the need for complete disassembly of the firearm. Specifically, the set screw responsible for biasing the trigger bow into full engagement with the trigger shoe is strategically positioned and accessible from the top of the firearm when the slide is removed. This configuration allows shooters to make precise adjustments to the trigger shoe assembly without the necessity of disassembling the entire firearm. For example, consider a semi-automatic pistol equipped with this feature. When the shooter removes the slide of the pistol, typically accomplished by retracting the slide to its rearmost position and engaging the slide stop lever, the top rear portion of the trigger shoe becomes accessible. At this point, the set screw can be easily reached and adjusted using a suitable tool, such as a screwdriver or Allen wrench. By clockwise or counterclockwise rotation of the set screw, the pressure exerted on the trigger bow can be finely tuned, modifying the trigger shoe assembly's engagement and resulting trigger pull characteristics. This arrangement simplifies the adjustment process for shooters who desire to customize their trigger experience without requiring complete disassembly of the firearm. Instead of disassembling the entire pistol, which can be a time-consuming and complex procedure, accessing the set screw from the top of the firearm streamlines the adjustment process. This feature allows shooters to make quick and precise modifications to the trigger shoe assembly, enabling them to optimize their shooting experience according to personal preferences, competition requirements, or specific shooting scenarios.

In certain embodiments, the present invention pertains to a firearm incorporating techniques wherein the trigger shoe is designed in a dovetail shape. The dovetail shape of the trigger shoe offers distinct advantages in terms of secure installation, adjustable positioning, and compatibility with various firearm models and configurations. For example, consider a semi-automatic pistol that features a dovetail-shaped trigger shoe. The dovetail design enables the trigger shoe to be securely installed into a corresponding dovetail groove or slot in the firearm's frame. The geometry of the dovetail shape provides mechanical interlock and resistance against lateral movement, ensuring that the trigger shoe remains firmly in place during firearm operation. This robust installation method prevents unintended shifting or displacement of the trigger shoe, maintaining consistent trigger performance and reliability. Furthermore, the dovetail shape of the trigger shoe allows for adjustability. By selecting trigger shoes with different dovetail dimensions or by using shims, shooters can fine-tune the positioning of the trigger shoe to achieve their preferred trigger reach and finger placement. This adjustability accommodates shooters with varying hand sizes, grip preferences, and ergonomic needs, enhancing overall comfort and control during shooting. Moreover, the dovetail design of the trigger shoe promotes compatibility across different firearm models. Many firearms utilize a standardized dovetail groove for trigger shoe installation, allowing shooters to interchange trigger shoes between compatible firearms. This versatility enables shooters to personalize their trigger experience or transfer a preferred trigger shoe to different firearms within their collection, without the need for extensive modifications or customization.

In certain embodiments, the present invention encompasses a firearm incorporating techniques wherein the set screw responsible for biasing the trigger bow includes threading and a locking mechanism. This design allows the user to securely fix the desired position of the trigger bow relative to the trigger shoe, providing stability and preventing unintended movement during firearm operation. For example, consider a firearm equipped with this feature. The set screw, threaded to match the corresponding internal threads of the trigger shoe, enables the user to adjust the position of the trigger bow along the rear channel. By turning the set screw clockwise or counterclockwise, the user can control the amount of pressure exerted on the trigger bow, influencing the trigger shoe assembly's engagement and resulting trigger pull characteristics. Furthermore, the set screw incorporates a locking mechanism to ensure that once the desired position of the trigger bow is achieved, it remains securely fixed in place. This locking mechanism can be in the form of a locking nut, a threaded collar, or a specialized locking mechanism integrated into the set screw itself. When engaged, the locking mechanism prevents the set screw from unintentionally loosening due to recoil or other external forces, maintaining the desired position of the trigger bow. The threaded set screw with a locking mechanism provides shooters with a means to customize their trigger pull characteristics and maintain consistency over time. Once the ideal position of the trigger bow is determined, the locking mechanism can be tightened, effectively securing the set screw in place. This feature offers peace of mind to shooters, knowing that their desired trigger configuration will remain fixed and unchanged during shooting sessions or when transporting the firearm.

In certain embodiments, the present invention pertains to a firearm incorporating techniques wherein a spring-loaded detent mechanism is integrated within the trigger shoe assembly. This mechanism enhances the user experience by providing audible and tactile feedback, specifically when the front tab of the trigger bow is fully engaged within the rear channel of the trigger shoe. For example, consider a semi-automatic pistol featuring this spring-loaded detent mechanism. As the front tab of the trigger bow is inserted into the rear channel of the trigger shoe, the detent mechanism is compressed. Once the front tab reaches the fully engaged position, the detent mechanism is released, producing an audible click or snap sound and a tactile sensation that can be felt by the shooter's finger. The audible feedback serves as an indicator that the trigger shoe and trigger bow are securely and properly engaged. It provides confirmation to the shooter that the components are correctly aligned and ready for firing, increasing confidence in the firearm's operation. The tactile feedback further enhances the shooter's experience by providing a physical sensation of engagement. This feedback is particularly useful in situations where visual confirmation of the trigger engagement may be challenging, such as low-light conditions or when the shooter's focus is primarily on the target. The tactile sensation allows the shooter to verify the proper engagement of the trigger shoe and trigger bow without needing to visually inspect the firearm. By incorporating the spring-loaded detent mechanism into the trigger shoe assembly, the firearm provides an additional layer of reassurance and reliability. Shooters can trust that the trigger shoe and trigger bow are fully engaged and ready to deliver consistent and predictable trigger performance.

In various embodiments, the present invention encompasses a firearm incorporating techniques wherein the trigger shoe assembly is designed to be modular and interchangeable. This feature enables shooters to customize the trigger shoe assembly according to their preferences and provides compatibility with different firearm models, enhancing versatility and adaptability. For example, consider a modular rifle platform that allows users to interchange trigger shoe assemblies. The trigger shoe assembly consists of a removable trigger shoe and trigger bow unit that can be easily detached and replaced with another assembly. Each trigger shoe assembly may have distinct characteristics such as shape, size, texture, or trigger pull weight, offering shooters a range of options to suit their specific needs and shooting styles. By having a modular and interchangeable trigger shoe assembly, shooters can select trigger shoe units that optimize ergonomics, improve trigger feel, or meet specific shooting requirements. For instance, a shooter who prefers a wider trigger shoe with a textured surface may swap out the standard trigger shoe assembly for one that matches their preference. Likewise, a shooter participating in precision long-range shooting may choose a trigger shoe assembly with an adjustable trigger pull weight to fine-tune the trigger response. The modular nature of the trigger shoe assembly also allows for compatibility with different firearm models. By ensuring standardized dimensions and attachment methods, shooters can easily transfer their preferred trigger shoe assembly between firearms within the same platform or even across different models, saving time and effort in customization. Moreover, the modularity of the trigger shoe assembly facilitates easy maintenance and replacement. If a trigger shoe assembly becomes worn, damaged, or requires servicing, it can be quickly swapped out with a new assembly, eliminating the need for intricate repairs or complete firearm disassembly.

In certain embodiments, the present invention pertains to a firearm incorporating techniques wherein the trigger shoe is designed with a textured surface or grip enhancements. This feature enhances the shooter's control and comfort during trigger manipulation, resulting in improved overall shooting experience. For example, consider a semi-automatic pistol equipped with a trigger shoe featuring a textured surface. The texture can take the form of stippling, checkering, or other patterns that provide a tactile grip. When the shooter's finger engages the trigger shoe, the textured surface increases friction and grip, allowing for a more secure and controlled trigger pull. This improved grip helps prevent slipping or unintentional movement of the finger during firing, ensuring consistent and precise trigger manipulation.

In certain embodiments, the present invention pertains to a firearm incorporating techniques wherein the rear channel of the trigger shoe includes an integral alignment guide. This feature facilitates quick and accurate assembly of the trigger shoe assembly with the trigger bow, simplifying the process and ensuring proper alignment between the components. For example, consider a rifle equipped with this feature. The rear channel of the trigger shoe is designed with a built-in alignment guide, which includes ridges, grooves, or other protrusions that correspond to matching features on the trigger bow. When assembling the trigger shoe assembly, the alignment guide aids in aligning and positioning the trigger bow correctly within the rear channel. The integral alignment guide ensures that the trigger bow slides smoothly and precisely into place, reducing the likelihood of misalignment or the need for excessive adjustment. This feature saves time and effort during assembly, particularly in scenarios where quick maintenance, field stripping, or component replacement is required.

In some aspects, the techniques described herein relate to a firearm, wherein at least a portion of the trigger shoe assembly is fabricated from a steel alloy, a polymer, or a carbon fiber.

In some aspects, the techniques described herein relate to a firearm including: a frame; and a trigger shoe assembly operably connected to the frame, wherein the trigger shoe assembly includes: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

In certain embodiments, the present invention pertains to a firearm incorporating techniques wherein a trigger safety mechanism is integrated within the trigger shoe assembly. This mechanism serves to prevent accidental discharge of the firearm, enhancing safety during handling and operation. For example, consider a semi-automatic pistol featuring this trigger safety mechanism. The mechanism within the trigger shoe assembly is designed to engage a safety feature that blocks the trigger from moving and prevents it from being pulled unless intentionally disengaged. This additional layer of safety helps prevent accidental or unintended discharge of the firearm. The trigger safety mechanism can take various forms, such as a lever, button, or other components that are incorporated within the trigger shoe assembly. To disengage the safety and allow the trigger to be pulled, the shooter must actively and deliberately interact with the mechanism, typically by applying pressure or manipulating the safety feature.

In some aspects, the techniques described herein relate to a firearm, wherein the front tab of the trigger bow includes a reinforced metal insert, increasing strength and wear resistance at the engagement point with the rear channel of the trigger shoe.

In certain embodiments, the present invention encompasses a firearm that incorporates techniques wherein an adjustable trigger pull weight mechanism is integrated into the set screw. This mechanism allows users to customize the trigger pull force according to their preference, providing a personalized shooting experience. For example, consider a handgun equipped with this adjustable trigger pull weight mechanism. The set screw responsible for biasing the trigger bow into engagement with the trigger shoe includes an innovative design that enables precise control over the trigger pull force. By turning the set screw clockwise or counterclockwise, shooters can increase or decrease the tension applied to the trigger bow, thereby adjusting the trigger pull weight. The adjustable trigger pull weight mechanism provides shooters with the ability to tailor the trigger pull to their liking, accommodating individual preferences, shooting styles, and shooting scenarios. Some shooters may prefer a lighter trigger pull weight for enhanced precision shooting, while others may opt for a slightly heavier pull for added safety and control. By offering adjustability, the firearm caters to a wide range of shooter preferences and allows for fine-tuning the trigger to achieve optimal performance.

In some aspects, the techniques described herein relate to a firearm further including a trigger reset mechanism in the trigger shoe assembly, providing audible and tactile feedback to the shooter when the trigger is ready for subsequent firing.

In some aspects, the techniques described herein relate to a firearm, wherein at least a portion of the trigger shoe assembly is fabricated from a steel alloy, a polymer, or a carbon fiber.

In some aspects, the techniques described herein relate to a firearm, wherein the trigger shoe assembly includes one or more interchangeable trigger shoes.

In some aspects, the techniques described herein relate to a firearm, wherein the trigger shoe includes a textured surface or grip enhancements, improving the shooter's control and comfort during trigger manipulation.

In some aspects, the techniques described herein relate to a firearm, wherein the trigger shoe assembly is modular and interchangeable, allowing for customization and compatibility with different firearm models or user preferences.

In some aspects, the techniques described herein relate to a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

Magazine Catch Retainer Plate

Hand pistols taught by U.S. Pat. No. 984,519, or some variation thereof, (each a "1911") have been in production for over one-hundred years. During that time, the 1911 has developed a loyal following for a variety of reasons. Unfortunately, the magazine capacity of traditional 1911's is somewhat limited. Accordingly, it would be beneficial to have a firearm that is capable of satisfying 1911 loyalists while offering a higher magazine capacity than a traditional 1911.

A traditional 1911 includes a frame having a magazine well that is configured to receive a single stack magazine. As the magazine is inserted into the magazine well, it is guided through a trigger bow. Unfortunately, the width of the magazine well and trigger bow prevents traditional 1911's from receiving a double stack magazine, such as a P320 magazine. Accordingly, it would be beneficial to have a 1911 style firearm that includes a magazine well and a trigger bow that are each wide enough to accept a double stack magazine.

Traditional 1911 trigger bows are swaged with a trigger shoe, thereby forming a trigger shoe assembly. The trigger shoe assembly is then installed on the firearm by inserting the trigger shoe assembly through a back opening of the magazine well and translating the trigger shoe assembly through the magazine well until the trigger shoe extends through a front opening of the magazine well, thereby forming a trigger cavity between the trigger shoe and magazine well. Although the traditional 1911 assembly process is satisfactory in certain situations, it would be beneficial to have an alternative assembly process, such as an installation process that allows for installation of the trigger shoe prior to engaging the trigger shoe with the trigger bow.

Additionally, a traditional 1911 utilizes a magazine catch to selectively retain a magazine within a magazine well and to selectively release the magazine therefrom. When a magazine is installed, an outward force from a laterally-oriented catch spring biases the magazine catch into engagement with the magazine, thereby retaining the magazine. Upon applying a sufficient inward force to the magazine catch, the outward biasing force of the spring is overcome, thereby disengaging the magazine catch from the magazine so that the magazine can be removed. A traditional 1911 magazine catch is configured to receive a proximal end of the catch spring, thereby inhibiting buckling of the spring as the spring is compressed into the magazine catch during operation. A concentric magazine catch lock extends into a distal end of the spring, thereby further inhibiting buckling of the spring. In other words, the 1911 catch spring is entrapped such that buckling of the spring is prevented. When assembled, the magazine catch and the magazine catch lock each extend into a frame of the 1911 from opposed sides of the frame, thereby forming a catch assembly having a nested catch spring. The catch assembly is positioned behind the trigger shoe such that the magazine assembly traverses the trigger cavity. In other words, the 1911 frame defines a lateral catch cavity and a longitudinal trigger cavity that are in communication with each other. Unfortunately, the communication of the catch cavity with the trigger cavity renders a traditional 1911 frame incompatible with certain magazine catches, such as the P320 magazine catch, thereby rendering the traditional 1911 incompatible with associated magazines. Accordingly, it would be beneficial to have a 1911 style firearm that is compatible with a larger variety of magazines, including the P320 magazine.

Like the 1911, the P320 magazine catch is associated with a lateral catch spring. Unlike the 1911, however, the P320 catch spring is not entrapped within a magazine catch. Instead, the P320 magazine catch and associated lateral catch spring are each installed within a lateral catch cavity of an associated frame such that the catch spring is entrapped between the magazine catch and a front surface of the catch cavity. Unfortunately, the communication of the 1911 catch cavity with the 1911 trigger cavity prevents a traditional 1911 from 1911 from sufficiently entrapping a P320 catch spring. Accordingly, it would be beneficial to have a system for and a method of entrapping a P320 catch spring in a 1911 style firearm.

The following embodiments describe a firearm with a magazine catch retainer plate. The plate is novel in that it sits between the trigger shoe and the magazine catch assembly while also functionally engaging with the magazine catch assembly itself. More specifically, the plate sits between in a cavity within the firearm frame between the trigger shoe and the magazine catch assembly. The plate is designed to fit snugly within the cavity, e.g. the plate can be designed to dovetail into the cavity via a recess in the firearm frame. During assembly and disassembly of the firearm, the plate can be inserted into the frame through the empty magazine well or in any suitable opening of the frame during assembly or disassembly. In some embodiments, the body of the plate can include a bottom portion and a top portion. The bottom portion can be rectangular shaped or trapezoidal shaped to fit the cavity within the frame. Furthermore, the bottom face of the bottom portion can itself have a relief configured to dovetail snugly with a part of the frame. The top portion can also be of rectangular or trapezoidal shape and extend perpendicular or at a slight angle from perpendicular from the bottom portion. In some embodiments, the plate can have a dimple, recess, or insert on the top portion which is useful for pushing the plate into place within the frame via a narrow object like a screw, nail, tweezers, screwdriver, armorer's punch, or any suitable tool that is narrow enough to fit the plate within the frame of the firearm during assembly and disassembly. Furthermore, the top portion of the plate can be configured to fit snugly with a recess on the magazine catch assembly. That is, the recess of the magazine catch assembly is designed to fit the top portion.

Once the plate is inserted into the frame, the magazine catch assembly can be inserted into the magazine catch assembly hole in the frame. Once inserted, the magazine catch assembly can operably engage with the magazine catch plate. Specifically, the magazine catch spring can be pushed against the plate by the user, thereby the spring is stopped or caught by the plate. Applying pressure to the spring against the catch plate, the user can engage the magazine release function of the magazine of the magazine catch assembly. That is, when a magazine is installed, the magazine catch assembly engages with the magazine, thereby retaining the magazine. Upon applying a sufficient inward force to the magazine catch, the outward biasing force of the spring is overcome, thereby disengaging the magazine catch from the magazine so that the magazine can be removed.

It is understood that the placement of the magazine catch plate between the trigger shoe and the magazine catch assembly is crucial. This placement allows for the magazine catch assembly to sit far enough away from the magazine well, thereby allowing the magazine well to fit larger magazines such as double stack magazine and P320 magazines. Thus, the plate allows for much greater compatibility with magazines as compared to the 1911 and other 1911-styled firearms.

FIG. 4A shows a firearm 100 according to an exemplary embodiment. The firearm 100 can be a handgun or hand pistol as shown. The firearm 100 can include in addition to at least frame, barrel, and slide: a trigger assembly 400; a magazine catch 225; and a lower frame 412 which can include at least a grip, the interior of which is a magazine well. FIG. 4B is a partial perspective sectional side view of a firearm of FIG. 4A, the hand pistol including a magazine catch retainer plate positioned between a trigger shoe 401 and a magazine catch 225. FIG. 4C is a partial perspective sectional view of the trigger shoe 401 and the trigger bow 404. FIG. 4D is a partial perspective sectional of the firearm 100. It is understood that other elements of a functional handgun can also be included in the firearm 100, including without limitation: barrel; slide; hammer; firing pin; safety; magazine; magazine spring; sear; sear spring; firing pin block; grip; sights; ejection port; slide stop; extractor; and trigger guard.

FIGS. 4A-4C, a firearm of the present invention includes a trigger shoe assembly 400 having a trigger shoe 401 and a trigger bow 404. A first engagement feature 403 of the trigger shoe 401 is configured to selectively engage with a second engagement feature 405 of the trigger bow 404. In some embodiments, the first engagement feature 403 can be a lip or flange on the back of the trigger shoe 401. Furthermore, the second engagement feature 405 can also be a lip, flange, or protrusion from the body of the trigger bow 404. The trigger bow 404 can further include a notch, dimple, recess, or relief near the second engagement feature 405 configured to receive the first engagement feature 403.

In some embodiments, the trigger shoe assembly 400 further includes a third engagement feature 407 for securing the first 403 and second 125 engagement features into selective engagement with each other. In some such embodiments, the third engagement feature 407 is accessible from the top of the firearm frame when a slide of the firearm is removed, thereby facilitating assembly of the trigger bow 404 with the trigger shoe 401 while the trigger shoe 401 is installed within the firearm. In some embodiments, the third engagement feature 407 can be a screw, nail, bolt, rivet, or some other mechanical faster or attachment. This third engagement feature 407 can engaged with the trigger bow 404 via a trigger shoe attachment hole 406. The trigger shoe attachment hole 406 can be accessed from the frame when the slide is removed. This allows for alternative assembly process compared to traditional 1911 models: the user can install the trigger shoe to the frame of the firearm 100 without first engaging the trigger shoe 401 with the trigger bow 404. That is, the trigger shoe 401 can be first attached to the frame, then attached to the trigger bow 404.

The firearm further includes a P320-style magazine catch 225 and a magazine catch retainer plate 411 associated therewith. The magazine catch retainer plate 411 is positioned between the trigger shoe 401 and the magazine catch 225, thereby preventing a catch spring (not shown) of the magazine catch 225 from buckling into a trigger cavity 408 positioned behind the trigger shoe 401.

In some embodiments, the firearm includes an adjustment mechanism 410, such as a set screw or the like. In some such embodiments, the adjustment mechanism 410 extends behind the trigger shoe 401 and is configured to engage with a front surface of the magazine catch retainer plate 411, thereby establishing the maximum allowed rearward travel of the trigger shoe 401. The adjustment mechanism 410 can be inserted into a trigger shoe adjustment hole 402. In some such embodiments, the adjustment mechanism 410 is adjustable, thereby changing the maximum allowed rearward travel of the trigger shoe 401. In some embodiments, the adjustment mechanism 410 is normal to the front surface of the magazine catch retainer plate 411 such that engagement of the adjustment mechanism 410 with the magazine catch retainer plate 411 is relatively uniform, thereby reducing wear.

Furthermore, the magazine catch 225 can be configured such that the magazine well 350 is not encroached upon by the magazine catch. Thus, the firearm 100 is compatible with a larger variety of magazines, including a double stacked magazine and a P320 magazine.

FIGS. 4D and 4E show how the magazine catch plate 413 interacts with the magazine catch 225 and the trigger shoe assembly 418. The plate 413 can be inserted inside the frame of the firearm 100 during assembly, e.g. the plate 413 can be inserted through the open magazine well during assembly. The plate 413 can be configured to fit snugly within the frame of the firearm via a mating mechanism, such as a male protrusion on the interior of the firearm and a female recess on the body of the plate 413. The plate 413 sits below the trigger bow 421 and in between the trigger shoe 419 and the magazine catch 225. Once the plate 413 has been inserted into the frame, the magazine catch 225 can be inserted into the frame of the firearm 100 through a hole in the frame. Generally, the plate 413 can be inserted first, followed by either the trigger assembly 418 or the magazine catch 225. The magazine catch 225 can include a spring housing and a spring. The spring is not shown, but it is understood that a spring of a shape and size suitable for the spring housing is considered. The spring of the magazine catch 225 can be positioned against the plate 413 such that a user when pushing the magazine catch button 423 will push the spring against the plate 413, thus disengaging the magazine catch 225 from a magazine in the magazine well.

The trigger shoe 419 is positioned in front of the plate 413 such that when an attachment member like the adjustment mechanism 410 is placed or threaded through the trigger shoe attachment hole 420, the member touches the plate 413, thus giving the user a physical barrier by which to measure the movement of the trigger shoe 419.

The positioning of the plate 413 between the trigger assembly 418 and the magazine catch 225 is crucial to leaving enough room in the magazine well to accommodate a variety of magazines including double stack magazines and P320 magazines. Indeed, the tapered upper portion of the plate 413 in addition to its proximity to the trigger assembly 418 allows the magazine catch 225 to not encroach on the magazine well. Thus, the novel design and position of the plate 413 allows greater compatibility with various magazines.

FIGS. 4F and 4G illustrate a magazine catch plate 413 with an upper portion 417, a lower portion 414, and a recess 416. The lower portion 414 and the upper portion 417 can each be in the shape of a rectangular or trapezoidal prism. The upper portion 417 can extend longitudinally from the lower portion 414. The upper portion 417 and lower portion 414 can be integrated into one composition. The plate 413 can taper from the bottom of the bottom portion 414 to the top of the top portion 417. The recess 416 can extend into the top portion 417 thus forming a dimple or shallow cavity in the plate 413. The recess 416 can be useful for manufacturing the plate 413, ensuring that the entire plate 413 cures evenly. Furthermore, the recess 416 can be useful during assembly: when a user is attempting to place the plate 413 within the frame, the user can use tweezers or some other long tool to pick up and move the plate 413 via the recess 416. Thus, positioning of the plate 413 is made easier. Though the recess 416 is shown, it is understood that plates without such a cavity or any cavity at all is considered. On the bottom face of the bottom portion 414 is a female recess 415 that is configured to mate with a male protrusion or male form within the firearm. The female recess 415 can dovetail snugly with the male form to ensure secure positioning of the plate 413. The plate 413 can be made of one or more suitable materials, such as steel, metal alloy, polymers, plastics, thermoplastic, carbon fiber, or some combination thereof. The plate 413 can have sharp edges, beveled edges, smooth edge, or any combination thereof. In some embodiments, the male form or male protrusion within the firearm can include a magnetic material configured to magnetically attach to the plate 413 or vice versa. This would further secure the plate 413 within the firearm.

In some aspects, the techniques described herein relate to a firearm including: a frame; a slide; a trigger shoe assembly including: a trigger shoe further including a first engagement feature; a trigger bow further including a second first engagement feature configured to engage with the first engagement feature; a third engagement feature securing the first engagement feature and the second engagement feature into engagement with each other, a magazine catch including a catch body, a catch spring, and a release mechanism configured to disengage the magazine catch; a magazine catch retainer plate positioned between the trigger shoe and the magazine catch, wherein the magazine catch retainer plate is configured to prevent the catch spring of said magazine catch from buckling into a trigger cavity behind the trigger shoe; and an adjustment mechanism extending behind said trigger shoe, engaging with a front surface of the magazine catch retainer plate to establish a maximum allowed rearward travel of said trigger shoe, wherein the adjustment mechanism is inserted into a trigger shoe adjustment hole, wherein the adjustment mechanism being adjustable to change the maximum allowed rearward travel of the trigger shoe, the adjustment mechanism being perpendicular to the front surface of said magazine catch retainer plate for uniform engagement.

In some aspects, the techniques described herein relate to a firearm, wherein the third engagement feature is accessible from the top of the frame when the slide is removed.

In some aspects, the techniques described herein relate to a firearm, wherein the magazine catch is configured such that a magazine well is not encroached upon by the magazine catch, enabling compatibility with double stacked magazines and P320 magazines.

In some aspects, the techniques described herein relate to a firearm, wherein said third engagement feature includes a pin, a screw, or a bolt.

In some aspects, the techniques described herein relate to a firearm, wherein the release mechanism of the magazine catch includes a button or lever.

In some aspects, the techniques described herein relate to a firearm, wherein the firearm further includes an extended magazine catch button configured to release the magazine catch from a magazine.

In some aspects, the techniques described herein relate to a firearm, wherein the adjustment mechanism further includes a set screw or a threaded rod.

In some aspects, the techniques described herein relate to a firearm, wherein the adjustment mechanism includes markings or indicators for visual reference of the set rearward travel position of the trigger shoe.

In some aspects, the techniques described herein relate to a firearm, wherein the magazine catch is reversible or interchangeable to accommodate left-handed or ambidextrous shooters.

In some aspects, the techniques described herein relate to a magazine catch assembly including: a magazine catch including a catch body, a catch spring, and a release mechanism configured to disengage the magazine catch; a magazine catch retainer plate positioned between a trigger shoe and the magazine catch, wherein the magazine catch retainer plate is configured to prevent the catch spring of said magazine catch from buckling into a trigger cavity behind the trigger shoe; and an adjustment mechanism extending behind said trigger shoe, engaging with a front surface of the magazine catch retainer plate to establish a maximum allowed rearward travel of said trigger shoe, wherein the adjustment mechanism is inserted into a trigger shoe adjustment hole, wherein the adjustment mechanism being adjustable to change the maximum allowed rearward travel of the trigger shoe, the adjustment mechanism being perpendicular to the front surface of said magazine catch retainer plate for uniform engagement.

In some aspects, the techniques described herein relate to a magazine catch assembly, wherein the magazine catch retainer plate includes a top portion and a bottom portion, wherein the top portion extends longitudinally from the bottom portion.

In some aspects, the techniques described herein relate to a magazine catch assembly, wherein one side of the magazine catch retainer plate tapers from the bottom portion to the top portion.

In some aspects, the techniques described herein relate to a magazine catch assembly, top portion of the magazine catch retainer fits with a recess on the catch body.

In some aspects, the techniques described herein relate to a magazine catch assembly, wherein bottom face of the bottom portion includes a recess configured to mate with a protrusion on a frame of a firearm.

In some aspects, the techniques described herein relate to a magazine catch assembly, wherein one face of the top portion includes a recess.

In some aspects, the techniques described herein relate to a magazine catch assembly, wherein the magazine catch retainer plate has beveled edges.

In some aspects, the techniques described herein relate to a magazine catch assembly, wherein the magazine catch retainer plate has rounded edges.

In some aspects, the techniques described herein relate to a magazine catch assembly, wherein the magazine catch retainer plate is included of at least one selected from the group of steel, polymer, and carbon fiber.

In some aspects, the techniques described herein relate to a magazine catch assembly, wherein the composition of the catch body is made of at least one selected from the group of steel, polymer, and carbon fiber.

In some aspects, the techniques described herein relate to a magazine catch assembly including: a magazine catch including a catch body, a catch spring, and a release mechanism configured to disengage the magazine catch; and a magazine catch retainer plate positioned between a trigger shoe and the magazine catch, wherein the magazine catch retainer plate is configured to prevent the catch spring of said magazine catch from buckling into a trigger cavity behind the trigger shoe.

Captive Mainspring and Integral Beavertail

A 1911 includes a frame, a hammer pivotally coupled to an upper portion of the frame, a mainspring housing coupled to a lower portion of the frame, and a hammer strut extending between the hammer and the mainspring housing. The mainspring housing houses a mainspring, which provides the driving force for rotating the hammer from a cocked position to a firing position during a firing sequence. A proximal end of the hammer strut is pivotally coupled to the hammer and a distal end of the hammer strut is engaged with a top end of a mainspring. More specifically, the distal end of the hammer strut is engaged with a mainspring cap, and the mainspring cap is engaged with the top end of the mainspring.

Existing 1911 mainspring housings are pinned to the frame. In some embodiments, opposed flanges of the mainspring housing engage with corresponding channels of the frame prior to the mainspring housing being slid up and into position relative to the frame. The mainspring housing is then pinned to the frame, thereby preventing the mainspring housing from sliding out of position. By retaining the position of the mainspring housing relative to the frame, the mainspring's position is also retained. While presumably satisfactory in certain circumstances, it would be beneficial to have an alternative method of securing the mainspring's position. It would further be beneficial to have attachment methods that are more convenient than existing pin configurations for retaining the position of the mainspring.

A 1911 requires the hammer assembly to be installed before the mainspring housing can be installed. In some existing 1911 configurations, a back panel is then installed over the mainspring housing and the internal firing mechanisms. For some 1911 configurations, the back panel includes a beavertail. Other 1911 configurations include a grip safety having a beavertail. In each configuration, the beavertail is separate from the frame. Accordingly, it would be beneficial to have a 1911-style firearm that includes a beavertail that is integral with the frame. It would further be beneficial to have a method of manufacturing a 1911-style firearm in a manner that allows for the beavertail to be integral with the frame.

When moving the 1911 to a cocked configuration, the hammer is rotated to a cocked position, which causes the hammer strut to compress the mainspring. To retain constant reliable engagement of the hammer strut with the mainspring cap, the 1911 is designed such that the mainspring remains compressed, at least slightly, even when the hammer is rotated away from the cocked position, such as when the 1911 is in an un-cocked or firing configuration. In other words, when the 1911 is fully assembled, the mainspring includes some level of preload regardless of the configuration of the firearm. Unfortunately, the mainspring preload can create some issues associated with installing and removing the mainspring housing from the frame. Accordingly, it would be beneficial to have a system for and method of installing and removing the mainspring without requiring the mainspring to be preloaded.

The present invention comprises a highly modified 1911 hand pistol (the "2311"). The 2311 is similar enough to a 1911 to satisfy most loyalists, while resolving certain deficiencies associated with the 1911. Like the 1911, the 2311 utilizes a mainspring and a hammer strut. Unlike the 1911, the 2311 does not rely on existing pin configurations for retaining the position of the mainspring. Some embodiments of the 2311 include a beavertail that is integral with the frame. Furthermore, the present invention includes a method of manufacturing a 2311 in a manner that allows the beavertail to be integral with the frame. In some embodiments, the 2311 facilitates installing and removing the mainspring without requiring the mainspring to be preloaded.

Referring to FIGS. 5A-5C, a firearm of the present invention includes a frame 215, which serves as the structural foundation of the firearm. The frame 215 comprises a rigid structure designed to accommodate various components and provide stability during operation. A hammer 503 is pivotally coupled to an upper portion of the frame 215. The hammer 503 is a component responsible for striking the firing pin or primer of a cartridge, initiating the ignition process. A mainspring assembly 505 is coupled to a lower portion of the frame 215. The mainspring assembly 505 can be housed within the frame 215. The mainspring assembly 505 comprises a main body 506 which can house a mainspring 511 extending therefrom. The main body 506 acts as a housing for the mainspring 511 and provides support and guidance during the operation of the firearm. The main body 506 of the mainspring assembly 505 has a top end 507 that is open and that is specifically configured to receive a distal end of the hammer strut 504. The hammer strut 504 is a structural component extending between the hammer 503 and the mainspring assembly 505, transmitting force between them. Additionally, the top end 507 of the main body 506 serves as a retention mechanism, securely holding the top end of the mainspring 511 in place. Furthermore, the mainspring assembly 505 can include a receiving member 510 configured to receive the hammer strut 504. The receiving member 510 can be configured to be screw shaped, such as a mushroom shaped top and a cylindrical member extending into the mainspring 511. The mushroom top is designed to be stopped by the flanges 509. The mushroom top of the receiving member 510 can further include a dimple or recess or relief configured to meet with the distal end of the hammer strut 504. To ensure further retention and stability, the mainspring assembly 505 includes a retention clip 512 selectively secured to the second end 508 of the main body 506. The retention clip 512 acts as an additional retention mechanism, firmly securing the bottom end of the mainspring 511 within the mainspring assembly 505. By incorporating the hammer strut 504, main body 506, mainspring 511, and retention clip 512 into the firearm design, the present invention provides a reliable and secure mechanism for the controlled movement and operation of the hammer 503 and mainspring 511 within the firearm.

The main body 506 of the mainspring assembly 505 is specially designed to include corresponding opposed flanges 509. These opposed flanges 509 are protrusions or ridges on the main body 506 that align with and fit into the frame 215. The presence of flanges 509 facilitates slidable engagement of the mainspring assembly 505 with the frame 215. This arrangement allows for smooth and controlled movement of the mainspring assembly 505 within the frame 215, ensuring proper functioning of the firearm. In some embodiments, the mainspring assembly 505 further includes a retention mechanism 515. The retention mechanism 515 serves to secure the mainspring assembly 505 in position relative to the frame 50, thereby ensuring the stable and fixed positioning of the mainspring 511 relative to the frame 215. The retention mechanism 515 can take the form of a screw, a bolt, or similar fastening elements. It is configured to engage with corresponding threads or holes present in both the mainspring assembly 505 and the frame 215, providing a secure attachment. In certain embodiments, the retention mechanism 515 extends through a portion of the frame 215 into engagement with the retention clip 512. The retention clip 512 is a component located within the mainspring assembly 505 and serves as an additional retention mechanism for the mainspring 511. By extending through a portion of the frame 215 and engaging with the retention clip 512, the retention mechanism 515 not only secures the mainspring assembly 505 but also reinforces the attachment of the mainspring assembly 505 relative to the frame 215. The retention clip 512 can be configured to receive the mainspring 511 via a spring recess 513. The retention clip 512 can also include a retention insert 514 which can be a hole, insert, or threaded recess configured to fit the retention mechanism 515. This arrangement ensures the stability and proper functioning of the mainspring 511 within the firearm. The incorporation of the opposed flanges 509, retention mechanism 515, and retention clip 512 in certain embodiments of the firearm design provides enhanced structural integrity, secure attachment, and improved performance during firearm operation.

Referring now to FIGS. 5D-5F, some firearms of the present invention include a frame 215 having an integral beavertail 52. An integral beavertail 501 refers to a design where the beavertail component is seamlessly incorporated into the frame 215 structure itself. It eliminates the need for a separate beavertail attachment, providing a streamlined and cohesive firearm design. The integral beavertail 501 is an extended portion at the rear of the frame 215, typically positioned above the web of the shooter's hand. It enhances ergonomics by allowing for a higher grip and reducing the risk of slide bite during recoil. The integral beavertail contributes to improved control, recoil management, and overall shooting comfort. Furthermore, the integral beavertail 501 can include a beavertail recess 502 that is a recess on the beavertail 52. The beavertail recess 502 can be configured such that the hammer 503 in the depressed position fits within the beavertail recess 502.

The present embodiments further include a method of assembling a firearm. The method starts by engaging a mainspring assembly 505 with a frame 215. The mainspring assembly 505 and frame 215 are brought together, aligning the respective components. The next step is sliding the mainspring assembly 505 vertically downward into position relative to the frame 215. This vertical movement ensures that the mainspring assembly 505 properly aligns with the designated location within the frame 215, preparing it for secure attachment. Upon moving the mainspring assembly 505 into position, the mainspring assembly 505 is secured to the frame 215. This secure attachment involves fastening the mainspring assembly 505 to the frame 215 using appropriate attachment means, such as screws, pins, or other fastening elements. By securing the mainspring assembly 505 to the frame 215, the position of the mainspring 511 within the firearm is also fixed relative to the frame 215. Once the mainspring assembly 505 is securely in position, the next step is installing a hammer 503 and a hammer strut 504. The hammer 503 is affixed to the upper portion of the frame 215 and is responsible for striking the firing pin or primer of a cartridge. The hammer strut 504 extends between the hammer 503 and the mainspring assembly 505, transmitting force and energy during firearm operation. The installation of the hammer 503 and hammer strut 504 typically involves proper alignment and engagement with their respective components, ensuring smooth and controlled movement during the firing cycle. By following this method, the firearm is assembled with the mainspring assembly 505 secured in position, allowing for the proper functioning of the mainspring 511, hammer 503, and hammer strut 504 within the firearm.

In some aspects, the techniques described herein relate to a firearm including: a frame; a hammer pivotally coupled to an upper portion of the frame; a mainspring assembly coupled to a lower portion of the frame; a hammer strut extending between the hammer and the mainspring assembly; the mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; a retention mechanism configured to secure the mainspring assembly in position relative to the frame, thereby securing the position of the mainspring relative to the frame; wherein the retention mechanism extends through a portion of the frame into engagement with the retention clip, securing the mainspring assembly relative to the frame by way of the retention clip.

In some aspects, the techniques described herein relate to a firearm, wherein the frame includes a beavertail portion at a rear end of the frame.

In some aspects, the techniques described herein relate to a firearm, wherein beavertail is located under the hammer such that the shooter's hand is guarded from the hammer and a slide.

In some aspects, the techniques described herein relate to a firearm, wherein the beavertail includes a relief to configured to receive the hammer when the hammer is in a depressed position.

In some aspects, the techniques described herein relate to a firearm, wherein the retention mechanism includes a threaded screw extending through the frame and engaging with the retention clip, thereby securing the mainspring assembly in position relative to the frame.

In some aspects, the techniques described herein relate to a firearm, wherein the mainspring includes a coiled spring element.

In some aspects, the techniques described herein relate to a firearm, wherein at least a portion of the mainspring assembly is fabricated from a steel alloy, a polymer, or a carbon fiber.

In some aspects, the techniques described herein relate to a mainspring assembly including: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame;

In some aspects, the techniques described herein relate to a mainspring assembly, wherein the top end of the main body of the mainspring assembly further includes a recessed cavity configured to securely receive and retain the distal end of the hammer strut.

In some aspects, the techniques described herein relate to a mainspring assembly, wherein at least a portion of the mainspring assembly is fabricated from a steel alloy, a polymer, or a carbon fiber.

In some aspects, the techniques described herein relate to a mainspring assembly, wherein the mainspring includes a coiled spring element.

In some aspects, the techniques described herein relate to a mainspring assembly, wherein the mainspring assembly is configured to be slid vertically downward into a cavity within the frame.

In some aspects, the techniques described herein relate to a mainspring assembly, wherein the retention mechanism includes a threaded screw extending through the frame and engaging with the retention clip, thereby securing the mainspring assembly in position relative to the frame.

In some aspects, the techniques described herein relate to a method of assembling a firearm: engaging a mainspring assembly with a frame of the firearm, wherein the mainspring assembly includes: a main body having a top end configured to receive a distal end of the hammer strut and retain a top end of a mainspring; a retention clip selectively secured to a second end of the main body, serving as a retention mechanism for a bottom end of the mainspring; the main body of the mainspring assembly including corresponding opposed flanges facilitating slidable engagement of the mainspring assembly with the frame; sliding the mainspring assembly vertically downward into position relative to the frame; securing the mainspring assembly to the frame, thereby securing a mainspring of the mainspring assembly in position relative to the frame; installing a hammer and a hammer strut after the mainspring assembly is secured in position.

Handgun Slidestop

Hand pistols taught by U.S. Pat. No. 984,519, or some variation thereof, (each a "1911") have been in production for over one-hundred years. During that time, the 1911 has developed a loyal following for a variety of reasons. Unfortunately, certain features of the 1911 are not optimized. For example, the slide stop on the 1911 is not ambidextrous, i.e. the slide stop can be engaged much more easily by right-handed shooters. Accordingly, it would be beneficial to have a firearm that is capable of satisfying 1911 loyalists while improving upon certain non-optimized features.

Like the 1911, the firearm disclosed in the present embodiments includes a frame, a slide, and a slide stop for locking and releasing the slide during operation of the firearm. Unlike the 1911, the present firearm includes a slide stop is an ambidextrous slide stop that facilitates locking and releasing the slide during left-handed and right-handed operation of the firearm.

The application provides improvements upon the 1911. For example, the ambidextrous slid stop provides improved accessibility for left-handed shooters. The 1911 pistol traditionally features a slide stop/release on the left side of the frame, which can be challenging for left-handed shooters to operate comfortably. By adding an ambidextrous slide stop, left-handed shooters can easily manipulate the slide stop with their dominant hand, enhancing their ability to quickly and effectively engage the slide. As another example, the disclosed slide stop can streamline reloads and malfunction clearance. The ambidextrous slide stop simplifies the process of conducting slide lock reloads. Shooters can use their thumb or index finger of either hand to engage the slide stop, facilitating faster and more efficient reloading. Additionally, in the case of a malfunction, the ability to manipulate the slide stop with either hand allows for easier clearance of the malfunction and faster readiness for subsequent shots. Finally, the ambidextrous slide stop improves the consistency of each shooter in relation to the handgun. With an ambidextrous slide stop, shooters can maintain a consistent grip and shooting stance regardless of hand dominance. This consistency can aid in training and muscle memory development, as shooters can perform reloads and other manipulations using the same technique regardless of which hand they use to engage the slide stop.

Unlike conventional or existing slide stops such as U.S. Pat. No. 9,068,790 B2, the application does not rely on springs to function. Furthermore, this application does not require one side of the slide stop to be removed first before removing the other from the frame of the firearm. Indeed, there are no screws, pins, or other similar attachment means in many but not all of the embodiments. Rather, this application can use only a mating mechanism to removably attach the slide stop to the frame.

The slide stop 210 being configured to move in and out of engagement with the slide 205, thereby locking or releasing the slide, respectively. The slide stop 210 is an ambidextrous slide stop having left and right portions associated with a respective left and right sides of the frame 215. The slide stop 210 can be configured to engage with the slide stop notch 235 thereby stopping the slide 205 from moving.

FIGS. 6A and 6B are top-down views of the firearm 600 with the slide stop having a first portion 603 and a second portion 608 attached removably to the frame 215. In FIGS. 6A and 6B, the first portion 603 is on the left side of the firearm 600 while the second portion 608 is on the right side of the firearm 600. In other embodiments, the positions of the portions may be switched, e.g. the first portion 603 can be configured to fit the right side of the firearm 600 while the second portion 608 can be configured to fit the left side of the firearm 600. In FIG. 6A, the first portion 603 and second portion 608 are coupled to one another, and they are also coupled to the frame 215. In FIG. 6B, the first portion 603 and second portion 608 are uncoupled from each other and the frame 215. The first portion 603 can include a lever 604 and a shaft 605 extending from the lever 604. The shaft 605 can extend into the frame 215. The lever 604 can extend along the outer surface of the frame 215, thereby facilitating operation of the slide stop. The first portion 603 can further include a stopper 606 which can be configured to stop the slide 205 upon the user pushing the stopper 606 into a slide stop notch 235.

The second portion 608 can include a lever arm 610 which can be moved by the user. The first portion 603 and the second portion 608 can be interlocked by an interlocking mechanism including a male mating mechanism 607 on the first portion 603 and a female mating mechanism 609 on the second portion 608. The male mating mechanism 607 can be a protrusion or projection from the distal end of the shaft 605 without any recess. The female mating mechanism 609 can also include a protrusion or projection but perpendicular from the lever arm 610 at the distal end of lever arm 610. The male mating mechanism 607 is configured to mate removably with the female mating mechanism 609. The mechanisms 607 and 609 are configured to mate such that first portion 603 and second portion 608 move operably with one another such that a shooter can engage the stopper 606 with the slide stop notch 235 with either hand whether the shooter is left-handed or right-handed. That is, once the portions are connected, any movement of the first portion 603 necessarily results in movement of the second portion 608 and vice versa.

Though not visually depicted in FIGS. 6A-6B, the frame 215 can also include slots configured to fit the male mating mechanism of the first portion 603 and the female mating mechanism of the second portion 608. That is, the frame 215 of the handgun can include two specific slots that are designed to accommodate the male and female mating mechanisms of the first and second portions of the slide stop, respectively. The slide stop slots serve as dedicated housing areas within the frame 215 where the first and second portions of the slide stop are inserted and engaged. They ensure that the slide stop remains properly aligned and in its designated position during firearm operation. A concrete example of these slide stop slots could be two parallel channels located on the frame 215 of the handgun. These channels are precisely machined or molded to match the dimensions and shape of the male mating mechanism on the first portion 603 and the female mating mechanism on the second portion 608 of the slide stop. When assembling the slide stop, the user would align the male mating mechanism of the first portion 603 with one of the slide stop slots, and the female mating mechanism of the second portion 608 with the other slide stop slot. This alignment allows the slide stop to fit securely into the frame 215, enabling the proper functioning and movement of the slide stop mechanism. By having these specific slide stop slots, the firearm design enhances the stability, reliability, and overall performance of the slide stop mechanism. It provides a secure and consistent attachment point for the slide stop components, allowing for smooth and controlled engagement and disengagement of the slide stop with the slide stop notch 235.

In some embodiments, the first portion 603 and the second portion 608 of the slide stop are designed in such a way that they can be swapped or exchanged with each other without any modifications or adjustments to the firearm frame 215. That is, the first and second portions of the slide stop could involve a modular design approach. The first and second portions can be manufactured as separate components that are identical in shape, size, and function. They would have compatible attachment mechanisms and mating features, allowing them to be easily removed from the frame 215 and interchanged with one another. For instance, the first portion 603 and the second portion 608 of the slide stop might have corresponding connectors or fasteners that facilitate their attachment to the frame 215. These connectors could be screws, pins, or other mechanisms that secure the slide stop in place. Interchangeability offers benefits such as adaptability to different hand sizes or shooting techniques. Some users may prefer a larger thumb pad on one side or a different lever design, and being able to interchange the portions allows for personalization to suit individual needs. Additionally, interchangeability simplifies maintenance and repairs. If one portion becomes damaged or worn out, it can be replaced independently without replacing the entire slide stop assembly.

FIGS. 6C and 6D illustrate the first portion 603 and the second portion 608 in greater detail. In addition to the elements discussed above, the first portion 603 can further include a thumb pad 601 configured to be pressed by the shooter's thumb or finger. The thumb pad 601 can make it easier for the shooter to engage the slide stop. The thumb pads on either or both the first portion 603 and the second portion 608 can be textured. That is, either the second lever 318, the first lever 604, or both of them in the slide stop have a thumb pad, which is a designated area for the user's thumb to interact with, and this thumb pad has a textured surface. As a nonlimiting example, a thumb pad with a textured surface on the second lever 318 and/or the first lever 604 of the slide stop could involve adding a raised area or a protrusion on the lever's surface. This raised area can have a textured pattern, such as stippling, checkering, or grooves, which provide a tactile grip or enhanced friction for the user's thumb. The textured surface on the thumb pad serves multiple purposes. First, it improves the user's grip and control over the slide stop, particularly when manipulating it to engage or disengage the slide. The textured surface helps prevent the thumb from slipping or losing traction during operation, ensuring a secure and confident thumb placement. Second, the textured surface can assist in quick and intuitive thumb recognition. By providing a distinct tactile sensation, the user can easily locate and activate the slide stop without needing to visually confirm its position, especially in fast-paced or high-stress situations.

FIG. 6E illustrates the first portion 603 and the second portion 608 mated together but outside the context of the frame 215. As depicted, the first and second portions can be mated by snugly fitting each portion to one another. The first and second portions can be configured at least in some embodiments to have chamfered edges. As a nonlimiting example, the chamfered edges on the first and second portions of the slide stop could involve beveled or angled surfaces along the outer edges of these components. The chamfered edges are typically created by removing material at a specific angle or slope, resulting in a sloping transition between different surfaces. Chamfered edges serve two purposes in the context of the slide stop. First, they can enhance the ergonomics of the slide stop by providing smoother and more comfortable contact points for the user's fingers during operation. The beveled edges reduce sharp corners and edges, minimizing the potential for discomfort or irritation during extended firearm handling. Second, chamfered edges can help prevent snagging or catching on clothing, holsters, or other objects while drawing or manipulating the firearm 600. The angled surfaces create a more streamlined profile, reducing the likelihood of obstructions impeding the smooth movement of the slide stop.

In some embodiments, the mating mechanism between the first portion 603 and the second portion 608 of the slide stop can include a locking mechanism configured to prevent accidental disengagement during an operation of the firearm. When the slide stop is in the engaged position, the detent ball would securely engage the notch, creating a positive locking mechanism. This locking mechanism prevents the slide stop from inadvertently disengaging due to recoil, vibration, or other external forces that may be experienced during firearm operation. To disengage the slide stop intentionally, the user would need to apply a specific amount of force or manipulate the slide stop in a deliberate manner to overcome the resistance provided by the locking mechanism. This ensures that the slide stop remains engaged during normal operation but can still be readily released when intended.

In still other embodiments, the slide stop can be combined with other useful elements such as a visual indicator configured to indicate the status of the slide stop's engagement with the slide stop notch 235. That is, the slide stop can include a visual indicator that is specifically designed to provide information about the status of the slide stop's engagement with the slide stop notch 235 on the firearm 600. A nonlimiting example of a visual indicator could be a small window or cutout on the slide stop itself, which allows the user to visually inspect and determine whether the slide stop is engaged or disengaged with the slide stop notch 235. For instance, when the slide stop is in the engaged position, the visual indicator might show a colored dot or line, indicating that the slide stop is securely locking the slide 205 in place. This visual cue gives the user immediate feedback that the slide 205 is properly locked and ready for operation. On the other hand, when the slide stop is disengaged or released, the visual indicator might show an absence of color or a different pattern, signaling that the slide stop is not engaged with the slide stop notch 235. This visual cue serves as a reminder to the user that the slide 205 can freely move and that the firearm 600 may need to be reloaded or attended to.

In still other embodiments, the first portion 603 and the second portion 608 of the slide stop have specific alignment features that facilitate their proper mating or connection with each other via their respective mating mechanisms. A nonlimiting example of alignment features for mating on the first and second portions of the slide stop would involve corresponding recesses and protrusions. These features are designed to align the two portions precisely when they are brought together during assembly. For instance, the first portion 603 of the slide stop might have a recess or groove machined into its surface, while the second portion 608 could have a corresponding protrusion or ridge that fits snugly into the recess. This ensures that when the two portions are joined, they align perfectly, allowing for a secure and stable connection. Alignment features can play a crucial role in ensuring the proper functioning of the slide stop. They prevent misalignment, wobbling, or unintended movement of the slide stop during firearm operation, which could compromise the reliability and safety of the firearm 600. By incorporating alignment features, the first and second portions of the slide stop can be easily and accurately positioned relative to each other, ensuring a precise and consistent engagement and disengagement of the slide stop with the stop notch of the handgun slide. These alignment features simplify the assembly process for the user, enabling them to quickly and accurately join the first and second portions without the need for complex adjustments or excessive force.

In some aspects, the techniques described herein relate to a firearm including: a frame of a handgun including an outer surface with a first side and a second side; a slide attached slidably to the frame including a stop notch; and a slide stop attached to frame, wherein the slide stop is configured to move in and out of engagement with the slide for locking and releasing the slide, wherein the slide stop includes a first portion and a second portion both removably attached to the frame, wherein the first portion is on the first side of the frame and the second portion is on the second side of the frame; wherein the first portion includes a first lever with a proximal end and a distal end, a shaft extending perpendicularly from the distal end of the first lever, and a stopper extending from the proximal end of the first lever configured to mate with the stop notch, the first lever extending along the outer surface of the frame facilitating the operation of the slide stop; wherein the second portion includes a second lever; wherein the slide stop further includes a mating mechanism between the first portion and the second portion, wherein the mating mechanism further includes a male mating mechanism on the first portion and a female mating mechanism on the second portion, wherein the male mating mechanism is a protrusion extending from the shaft, and the female mating mechanism is a protrusion extending perpendicularly from the second lever; wherein the first portion and the second portion, upon mating with each other via the mating mechanism move operably with one another such that engaging the stopper with the slide stop notch 235 is achievable with either hand of a user.

In some aspects, the techniques described herein relate to a firearm, wherein the firearm further includes a thumb pad on the first portion, facilitating engagement of the slide stop by the user's thumb or finger.

In some aspects, the techniques described herein relate to a firearm, wherein the firearm further includes an adjustable tension mechanism on the first portion to customize the force required for engaging and disengaging the stop notch.

In some aspects, the techniques described herein relate to a firearm, wherein the first portion and the second portion of the slide stop further include alignment features for mating.

In some aspects, the techniques described herein relate to a firearm, wherein the mating mechanism between the first portion and the second portion of the slide stop further includes a locking mechanism configured to prevent accidental disengagement during an operation of the firearm.

In some aspects, the techniques described herein relate to a firearm, wherein the first portion and the second portion of the slide stop are configured to be interchangeable.

In some aspects, the techniques described herein relate to a firearm, wherein the slide stop further includes a visual indicator configured to indicate the status of the slide stop's engagement with the slide stop notch 235.

In some aspects, the techniques described herein relate to a firearm, wherein the frame includes two slide stop slots configured to fit the male mating mechanism of the first portion and the female mating mechanism of the second portion.

In some aspects, the techniques described herein relate to a firearm, wherein the slide stop is made of at least one selected from the group of steel, aluminum, and titanium.

In some aspects, the techniques described herein relate to a device including: a slide stop configured to be attached to a frame of a handgun, wherein the slide stop is configured to move in and out of engagement with a handgun slide including a stop notch for locking and releasing the handgun slide on the handgun, wherein the slide stop includes a first portion configured to be removably attached to a first side of the frame and a second portion configured to be removably attached to a second side of the frame; wherein the first portion includes a first lever with a distal end and a proximal end, a shaft extending substantially perpendicularly from the distal end of the first lever, and a stopper extending from the proximal end of the first lever configured to mate with the stop notch, the first lever configured to extend along the outer surface of the frame to facilitate the operation of the slide stop; wherein the second portion includes a second lever; wherein the slide stop further includes a mating mechanism between the first portion and the second portion, wherein the mating mechanism further includes a male mating mechanism on the first portion and a female mating mechanism on the second portion, wherein the male mating mechanism is a protrusion extending from the shaft, and the female mating mechanism is a protrusion extending perpendicularly from the second lever; wherein the first portion and the second portion, upon mating with each other via the mating mechanism are configured to move operably with one another such that a user can engage the stopper on the first side of the frame or the second side of the frame.

In some aspects, the techniques described herein relate to a device, wherein the slide stop is made of at least one selected from the group of polymer, thermoplastic, and polycarbonate.

In some aspects, the techniques described herein relate to a device, wherein the first lever of the slide stop further includes a thumb pad with a textured surface.

In some aspects, the techniques described herein relate to a device, wherein the second lever of the slide stop further includes a thumb pad with a textured surface.

In some aspects, the techniques described herein relate to a device, wherein the first portion and the second portion further include chamfered edges.

In some aspects, the techniques described herein relate to a device, wherein the first portion and the second portion of the slide stop are reversible and can be interchanged.

In some aspects, the techniques described herein relate to a slide stop for a handgun, including: a first portion configured to be removably attached to a side of a frame of a handgun; a second portion configured to be removably attached to an opposite side of the frame of the handgun; the first portion including a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide; the second portion including a lever; and a mating mechanism between the first portion and the second portion, wherein the mating mechanism includes a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame.

In some aspects, the techniques described herein relate to a slide stop, wherein the first portion and the second portion of the slide stop are configured to be interchangeable.

In some aspects, the techniques described herein relate to a slide stop, wherein the first lever of the slide stop further includes a thumb pad with a textured surface.

In some aspects, the techniques described herein relate to a slide stop, wherein the second lever of the slide stop further includes a thumb pad with a textured surface.

In some aspects, the techniques described herein relate to a slide stop, wherein the slide stop further includes a visual indicator configured to indicate the status of the slide stop's engagement with the slide stop notch.

In some aspects, reference made to a firearm 200 is meant to include the following elements found in conventional handguns such as without limitation: a frame; slide, barrel; trigger; hammer; firing pin; sight; grip; magazine; trigger guard; safety; slide release; extractor; ejector; recoil spring; magazine release; magazine base plate; disconnector; sear; sear spring; magazine follower; magazine spring; and pin retainers. One or more of these elements can be included in the term "frame," "firearm," or both.

It is understood that some or all of the devices or elements thereof can be made or manufactured out of one or more materials. These materials can include without limitation: steel; stainless steel; aluminum; titanium; a zinc alloy; brass; polymer; fiberglass; thermoplastic; polyethylene; polyamide; polycarbonate; and polypropylene. The use of different materials for the first and second portions of the slide stop offers several advantages. By allowing a combination of metal, polymer, and composite materials, the firearm manufacturer can optimize the slide stop's performance and functionality. For example, using a metal material for the first portion 602, such as steel or aluminum, can provide strength and durability to withstand the forces involved in locking and releasing the handgun slide. On the other hand, employing a polymer or composite material for the second portion 607 can contribute to weight reduction, enhancing the overall maneuverability and ergonomics of the firearm. Additionally, the choice of materials for each portion can be tailored to specific requirements, such as corrosion resistance, impact absorption, or friction reduction. This versatility in material selection for the first and second portions of the slide stop 210 enables firearm designers to achieve the desired balance of strength, weight, and performance characteristics, ultimately enhancing the overall user experience and satisfaction.

Although some elements with reference to the firearm have been described, they are not exhaustive. Other elements can be added to make the slide stop more versatile, user friendly, or mechanically sound. For example, the firearm can include an adjustable tension mechanism on the first portion 602 to customize the force required for engaging and disengaging the stop notch. This mechanism allows the user to customize or adjust the amount of force or tension required to engage and disengage the stop notch on the handgun slide. For example, the adjustable tension mechanism could be a small screw or set screw embedded within the first portion 602 of the slide stop. By turning the screw clockwise or counterclockwise, the user can increase or decrease the tension applied to the stop notch. For instance, when the tension is set to a higher level, it would require more force or effort from the user to engage or disengage the slide stop. This can provide added security and prevent accidental engagement or disengagement of the slide stop during firearm operation. Conversely, if the tension is set to a lower level, it would reduce the force required to operate the slide stop. This can be useful for users who prefer a smoother and easier slide stop operation or for individuals who may have limited hand strength.

Debris Channels

A 1911 includes a frame, a hammer pivotally coupled to an upper portion of the frame, a slide slidably coupled to the frame and forming a void therebetween (the "barrel void"), and a barrel positioned at least partially within the barrel void. The barrel is coupled to the frame and operably linked to the slide such that movement of the slide causes the barrel to move as well. In particular, the barrel rocks backward towards a loading position as the slide moves backwards towards a cocking position. After cocking and loading the firearm, the slide and the barrel move simultaneously back to their respective firing positions. Unfortunately, the 1911 is at least somewhat susceptible to debris migrating into internal areas of the firearm, such as the barrel void. Once inside the firearm, the debris can collect in one or more working joints of the firearm (and/or can collect in one or more other areas) in such a way as to cause unnecessary wear or other damage. Accordingly, it would be beneficial to have a 1911-style firearm that includes provisions for mitigating risk associated with debris.

Of particular concern is debris migrating into the barrel of the 1911, such as through the breech of the barrel during a loading operation for the firearm. Accordingly, it would be beneficial to have a 1911-style firearm that includes provisions for directing debris away from the breech of the barrel.

The present invention comprises a modified 1911 hand pistol (the "2311"). The 2311 is similar enough to a 1911 to satisfy most loyalists, while resolving certain deficiencies associated with the 1911. Like the 1911, the 2311 includes a barrel void positioned between a frame and a slide. Both firearms also include a barrel positioned at least partially within the barrel void. Unlike the 1911, an inner surface of the frame of the 2311 defines a relief in communication with the barrel void (or forming part of the barrel void, as the case may be), the relief being configured to capture debris, thereby mitigating risk associated with the debris. Furthermore, some embodiments of the 2311 include provisions for directing debris away from a breech of the barrel.

The debris management elements provide several benefits over conventional handguns. For example, the debris management elements can enhance reliability of the handgun. Debris, such as dirt, dust, or small particles, can disrupt the smooth functioning of the firearm's moving parts. By reducing the risk of debris entering the internal areas, particularly the barrel void, the firearm's reliability and overall performance can be improved. Unwanted debris can cause malfunctions, misfeeds, or other operational issues, leading to potential failures or delays in critical situations. Furthermore, the debris management system can reduce the need to maintain the handgun and in turn improve durability. Debris accumulation in working joints or other areas of the firearm can contribute to increased wear and tear. Over time, this can lead to mechanical problems and a decrease in the firearm's lifespan. By designing the 1911-style firearm with better debris mitigation, the need for frequent cleaning, maintenance, and repairs can be reduced, ensuring long-term durability and minimizing downtime. Furthermore, these elements will improve consistency and accuracy of the handgun in use. Any foreign material present in the barrel or other critical areas of the firearm can affect the accuracy and consistency of the shots. Even small debris particles can disrupt the trajectory of the bullet or affect the timing of the firearm's cycling mechanism. By minimizing debris intrusion, the firearm can maintain its intended precision and consistency, crucial for accurate shooting. Finally, these debris management elements will improve safety and functionality. A clean and well-maintained firearm is essential for safe operation. Debris inside the firearm can potentially interfere with safety mechanisms or cause unintended behavior, posing a safety risk to the shooter and those in proximity. Improving debris mitigation in the 1911-style firearm ensures that it operates as intended, reducing the likelihood of accidental discharges or other safety-related issues. In summary, enhancing the debris mitigating elements of the 1911-style firearm leads to improved reliability, reduced maintenance requirements, increased durability, consistent accuracy, and enhanced safety. These benefits collectively contribute to a more effective and reliable firearm for the user.

Referring to FIGS. 7A-7C is an elevation view of a portion of the frame 215 with a relief 700. The relief 700 can sit below where the barrel 701 would typically sit once assembled with the frame 215. The relief 700 can be shaped such that the debris that would typically be held in the barrel void would instead fall into the relief 700. The relief 700 can sit coaxially within the portion of the frame 215 that typically holds the barrel 701. The relief 700 can vary in length in different embodiments. In some embodiments, the relief 700 can have sharp or curved edges, or even sheer walls conducive to trapping debris. In still other embodiments, the relief can have beveled or chamfered edges.

In FIGS. 7D-7E, the barrel 701 can have a cylindrical body, a barrel exterior 702, a barrel interior 703, and a barrel lug 706 configured to be coupled to the frame 215 so as to facilitate rocking the barrel 701 between loading and firing positions. The barrel 701 can further include on the barrel lug 706 with a first flute 704 and a second flute 705, each flute being designed to direct debris away from barrel interior 703. A first flute 704 and second flute 705 can be present on both sides of the barrel lug 706. The first flute 704 extends from the front of the barrel lug 706 towards the rear of the barrel lug 706 such that the first flute is parallel with the barrel 701. The second flute 705 can extend down at an angle such that the second flute 705 is angled relative to the barrel 701. The first flute 704 and the second flute 705 can intersect such that the opening of the second flute 705 is within the first flute 704.

FIG. 7F shows a side elevation view of the barrel 701 and the frame 215.

In some aspects, the techniques described herein relate to a firearm including: a slide assembly; a barrel; a frame configured mate with the slide assembly, wherein the frame and the slide assembly can house the barrel, wherein the frame includes an inner surface; a relief in the inner surface of the frame wherein the relief is coaxially situated on the inner surface of the frame; and a barrel lug configured to removably attach the barrel to the frame, wherein the barrel lug further includes a first flute and a second flute.

In some aspects, the techniques described herein relate to a firearm, wherein relief is below a placement of the barrel within the frame when barrel is assembled with the frame.

In some aspects, the techniques described herein relate to a firearm, wherein the barrel has a cylindrical body, and exterior, and an interior.

In some aspects, the techniques described herein relate to a firearm, wherein the relief is configured to capture debris in between the barrel and the interior of the frame.

In some aspects, the techniques described herein relate to a firearm, wherein first flute and the second flute are configured to direct debris away from the interior of the frame.

In some aspects, the techniques described herein relate to a firearm, wherein the first flute is parallel to the barrel.

In some aspects, the techniques described herein relate to a firearm, wherein the second flute is at an angle relative to the barrel.

In some aspects, the techniques described herein relate to a firearm, wherein the barrel lug facilitates a rocking movement of the barrel between loading and firing positions of the firearm.

In some aspects, the techniques described herein relate to a firearm, wherein the firearm includes a plurality of reliefs in the inner surface of the frame.

In some aspects, the techniques described herein relate to a firearm, wherein the barrel lug includes three or more flutes configured to direct debris away from the interior of the frame.

In some aspects, the techniques described herein relate to a firearm including: a slide assembly; a barrel; a frame configured mate with the slide assembly, wherein the frame and the slide assembly can house the barrel, wherein the frame includes an inner surface; and a relief in the inner surface of the frame wherein the relief is coaxially situated on the inner surface of the frame.

In some aspects, the techniques described herein relate to a frame, wherein relief is below a placement of the barrel within the frame when barrel is assembled with the frame.

In some aspects, the techniques described herein relate to a frame, wherein the barrel has a cylindrical body, and exterior, and an interior.

In some aspects, the techniques described herein relate to a frame, wherein the relief is configured to capture debris in between the barrel and the interior of the frame.

In some aspects, the techniques described herein relate to a frame, wherein the firearm includes a plurality of reliefs in the inner surface of the frame.

In some aspects, the techniques described herein relate to a frame, wherein the relief has chamfered edges.

In some aspects, the techniques described herein relate to a frame, wherein the relief has sharp edges.

In some aspects, the techniques described herein relate to a frame, wherein the relief has curved edges.

In some aspects, the techniques described herein relate to a frame, wherein the relief within the frame includes sheer walls with a textured surface. This area can have a textured pattern, such as stippling, checkering, or grooves, which facilitate the accumulation of debris.

In some aspects, the techniques described herein relate to a frame, wherein the relief within includes a length that extends less than half of the entire inner surface.

In some aspects, the techniques described herein relate to a firearm frame including: an inner surface; a relief in the inner surface of the frame wherein the relief is coaxially situated on the inner surface of the frame.

Modular Firearm Block

Hand pistols taught by U.S. Pat. No. 984,519, or some variation thereof, (each a "1911") have been in production for over one-hundred years. During that time, the 1911 has developed a loyal following for a variety of reasons. Unfortunately, the front sight on the 1911 is on the slide, which moves during firing. Thus, aiming is made more difficult. It would be beneficial to provide a firearm with a front sight that could be stationary during firing.

The following description relates to a modular firearm block that is can be removably attached to the frame of a firearm, e.g. the frame of a handgun. The firearm block can be attached to the frame via one or more attachment mechanisms such as a pin and pin connector. Also, the block can be configured to mate with the frame via a dovetail attachment mechanism or some other suitable mating mechanism. In an exemplary situation, the user can assemble the barrel and slide to the frame of the firearm. Then, after pulling back the slide, the user can attach the block to the frame of the gun via the attachment mechanisms. Thus, the block is fully modular.

The modular block offers a stationary sight while the firearm is firing or cycling, thus improving the aim of the user. Furthermore, the pin and pin connectors (as well as the dovetail configuration) make the block easy to assemble and disassemble from the firearm. Thus, the user can much more quickly release the front system and swap out other modular blocks, clean the firearm, or other action that requires partial or complete disassembly.

Additionally, the modular block can act not only as a stationary sight, but also as a muzzle brake. That is, the modular block can reduce recoil and control muzzle rise during firing. It can redirect and manage the gases that are expelled from the barrel when a round is fired, thereby mitigating the effects of recoil on the shooter. Such muzzle braking is particularly useful for competition pistols, where fast follow-up shots and recoil management are crucial for performance. Regardless, the modular block can mitigate recoil in any shooting situation. Furthermore, the modular block can address muzzle rise and flip. Muzzle rise occurs when the front of the handgun rises during firing due to the recoil forces. This can make it challenging to maintain sight alignment and sight picture for follow-up shots. A compensator's design directs the expelled gases in a way that counteracts the upward motion of the muzzle, keeping the firearm more stable during rapid fire and enabling quicker target reacquisition. Although not illustrated in the figures, it is understood that some embodiments of the modular block can include ports specifically designed to manage the escape of gases while firing. Furthermore, the frame of the handgun in the following embodiments is configured to receive multiple different modular blocks. This would be useful in situations where the shooter would like to switch out modular blocks for competitions or for aesthetic purposes.

FIGS. 8A, 8B, and 8C illustrate a modular sight block 800 according to an exemplary embodiment. FIG. 8A is a perspective view of the sight block 800. The block 800 can include a barrel hole 801 which can match the size and shape of the barrel or otherwise be suitably sized for the barrel of the firearm. Below the barrel hole 801 is the pin hole 802. The pin hole 802 can be smaller than the barrel hole 801 and threaded for engagement with the pin 805. The block 800 can also have a member 803 on the lower portion of the block 800, i.e. the portion below the barrel hole 801 and the pin hole 802. The member 803 can be designed like a dovetail so that it can fit snugly with a corresponding member recess on the frame 215. Running from the member 803 into the pin hole 802 is a pin connector hole 804. The pin connector hole 804 can be shaped and sized to fit the pin connector 808.

Regarding FIG. 8B, the block 800 can be engaged with a pin 805 and a pin connector 808. The pin 805 can be any suitable attachment mechanism such as a screw, thread, rod, or pin. The pin 805 may be threaded to removably attached with a correspondingly threaded pin connector 808. The pin 805 may have a pin head 806 and pin body 807. The pin head 806 can have a recess suitable for using a screwdriver or some other driving member to attach the pin 805 to the pin connector member 810. The pin body 807 can be threaded to fit the pin connector 808 via the pin body recess. The pin connector 808 can be threaded through the pin connector hole 804 such that the pin body recess 809 sits within the pin hole 802 and the pin connector member 810 extends past the pin connector hole 804 such that the pin connector member 810 can removably attach to the pin connector member recess as illustrated in FIG. 8A.

Regarding FIG. 8C, the block 800 can engage with the pin 805 and the pin connector 808 such that the pin 805 removably attaches to the pin connector 808 within the pin hole 802. Once connected with the pin 805, the pin connector member 810 extends past the pin connector hole 804 out of the member 803.

FIGS. 8D, 8E, and 8F illustrate a firearm frame 215 with and without a modular sight block according to an exemplary embodiment.

Regarding FIG. 8D, the frame 215 can include a barrel recess 811 extending along the portion of the frame 215 where the barrel of a conventional 1911 would sit. Overlapping with the barrel recess 811 is the block member recess 812 designed to receive or mate with the block member 803. In some embodiments, the block member 803 and the block member recess 812 can be designed to have a dovetail configuration such that the block member 803 can dovetail or slide 205 into the block member recess 812 such that the block member 803 is mated and removably attached to the frame 215. Within the block member recess 812 is a pin connector member recess 813 which is designed to receive the pin connector member 810. In one embodiment, the pin connector member 810 once mated with the pin connector member recess 813 will provide further stability to the attachment between the block 800 and the frame 215.

Regarding FIG. 8E, the block 800 can be removably attached to the block member recess 812 on the frame 215. Although not pictured in FIG. 4B, it is understood that the pin 805 and the pin connector 808 can be attached to the block 800 via the pin hole 802.

Regarding FIG. 8F, the diagram shows how the pin 805 and the pin connector 808 would appear on the frame 215 without the block 800. This diagram is not meant to show an embodiment, but rather how the pin 805 and the pin connector 808 would attach to the frame 215 without the block 800 obstructing the view.

In some aspects, the techniques described herein relate to a firearm including: a frame including a block member recess and a pin connector member recess; a barrel; a slide; and a sight block including: a block member configured to removably attach to the block member recess; a barrel hole; a pin hole below the barrel hole; a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a firearm, wherein the pin is a threaded screw, bolt, or rod. In this aspect, the pin used to attach the modular sight block to the firearm is designed as a threaded screw, bolt, or rod. The threading allows for a secure and removable attachment of the pin to the pin connector. This threaded pin provides a reliable and robust connection between the sight block and the firearm frame. A threaded bolt pin could be used in this aspect. It would have a threaded body that matches the threading inside the pin connector hole of the sight block. The bolt pin could be inserted through the pin hole in the sight block and screwed into the pin connector, ensuring a tight and secure attachment.

In some aspects, the techniques described herein relate to a firearm, wherein the pin connector is threaded to receive the pin. This aspect pertains to the pin connector, which is the component that receives and engages with the threaded pin to attach the sight block. The pin connector itself is designed with threading that matches the pin, allowing the two to be screwed together. This threaded connection ensures a firm and stable attachment between the sight block and the firearm frame. For example, pin connector could be a cylindrical component with internal threading that corresponds to the threading on the pin. When the pin is inserted into the pin connector hole of the sight block, the pin connector is screwed onto the pin, securely fastening the sight block to the firearm frame.

In some aspects, the techniques described herein relate to a firearm, wherein the pin includes a pin head and a pin body, wherein the pin head can be operably engaged with a screwdriver. For example, the pin could be designed with a pin head that has a recessed slot or a suitable shape for accommodating a screwdriver. This allows the user to tighten or loosen the pin using a screwdriver, providing a straightforward method for attaching or removing the sight block.

In some aspects, the techniques described herein relate to a firearm, wherein the sight block is configured to be covered by the slide while firearm is assembled but not firing.

In some aspects, the techniques described herein relate to a firearm, wherein the sight block is configured to remain in a fixed position while the firearm is firing.

In some aspects, the techniques described herein relate to a firearm, wherein the sight block has beveled edges.

In some aspects, the techniques described herein relate to a firearm, wherein the sight block has rounded edges.

In some aspects, the techniques described herein relate to a firearm, wherein the sight block is included of at least one selected from the group of steel, polymer, and carbon fiber.

In some aspects, the techniques described herein relate to a firearm including: a frame including a block member recess and a pin connector recess; a sight block including: a block member configured to removably attach to the block member recess; a barrel hole; a pin hole below the barrel hole; a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

In some aspects, the techniques described herein relate to a firearm, wherein the pin is a threaded screw, bolt, or rod.

In some aspects, the techniques described herein relate to a firearm, wherein the pin connector is threaded to receive the pin.

In some aspects, the techniques described herein relate to a firearm, wherein the pin includes a pin head and a pin body, wherein the pin head can be operably engaged with a screwdriver.

In some aspects, the techniques described herein relate to a firearm, wherein the member recess is itself within a barrel recess on the frame.

In some aspects, the techniques described herein relate to a firearm, wherein the sight block is included of at least one selected from the group of steel, polymer, and carbon fiber.

In some aspects, the techniques described herein relate to a firearm, wherein the pin connector member recess overlaps with a barrel recess on the frame.

In some aspects, the techniques described herein relate to a firearm, wherein the block member and the block member recess include a dovetail attachment mechanism.

In some aspects, the techniques described herein relate to a firearm, wherein the pin connector member and the pin connector member recess include a mortise and tenon attachment mechanism, wherein the pin connector member is the mortise and the pin connector member recess is the tenon.

In some aspects, the techniques described herein relate to a firearm, wherein removing the pin from the pin connector will release the pin connector member from the pin connector member recess.

In some aspects, the techniques described herein relate to a sight block including: a block member configured to removably attach to a block member recess in a firearm frame; a barrel hole; a pin hole below the barrel hole; a pin connector hole running through the block member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

Modular Finger Interface

The modular finger interface embodiments described herein may be implemented by themselves or with any one or more of the embodiments described above and/or in FIGS. 2-8. The modular finger interface advantageously allows a user to incorporate different features, e.g., accessories, into the firearm with minimal effort by the user such that the frame comprises a multi-purpose modular interface configured to allow for different purposes and outcomes.

In one embodiment, a modular firearm frame comprises a frame which is straight at a top and wherein the straight length then extends downward to form a grip. The frame comprises a recessed socket face located at a position in the straight length of the frame. The position may vary but in some embodiments the recessed socket face is at least partially above where a trigger guard will either be attached to the frame or made integral with the frame. The recessed socket may be on one or preferably both sides of the frame below the barrel. The precise location, as well as the specific dimensions and shape of the recessed socket are not particularly critical so long as the recessed socket or sockets can receive a removable finger interface that is configured to fit within and releasably attach to the recessed socket face.

The removable finger interface and corresponding received removable finger interface may be designed to comprise either an integral or other attached accessory. As such, the specific dimensions, shape, and/or attachment mechanism of the recessed socket and/or the received removable finger interface may be configured such that a received removable finger interface can accommodate the weight and/or shape of one or more desired accessories.

The specific joining mechanism between the recessed socket and removable finger interface is not particularly critical so long as it adequately secures the removable finger interface within the recessed socket during use of the firearm. In some embodiments, the modular firearm frame comprises a recessed socket comprising a dovetail perimeter configured to locate and secure a matching removable finger interface. Suitable dovetail perimeters may include, for example, perimeters that facilitate a companion finger interface to be locked into the recessed socket via sliding the companion finger interface upward and pushing inward with a force sufficient to snap and lock the finger interface into the recessed socket. In this or other embodiments, the perimeter of the finger interface may match that of the recessed socket but be slightly smaller such that it can be releasably snapped into the recessed socket.

In some embodiments, the recessed socket comprises a hole configured to accept a fastener such as, for example, a screw to secure the removable finger interface into the recessed socket. In some embodiments, the joining mechanism may be a tongue-and-groove (or tail-and-pin) connection. In some embodiments the recessed socket and removable finger interface may be located and secured by a counterbore keyway with a relatively flat-bottomed opening or a countersink keyhole with a tapered opening. In some embodiments, the joining mechanism is such that any fastener employed does not substantially protrude from the surface of the removable finger interface, but rather, is relatively flush.

As described above, the removable finger interface allows for the ready use of accessories such that the finger interface further comprises an accessory. In such embodiments the removable finger interface and the accessory may be integral to each other or alternatively be attached to one another via a convenient mechanism. In preferred embodiments, the removable finger interface and the accessory are integral such that each different optional accessory has an associated integral removable finger interface. In some embodiments an optional accessory comprises two associated integral removable finger interfaces such that a first associated integral removable finger interface is configured to attach to one side of the firearm frame and the second integral removable finger interface is configured to attach to the other side of the firearm frame.

The accessories that may be employed with the removable finger interface are not particularly limited and include, for example, a support hand thumb rest, as well as, various optics mounts, lasers, and sights. Other potential accessories may include, for example, a storage compartment for a tool such as a small screwdriver or battery, a flashlight, a vertical foregrip for a rifle configuration, or an identifying marker such as a UV or infrared red reflective panel. In sum, the modular firearm frame is may be employed on virtually any firearm such to facilitate customization. Such firearms include, handguns such as pistols and revolvers, as well as certain rifles. Particularly preferred firearms that may employ the modular firearm frame described here include semi-automatic pistols such as SIG SAUER P320™, OA DEFENSE 2311™, STACATTO 2011™, and other 1911-style pistols.

FIG. 9A shows a pistol having the modular firearm frame described above. The firearm frame 215*a* has a grip with the trigger guard 920 in front of the grip which is the lower portion of the frame 215*a*. The trigger guard 920 may be integral with the frame or alternatively be separate from the frame and attached to the grip. The removable finger interface 900 is located at a position along the straight length of the frame before the frame extends downward to form a grip. In FIG. 9A the removable finger interface is shown at least partially above trigger guard 920. The removable finger interface is held within the recessed socket face with screw 910 through a hole 930 as shown in FIG. 9B. The removable finger interface is flush with the adjacent frame such that holsters need not be modified to accommodate firearms having the modular firearm frames described herein.

FIG. 9B shows a removable finger interface 900 having a dovetail perimeter with hole 930 for a fastener and integral gas pedal MIP 940 as an accessory. Gas pedal MIP is a modified takedown lever for a user's support hand thumb. FIGS. 9C and 9D show different perspective views of the firearm of FIG. 9A having a removable finger interface 900 with a dovetail perimeter. The same or different configuration may be employed on the opposite side of the frame so that these parts may be removed by removing one screw and sliding the removable finger interface out of the matching dovetail socket. Thus, customization may be accomplished with little to no risk of damaging the frame, slide, and/or changing the firearm's outward appearance such as showing threaded holes when an accessory is not installed.

FIG. 9E shows a top view of a customized firearm wherein gas pedal 940 is attached via a removable finger interface on one side while the other side remains flush using an opposing removable finger interface without an integrated accessory.

FIG. 9F shows a customized firearm wherein optics mount 950 is attached via a removable finger interface 900 on each side of the frame. In this manner the optics mount can be added using only two screws-one in each removable finger interface 900 as opposed to the many multiple screws associated with prior mounting of optics.

As shown in 9G the optics mount can be installed in some embodiments by removing the slide, inserting the front of the frame through the optics mount and sliding the optics mount 950 into the dovetail perimeter recessed sockets from below and inserting the screws.

In some embodiments the counterbore behind, i.e., the tapped screwhole on the removable finger interface, slightly offset a few thousands of an inch so that it is not centered. This may be done with, for example, a drill point, e.g., one having a tapered/conical end created by the drill. This may facilitate the attaching set screw to apply force and locate the removable finger interface toward the proper direction of the dovetailed socket. This may provide a more positive clamping force, more consistently locating the removable finger interface once installed and torqued, and specifically assist in resisting significant wiggle and/or deflection in a direction that would uninstall the removable finger interface. This concept is demonstrated in FIGS. 9H, 9I, 9J, and 9K.

In FIG. 9K as the set screw (1) is driven into the mating part, the offset (2) between the centers of the screw and the countersink below causes the screw to contact at a point that drives the modular interface further upward and into its socket. Additionally, the set screw pushes outward, securing the removable finger interface outward (4) against the dovetailed recessed socket, firmly locking the removable finger interface in the recessed socket face once torqued.

FIGS. 9L and 9M show different perspectives of a recessed socket face 960 on a modular firearm frame. The recessed socket comprises a dovetail perimeter for accepting a dovetail shaped removable finger interface in the recessed socket face. A hole 970 is configured to accept a fastener such as a screw in which case hole 970 may be threaded.

FIGS. 9N and 9O show different perspectives of a recessed socket face 960 on a modular firearm frame. The recessed socket is configured to be accept and retain a removable finger interface in the recessed socket face using a counterbore keyway which may be square.

FIGS. 9P, 9Q, 9R illustrate a detent-style retention that may be employed to facilitate retaining a removable finger interface in a recessed socket face. If desired, such detents can be integrated with, for example, a fastening means such as one or more pins that hold the grip to the frame. Alternatively, the detent-style retention may be implemented with a separate group of parts dedicated to retaining the modular finger interfaces. FIGS. 9P, 9Q, 9R illustrate a grip-frame-pin style. In another embodiment, detent-style retention could be implemented without a pin and the detents may be in a suitable position such as where the threaded holes/countersinks are in other embodiments described here.

FIG. 9S illustrates another detent-style of retention that may be employed to facilitate retaining a removable finger interface in a recessed socket face. In FIG. 9S the detent is not allowed to pass through to act as a pin, but rather, is kept under constant pressure, forcing the removable finger interface to be retained in the recessed socket face like the set screw. A small hole may be used to allow the detent to be depressed with a tool for removal of the removable finger interface from the recessed socket face.

FIG. 9T shows the recessed socket face on the frame without the removable finger interface in place.

Modular Finger Interface Embodiments

1. A modular firearm frame comprising:
   - a frame which is straight at a top and wherein the straight length extends downward to form a grip;
   - wherein the frame comprises a recessed socket face located in the straight length of the frame;
   - a removable finger interface configured to fit within and attach to the recessed socket face.

2. The modular firearm frame of embodiment 1 wherein the recessed socket comprises a dovetail perimeter configured to locate and secure the removable finger interface.
3. The modular firearm frame of embodiment 2 wherein the recessed socket comprises a hole configured to accept a fastener to secure the removable finger interface.
4. The modular firearm frame of embodiment 2 wherein the fastener is a screw.
5. The modular firearm frame of embodiment 1 wherein the recessed socket comprises a counterbore keyway configured to locate and secure the removable finger interface.
6. The modular firearm frame of embodiment 1 wherein the removable finger interface further comprises an accessory.
7. The modular firearm frame of embodiment 6 wherein the removable finger interface and the accessory are integral to each other.
8. The modular firearm frame of claim 6 wherein the accessory comprises a storage compartment for a tool.
9. The modular firearm frame of embodiment 6 wherein the accessory comprises a storage compartment for a tool, a flashlight, a laser module, a vertical foregrip for a rifle, or an identifying marker.
10. The modular firearm frame of embodiment 6 wherein the accessory comprises a support hand thumb rest.
11. The modular firearm frame of embodiment 6 wherein the accessory comprises an optics mount.
12. A firearm comprising the modular firearm frame of embodiment 1.
13. A firearm comprising:
    a frame;
    a barrel mounted on the frame;
    a slide on the frame;
    a trigger shoe assembly;
    a hammer pivotally coupled to an upper portion of the frame;
    a mainspring assembly coupled to a lower portion of the frame;
    a hammer strut extending between the hammer and the mainspring assembly; and
    a slide stop removably attached to each side of the frame;
    wherein the frame is straight at a top and wherein the straight length then extends downward to form a grip;
    wherein the frame comprises a recessed socket face located at a position in the straight length of the frame and a removable finger interface is configured to fit within and attach to the recessed socket face.
14. The firearm of embodiment 12 wherein the recessed socket comprises a dovetail perimeter configured to locate and secure the removable finger interface.
15. The firearm of embodiment 12 wherein the recessed socket comprises a hole configured to accept a fastener to secure the removable finger interface.
16. The firearm of embodiment 14 wherein the fastener is a screw.
17. The firearm of embodiment 12 wherein the recessed socket comprises a counterbore keyway configured to locate and secure the removable finger interface.
18. The firearm of embodiment 12 wherein the removable finger interface further comprises an accessory.
19. The modular firearm frame of embodiment 17 wherein the removable finger interface and the accessory are integral to each other.
20. The modular firearm frame of embodiment 17 wherein the accessory comprises a support hand thumb rest, an optics mount, a storage compartment for a tool, an optics mount, a flashlight, a laser module, a vertical foregrip for a rifle, or an identifying marker.

OTHER EMBODIMENTS

1. A firearm comprising:
    a frame comprising a block member recess and a pin connector member recess;
    a barrel;
    a slide;
    a trigger shoe assembly comprising:
a trigger shoe having a back portion defining a rear channel;
a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow;
a magazine catch comprising a catch body, a catch spring, and a release mechanism configured to disengage the magazine catch; and
a magazine catch retainer plate positioned between the trigger shoe and the magazine catch, wherein the magazine catch retainer plate is configured to prevent the catch spring of said magazine catch from buckling into a trigger cavity behind the trigger shoe;
a hammer pivotally coupled to an upper portion of the frame;
a mainspring assembly coupled to a lower portion of the frame;
a hammer strut extending between the hammer and the mainspring assembly; the mainspring assembly comprising:
a main body having a top end configured to receive a distal end of the hammer strut and retain a top end of a mainspring;
a retention clip selectively secured to a second end of the main body, serving as a retention mechanism for a bottom end of the mainspring;
the main body of the mainspring assembly comprising corresponding opposed flanges facilitating slidable engagement of the mainspring assembly with the frame;
a retention mechanism configured to secure the mainspring assembly in position relative to the frame, thereby securing the position of the mainspring relative to the frame;
wherein the retention mechanism extends through a portion of the frame into engagement with the retention clip, securing the mainspring assembly relative to the frame by way of the retention clip;
a slide stop comprising:
a first portion configured to be removably attached to a side of the frame;

a second portion configured to be removably attached to an opposite side of the frame;

the first portion comprising a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide;

the second portion comprising a lever; and a mating mechanism between the first portion and the second portion, wherein the mating mechanism comprises a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame;

a relief in the inner surface of the frame wherein the relief is coaxially situated on the inner surface of the frame;

a barrel lug configured to removably attach the barrel to the frame, wherein the barrel lug further comprises a first flute and a second flute.

a sight block comprising:

a block member configured to removably attach to the block member recess;

a barrel hole;

a pin hole below the barrel hole;

a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

2. The firearm of embodiment 1, wherein the trigger shoe is dovetail shaped.

3. The firearm of embodiment 1, wherein the trigger shoe assembly comprises one or more interchangeable trigger shoes.

4. The firearm of embodiment 1, wherein the magazine catch is configured such that a magazine well is not encroached upon by the magazine catch, enabling compatibility with double stacked magazines and P320 magazines.

5. The firearm of embodiment 1, wherein the firearm further comprises an extended magazine catch button configured to release the magazine catch from a magazine.

6. The firearm of embodiment 1, wherein the frame comprises a beavertail portion at a rear end of the frame.

7. The firearm of embodiment 1, wherein the mating mechanism between the first portion and the second portion of the slide stop further comprises a locking mechanism configured to prevent accidental disengagement during an operation of the firearm.

8. The firearm of embodiment 1, wherein the first portion and the second portion of the slide stop are configured to be interchangeable.

9. The firearm of embodiment 1, wherein the pin is a threaded screw, bolt, or rod.

10. A firearm comprising:

a frame;

a barrel;

a slide;

a trigger shoe assembly comprising:

a trigger shoe having a back portion defining a rear channel;

a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow;

a magazine catch comprising a catch body, a catch spring, and a release mechanism configured to disengage the magazine catch; and a magazine catch retainer plate positioned between the trigger shoe and the magazine catch, wherein the magazine catch retainer plate is configured to prevent the catch spring of said magazine catch from buckling into a trigger cavity behind the trigger shoe;

a hammer pivotally coupled to an upper portion of the frame;

a mainspring assembly coupled to a lower portion of the frame;

a hammer strut extending between the hammer and the mainspring assembly; the mainspring assembly comprising:

a main body having a top end configured to receive a distal end of the hammer strut and retain a top end of a mainspring;

a retention clip selectively secured to a second end of the main body, serving as a retention mechanism for a bottom end of the mainspring;

the main body of the mainspring assembly comprising corresponding opposed flanges facilitating slidable engagement of the mainspring assembly with the frame;

a retention mechanism configured to secure the mainspring assembly in position relative to the frame, thereby securing the position of the mainspring relative to the frame; and wherein the retention mechanism extends through a portion of the frame into engagement with the retention clip, securing the mainspring assembly relative to the frame by way of the retention clip.

11. The firearm of embodiment 10, wherein the set screw accessible from a top of the firearm when the slide of the firearm is removed, thereby facilitating adjustment of the trigger shoe assembly without requiring complete disassembly of the firearm.

12. The firearm of embodiment 10, wherein the set screw is threaded and includes a locking mechanism, enabling the user to securely fix the desired position of the trigger bow relative to the trigger shoe.

13. The firearm of embodiment 10, wherein the magazine catch retainer plate is comprised of at least one selected from the group of steel, polymer, and carbon fiber.
14. The firearm of embodiment 10, wherein the retention mechanism comprises a threaded screw extending through the frame and engaging with the retention clip, thereby securing the mainspring assembly in position relative to the frame.
15. The firearm of embodiment 10, wherein the mainspring comprises a coiled spring element.
16. The firearm of embodiment 10, wherein at least a portion of the mainspring assembly is fabricated from a steel alloy, a polymer, or a carbon fiber.
17. The firearm of embodiment 10, wherein the front tab of the trigger bow comprises a reinforced metal insert, increasing strength and wear resistance at the engagement point with the rear channel of the trigger shoe.
18. The firearm of embodiment 10, further comprising an adjustable trigger pull weight mechanism integrated into the set screw, allowing users to customize the trigger pull force to their preference.
19. The firearm of embodiment 10, wherein the trigger shoe assembly is modular and interchangeable, allowing for customization and compatibility with different firearm models or user preferences.
20. A firearm comprising:

a frame comprising a block member recess and a pin connector member recess;

a barrel;

a slide;

a slide stop comprising:

a first portion configured to be removably attached to a side of the frame;

a second portion configured to be removably attached to an opposite side of the frame of the handgun;

the first portion comprising a lever with a distal end and a proximal end, a shaft extending substantially perpendicularly from the distal end of the lever, and a stopper extending from the proximal end of the lever, the stopper configured to mate with a stop notch on a handgun slide for locking and releasing the handgun slide;

the second portion comprising a lever; and a mating mechanism between the first portion and the second portion, wherein the mating mechanism comprises a male mating mechanism on the first portion and a female mating mechanism on the second portion, wherein the male mating mechanism is a protrusion extending from the shaft, and the female mating mechanism is a protrusion extending perpendicularly from the second lever, and the first portion and the second portion, upon mating with each other via the mating mechanism, are configured to move operably with one another such that a user can engage the stopper on either side of the frame;

a relief in the inner surface of the frame wherein the relief is coaxially situated on the inner surface of the frame;

a barrel lug configured to removably attach the barrel to the frame, wherein the barrel lug further comprises a first flute and a second flute.

a sight block comprising:

a block member configured to removably attach to the block member recess;

a barrel hole;

a pin hole below the barrel hole;

a pin connector hole running through the member and into the pin hole; and a pin and a pin connector, wherein the pin connector is threaded through the pin connector hole and the pin is threaded through the pin hole, wherein the pin removably attaches to the pin connector in the pin hole, and wherein the sight block with the pin and the pin connector attached can removably attach to the frame by connecting the member to the member recess and the pin connector to the pin connector recess.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

What is claimed is:

1. A firearm comprising:

a frame of a handgun comprising an outer surface with a first side and a second side;

a slide attached slidably to the frame comprising a stop notch; wherein the frame comprises an inner surface with at least one relief configured to capture debris; and a slide stop attached to frame, wherein the slide stop is configured to move in and out of engagement with the slide for locking and releasing the slide, wherein the slide stop comprises an integral first portion and an integral second portion removably attached to the frame, wherein the first portion is on the first side of the frame and the second portion is on the second side of the frame;

wherein the first portion comprises a first lever with a proximal end and a distal end, a shaft extending perpendicularly from the distal end of the first lever, and a stopper extending from the first lever configured to mate with the stop notch, the first lever extending along the outer surface of the frame facilitating the operation of the slide stop;

wherein the second portion comprises a second lever;

wherein the slide stop further comprises a mating mechanism between the first portion and the second portion, wherein the mating mechanism further comprises a male mating mechanism on the first portion and a female mating mechanism on the second portion wherein the male mating mechanism is a flat tab extending from the shaft configured to mate with the female mating mechanism on the second portion;

wherein the first portion and the second portion, upon mating with each other via the mating mechanism move operably with one another such that engaging the stopper with the slide stop notch is achievable with either hand of a user;

wherein the firearm further comprises an adjustable tension mechanism on the first portion to customize the force required for engaging and disengaging the stop notch.

2. The firearm of claim 1, wherein the mating mechanism between the first portion and the second portion of the slide stop further comprises a locking mechanism configured to prevent accidental disengagement during an operation of the firearm.

3. The firearm of claim 1, wherein the slide stop further comprises a visual indicator configured to indicate the status of the slide stop's engagement with the slide stop notch.

4. The firearm of claim 1, wherein the frame comprises two slide stop slots configured to fit the male mating mechanism of the first portion and the female mating mechanism of the second portion.

5. The firearm of claim 1, wherein the slide stop is made of at least one selected from the group of steel, aluminum, and titanium.

6. The firearm of claim 1, wherein the first lever of the slide stop further comprises a thumb pad with a textured surface.

7. The firearm of claim 1, wherein the second lever of the slide stop further comprises a thumb pad with a textured surface.

8. The firearm of claim 1, wherein the slide stop comprises no more than two components which components are the first portion and the second portion.

9. The firearm of claim 1, wherein the at least one relief is coaxially situated within a portion of the frame that holds a barrel.

10. The firearm of claim 9, wherein the at least one relief is curved.

11. The firearm of claim 9, wherein the at least one relief is shaped to capture debris that would be trapped in a void between the barrel and the frame in the absence of the at least one relief.

12. The firearm of claim 1, wherein the at least one relief is located proximate a muzzle end of the frame extending rearward and comprises a depression adjacent at least a portion of the frame configured to hold a barrel.

* * * * *